US006288683B1

(12) United States Patent
Deguchi et al.

(10) Patent No.: US 6,288,683 B1
(45) Date of Patent: Sep. 11, 2001

(54) ANTENNA MIRROR SURFACE MEASURING/ADJUSTING DEVICE

(75) Inventors: Hiroyuki Deguchi; Norio Miyahara; Shuji Urasaki; Soichi Matsumoto, all of Tokyo; Masato Ishiguro, Yamanashi; Tomohiro Mizuno; Shigeru Makino, both of Tokyo, all of (JP)

(73) Assignees: Mitsubishi Denki Kabushiki Kaisha; Japan Represented by Director-General National Astronomical Observatory, both of Tokyo (JP)

( * ) Notice: Subject to any disclaimer, the term of this patent is extended or adjusted under 35 U.S.C. 154(b) by 0 days.

(21) Appl. No.: 09/530,395

(22) PCT Filed: Aug. 27, 1999

(86) PCT No.: PCT/JP99/04632

§ 371 Date: Sep. 27, 2000

§ 102(e) Date: Sep. 27, 2000

(87) PCT Pub. No.: WO00/13261

PCT Pub. Date: Mar. 9, 2000

(30) Foreign Application Priority Data

Aug. 31, 1998 (JP) ..... 10-245610

(51) Int. Cl.[7] ..... H01Q 3/00

(52) U.S. Cl. ..... 343/703; 343/781 CA; 342/360

(58) Field of Search ..... 343/703, 781 CA, 343/840; 342/360

(56) References Cited

U.S. PATENT DOCUMENTS

| | | | | |
|---|---|---|---|---|
| 3,803,626 | | 4/1974 | Garrett | 343/894 |
| 3,940,858 | * | 3/1976 | Perrotti et al. | 33/228 |
| 5,119,105 | | 6/1992 | Ngai et al. | 343/703 |
| 5,374,934 | | 12/1994 | Miura et al. | 342/360 |

FOREIGN PATENT DOCUMENTS

| | | | |
|---|---|---|---|
| A60161566 | 8/1985 | (JP) | H01Q/25/02 |
| A1255301 | 10/1989 | (JP) | H01Q/19/10 |
| A9246855 | 9/1997 | (JP) | H01Q/19/10 |
| A6291541 | 10/1997 | (JP) | H01Q/19/18 |

OTHER PUBLICATIONS

Ishiguro et al., "Measurement of a Mirror Surface Accuracy of a 45m Radio Telescope by Radio Holography", vol. 62, No. 5, pp. 69–74 (1988).

* cited by examiner

*Primary Examiner*—Tan Ho
*Assistant Examiner*—Hoang Nguyen
(74) *Attorney, Agent, or Firm*—Birch, Stewart, Kolasch & Birch, LLP

(57) ABSTRACT

An antenna mirror surface measuring/adjusting apparatus has a plane mirror larger than an aperture surface of said principal reflection mirror and set in parallel with the aperture surface, an actuator for driving a group of mirror surface panels of the principal reflection mirror, and a receiving electric field arithmetic processor for measuring, each time the actuator shifts a position of the mirror surface panel from an initial state of the mirror surface panel of the principal reflection mirror, radio wave signals of radio waves radiated by a transmitter/receiver and reflected back from the plane mirror, obtaining an aperture surface phase distribution in an initial state of the principal reflection mirror by executing an arithmetic process on these measured signals, then gaining configurations of the mirror surface on the basis of the aperture surface phase distribution, and adjusting the mirror surface by the actuator in accordance with the obtained mirror surface configurations. Accordingly, a measurement frequency is freely selected, and the measurement can be carried out in an ideal measurement environment of not being influenced by changes in wind, sunlight and temperature, whereby the mirror surface can be adjusted with high accuracy.

12 Claims, 31 Drawing Sheets

(a)

(b)

ANTENNA MIRROR SURFACE MEASURING/ ADJUSTING DEVICE

This application is the national phase under 35 U.S.C. § 371 of PCT International Application No. PCT/JP99/04632 which has an International filing date of Aug. 27, 1999, which designated the United States of America.

BACKGROUND OF THE INVENTION

1. Field of the Invention

The present invention relates generally to an antenna mirror surface measuring/adjusting apparatus for measuring an accuracy of a mirror surface of a reflection mirror antenna used in a high-frequency band, or measuring and adjusting the mirror surface thereof, and more particularly to an antenna mirror surface measuring/adjusting apparatus of a large-aperture radio telescope used for an observation in millimeter waves and sub-millimeter waves.

2. Description of the Related Art

An antenna mirror surface measuring/adjusting apparatus in the prior art will be explained referring to the drawings. For example, FIGS. 31, 31A illustrate a construction of the conventional antenna mirror surface measuring/adjusting apparatus disclosed in "Surface-Error Measurement of a 45 m Radio Telescope Using Radio Holographic Metrology," written by Masato Ishiguro, Kohichiro Morita, Saeko Hayashi, Gohtoku Masuda, Takashi Hirushii, Shinichi Betsudan, pp.69–74, No.5, Vol. 62, 1988, Technical Report of Mitsubishi Electric Co.

Referring to FIGS. 31, 31A, there are illustrated a principal reflection mirror 1 of a test antenna which is an object for a mirror surface measurement, mirror surface panels 1*a* into which the mirror surface is segmented, an actuator 1*b* for changing an offset or an inclination of the mirror surface panel 1*a*, and a back structure 1*c* for supporting the mirror surface panel 1*a* and the actuator 1*b*.

Referring again to FIGS. 31, 31A, the numeral 2 designates a geostationary satellite, 3 represents a transmission antenna of which a bore site direction is aligned with a direction of the test antenna mounted on the geostationary satellite 2, and 4 denotes transmitting radio waves radiated from the transmission antenna 3. There are also shown a receipt-oriented primary focal horn 5 for receiving the radio waves after reflected by the principal reflection mirror 1 of the test antenna and converged, a receiver 6 supplied with the electricity from the receipt-oriented primary focal horn 5, a two-dimensional radiation pattern receiving signal 7 gained from the receiver 6, and antenna position angle signal 8 for biaxially changing a position of the antenna in order to obtain the radiation pattern receiving signal 7, a radio holography arithmetic processor 9 for calculating an aperture surface distribution by Fourier transform from the radiation pattern receiving signal 7 and from the antenna position angle signal 8, an actuator controller 10 for controlling the actuator 1*b* for driving the mirror surface panel 1*a*, and a reference antenna 11 serving as a base of phase.

Note that the number of the mirror surface panels 1*a* constituting the principal reflection mirror 1 is 600 in the case of a 45 m radio telescope installed in the Nobeyama National Astronomical Observatory, and 36 in the case of a 10 m antenna for millimeter wave interferometer in the Nobeyama National Astronomical Observatory.

In the antenna mirror surface measuring/adjusting apparatus shown in FIG. 31, the radio waves are used for measuring ruggedness on the principal reflection mirror 1 of the test antenna. A position of a transmission source is set well far from the test antenna as in the case of the geostationary satellite 2. A transmission source might be provided on the ground at a far distance instead of the geostationary satellite 2. In such a case, however, there might be selected such a topographic feature as to reduce an influence of the reflection on the ground surface. A radiation pattern of the test antenna is obtained by receiving the transmitting radio waves 4 while two-dimensionally changing the position of the test antenna.

With this operation, the measurement is done, wherein the two-dimensional radiation pattern receiving signal 7 is paired with the antenna position angle signal 8 representing the position of the test antenna. The radio holography arithmetic processor 10 executes an arithmetic process such as fast Fourier transform by utilizing the fact that a relationship between the two-dimensional radiation pattern and the aperture surface distribution is expressed with Fourier transform, and the aperture surface distribution of the test antenna is thus calculated.

By the way, it is required that an accuracy of the mirror surface be on the order of under 1/20 a wavelength in use if considered in terms of an antenna gain. Even in the case of a large aperture, a higher accuracy of the mirror surface must be attained as the wavelength in use becomes shorter ones such as millimeter waves and sub-millimeter waves. Therefore, a measurement frequency must be increased in order to measure the mirror surface at the still higher accuracy. In the transmission radio waves 4 of the geostationary satellite 2 shown in FIG. 31, however, the frequency is limited. Hence, there arises such a problem that the measurement accuracy can not be enhanced because of the measurement frequency being low.

Further, if the transmission source is provided on the ground, as already described in the discussion on the prior art example, the measurement accuracy is restricted due to the influence of the reflection on the ground surface. Moreover, in the case of an outdoor measurement, the measurement accuracy is restricted depending on a measurement environment such as changes in wind, sunlight and temperature. For example, the radiation pattern might be varied by a fluctuation in phase due to the atmospheric air and the shake of the principal reflection mirror due to the wind, resulting in an error of the measurement. Furthermore, in the measurement of the mirror surface using the radio wave holography, if the number of sample points for the measurement is increased for enhancing a resolution of the measurement, a measurement time increases, and the temperature might change during the measurement. Therefore, a configuration of the principal reflection mirror of the test antenna might differ depending on the positions of the sample points, resulting in the error of the measurement. A problem is that the measurement accuracy can not be enhanced in the outdoor measurement of the mirror surface using the radio wave holography.

When measuring the mirror surface indoors, a two-dimensional radiation field must be measured by performing a mechanical scan of a probe on a flat surface, a cylindrical surface and a spherical surface. A scan range is taken wider than the test antenna, and hence, in the case of the large-aperture antenna, it is difficult to precisely scan such a broad range, and the measurement accuracy is restricted by a scan accuracy of the probe. Then, a problem is that the measurement accuracy can not be enhanced.

SUMMARY OF THE INVENTION

It is an object of the present invention, which was devised to obviate the problems described above, to provide an antenna mirror surface measuring/adjusting apparatus capable of freely selecting a measurement frequency, obtaining a measurement environment of not being influenced by changes in wind, sunlight and temperature, and enhancing a measurement accuracy without two-dimensionally scanning a position of a probe even in a state where a position of the test antenna is fixed during a measurement.

According to a first aspect of the present invention, there is provided an antenna mirror surface measuring/adjusting apparatus for measuring a mirror surface of a principal reflection mirror constructed of a group of a plurality of mirror surface panels, and adjusting the mirror panel, the apparatus comprising:

a plane mirror larger than an aperture surface of the principal reflection mirror and set in parallel with the aperture surface;

transmitting/receiving means for transmitting and receiving radio waves between the principal reflection mirror and the plane mirror;

actuator means for driving the group of mirror surface panels of the principal reflection mirror; and an arithmetic processor for measuring, each time the actuator means shifts a position of the mirror surface panel from an initial state of the mirror surface panel of the principal reflection mirror, radio wave signals of radio waves which are radiated by the transmitting/receiving means and reflected back from the plane mirror, obtaining an aperture surface phase distribution in an initial state of the principal reflection mirror by executing an arithmetic process on these measured signals, then gaining configurations of the mirror surface on the basis of the aperture surface phase distribution, and adjusting the mirror surface by use of the actuator means in accordance with the thus obtained mirror surface configurations.

According to a second aspect of the present invention, in the antenna mirror surface measuring/adjusting apparatus of the first aspect, the arithmetic processor obtains a phase difference between an electric field component relative to the mirror surface panel to be driven and an electric field component given by those other than this panel by developing an amplitude and a phase of the measured electric field in complex Fourier series with respect to a driven quantity of the mirror surface panel, and thus obtains the aperture surface phase distribution.

According to a third aspect of the present invention, in the antenna mirror surface measuring/adjusting apparatus of the first aspect, the arithmetic processor obtains the phase difference between an electric field component relative to the mirror surface panel to be driven and an electric field component given by those other than this panel by developing only electric power of the measured electric field in the complex Fourier series with respect to the driven quantity of the mirror surface panel, and thus obtains the aperture surface phase distribution.

According to a fourth aspect of the present invention, in the antenna mirror surface measuring/adjusting apparatus of the first aspect, the arithmetic processor obtains the phase difference between an electric field component relative to the mirror surface panel to be driven and an electric field component given by those other than this panel by developing only a phase of the measured electric field in the complex Fourier series with respect to the driven quantity of the mirror surface panel, and thus obtains the aperture surface phase distribution.

According to a fifth aspect of the present invention, there is provided an antenna mirror surface measuring/adjusting apparatus for measuring a mirror surface of a principal reflection mirror constructed of a group of a plurality of mirror surface panels, and adjusting the mirror panel, the apparatus comprising:

a plane mirror larger than an aperture surface of the principal reflection mirror and set in parallel with the aperture surface;

transmitting/receiving means for transmitting and receiving radio waves between the principal reflection mirror and the plane mirror;

phase shifting means for changing a phase of the radio wave, provided between the plane mirror and the transmitting/receiving means;

actuator means for driving the group of mirror surface panels of the principal reflection mirror; and an arithmetic processor for measuring, each time the phase shifting means changes the phase from an initial state of the mirror surface panel of said principal reflection mirror, radio wave signals of radio waves which are radiated by the transmitting/receiving means and reflected back from the plane mirror, obtaining a phase difference between the measured electric fields by developing the electric power of these measured electric fields in complex Fourier series with respect to a quantity of the phase change by the phase shifting means, obtaining an aperture surface phase distribution in an initial state of the principal reflection mirror therefrom, then gaining configurations of the mirror surface on the basis of the aperture surface phase distribution, and adjusting the mirror surface by use of the actuator means in accordance with the thus obtained mirror surface configurations.

According to a sixth aspect of the present invention, there is provided an antenna mirror surface measuring/adjusting apparatus for measuring a mirror surface of a principal reflection mirror constructed of a group of a plurality of mirror surface panels, and adjusting the mirror panel, the apparatus comprising:

a plane mirror larger than an aperture surface of the principal reflection mirror, set in parallel with the aperture surface, and constructed of a group of a plurality of segmented plane panels;

transmitting/receiving means for transmitting and receiving radio waves between the principal reflection mirror and the plane mirror;

actuator means for driving the group of mirror surface panels of the principal reflection mirror, and the group of segmented plane panels of the plane mirror; and an arithmetic processor for measuring, each time said actuator means shifts a position of the segmented plane panel from an initial state of the mirror surface panel of the principal reflection mirror, radio wave signals of radio waves which are radiated by the transmitting/receiving means and reflected back from the plane mirror, obtaining an aperture surface phase distribution in an initial state of the principal reflection mirror by executing an arithmetic process on these measured signals, then gaining configurations of the mirror surface on the basis of the aperture surface phase distribution, and adjusting the mirror surface by use of the actuator means in accordance with the thus obtained mirror surface configurations.

According to a seventh aspect of the present invention, in the antenna mirror surface measuring/adjusting apparatus of the first aspect, the plane mirror is constructed of a first plane mirror orthogonal to a direction of the gravity, and a second plane mirror parallel to a plane including the direction of the gravity, and the arithmetic processor performs the measurement arithmetic process in such a way that the aperture surface of the principal reflection mirror is disposed in parallel to the first plane mirror, and next performs the measurement arithmetic process in such a way that the aperture surface of the principal reflection mirror is disposed in parallel to the second plane mirror.

According to an eighth aspect of the present invention, the antenna mirror surface measuring/adjusting apparatus of the first aspect further comprises a high-order mode generator capable of exciting the radio waves radiated from the transmitting/receiving means in a specified high-order mode.

According to a ninth aspect of the present invention, the antenna mirror surface measuring/adjusting apparatus of the first aspect further comprises a high-order mode synthesizer capable of exciting the radio waves radiated from the transmitting/receiving means by synthesizing a plurality of modes.

According to a tenth aspect of the present invention, the antenna mirror surface measuring/adjusting apparatus of the first aspect further comprises an electric supply device capable of independently exciting the radio waves radiated from the transmitting/receiving means respectively in a base mode and in a specified high-order mode.

According to an eleventh aspect of the present invention, in the antenna mirror surface measuring/adjusting apparatus of the first aspect, the arithmetic processor receives, each time the actuator means shifts a position of the single of mirror surface panel or shifts simultaneously positions of the plurality of mirror surface panels so that the electric power with which the mirror surface of the principal reflection mirror is irradiated becomes uniform, the radio waves radiated from the transmitting/receiving means and reflected back to the transmitting/receiving means from the plane mirror, then obtains the aperture surface phase distribution in the initial state of the principal reflection mirror by executing the arithmetic process on the radio waves, and gaining the mirror surface configurations therefrom.

According to a twelfth aspect of the present invention, there is provided an antenna mirror surface measuring/adjusting apparatus for measuring a mirror surface of a principal reflection mirror constructed of a group of a plurality of mirror surface panels, and adjusting the mirror panel, the apparatus comprising:

a plane mirror larger than an aperture surface of the principal reflection mirror;

transmitting/receiving means for transmitting and receiving radio waves between the principal reflection mirror and the plane mirror;

actuator means for driving the group of mirror surface panels of the principal reflection mirror; and an arithmetic processor for measuring, each time the actuator means shifts a position of the mirror surface panel from an initial state of the mirror surface panel of the principal reflection mirror, radio wave signals of radio waves which are radiated by the transmitting/receiving means and reflected back from the plane mirror, obtaining an aperture surface phase distribution in an initial state of the principal reflection mirror by executing an arithmetic process on these measured signals, then gaining configurations of the mirror surface on the basis of the aperture surface phase distribution, and adjusting the mirror surface by use of the actuator means in accordance with the thus obtained mirror surface configurations, in which an aperture surface of the principal reflection mirror is set at an angle orthogonal to an arbitrary side lobe direction with respect to the plane mirror.

DESCRIPTION OF THE PREFERRED EMBODIMENTS

<Embodiment 1>

Figure 1:
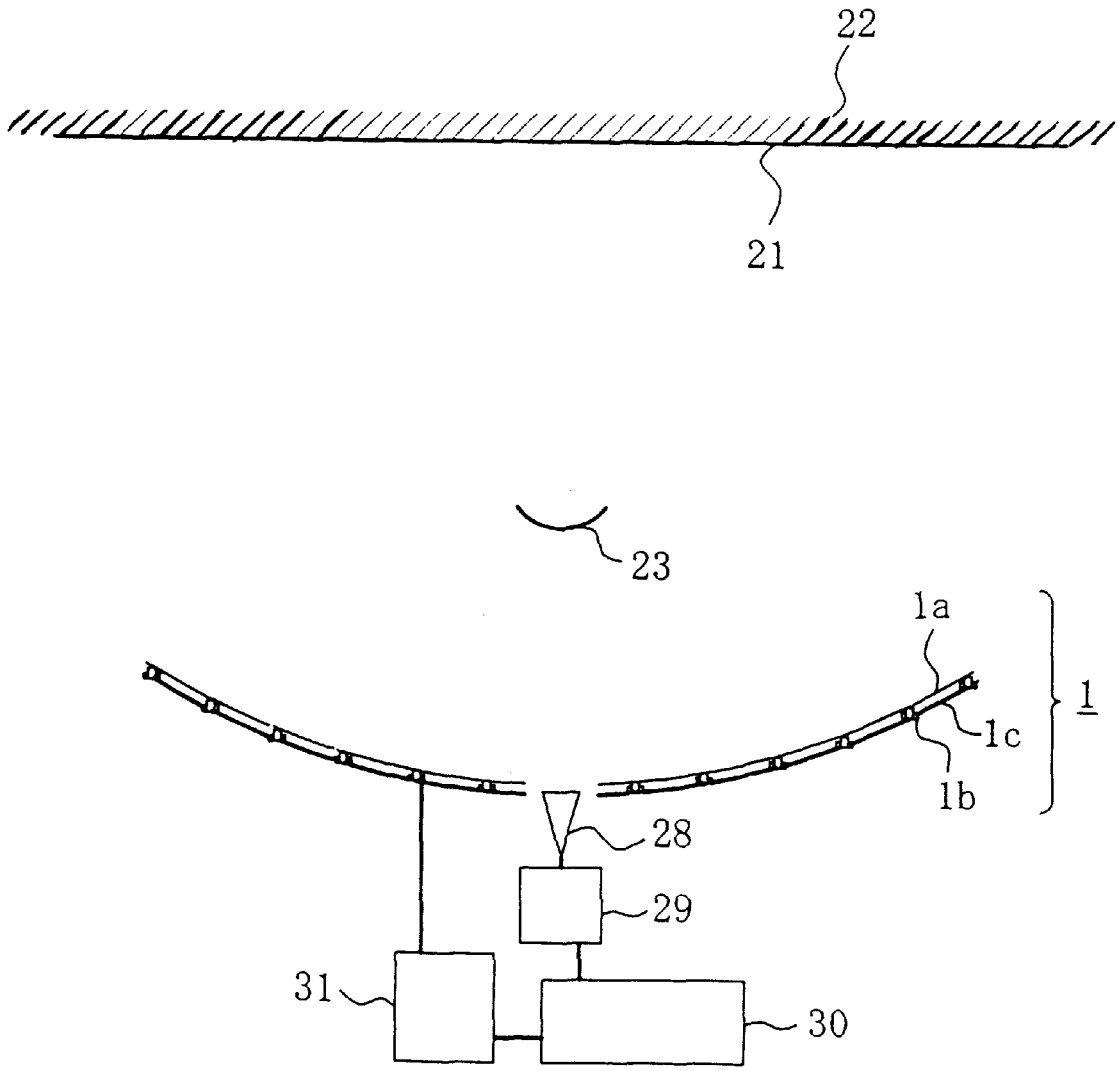
FIG. 1 is a diagram showing a construction of an antenna mirror surface measuring/adjusting apparatus according to an embodiment 1 of the present invention.

An antenna mirror surface measuring/adjusting apparatus according to an embodiment 1 of the present invention will hereinafter be described with reference to the drawings. FIG. 1 is a view illustrating a construction of the antenna mirror surface measuring/adjusting apparatus according to the embodiment 1 of the present invention. Note that the same reference numerals denote the identical or corresponding components throughout the drawings.

In FIG. 1, a principal reflection mirror 1 of a test antenna includes as its components a mirror surface panel 1*a* configured such that the surface of the principal reflection mirror 1 for reflecting radio waves is segmented, an actuator 1*b* for shifting the mirror surface panel 1*a* to a predetermined position, and a back structure 1*c* for holding the mirror surface panel 1*a* and the actuator 1*b*.

Also, there are shown in FIG. 1, a plane mirror 21 having a large aperture, and a plane mirror support member 22 for holding the large-aperture plane mirror 21.

FIG. 1 still further shows an auxiliary reflection mirror 23 of the test antenna, a transmission/receipt shared primary radiator 28, a transmitter/receiver 29, a receiving electric field arithmetic processor 30 such as a personal computer, and an actuator controller 31.

Figure 2:
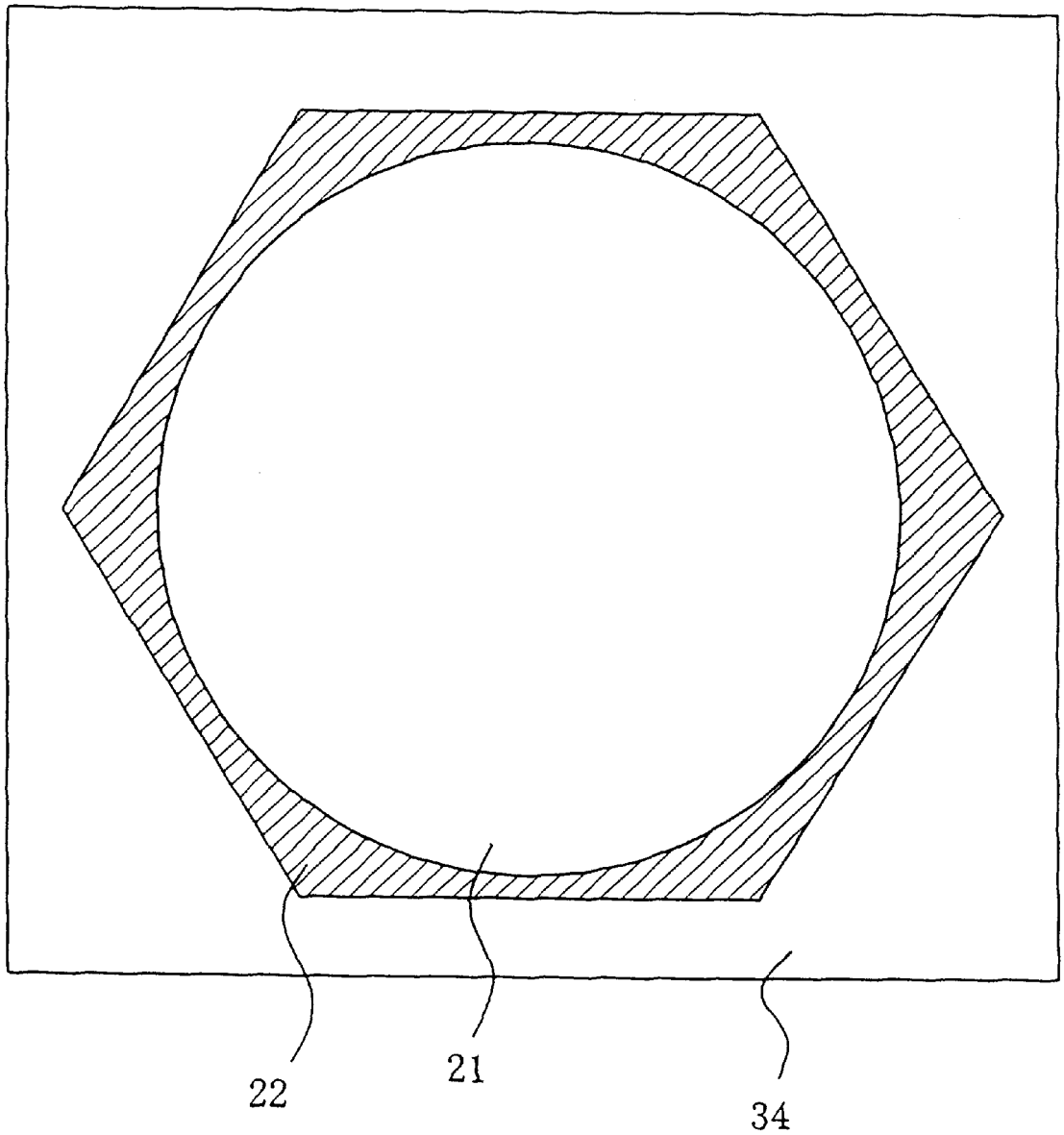
FIG. 2 is a front view showing a large-aperture plane mirror of the antenna mirror surface measuring/adjusting apparatus according to the embodiment 1 of the present invention.

FIG. 2 is a front view showing the large-aperture plane mirror of the antenna mirror surface measuring/adjusting apparatus according to the embodiment 1. In FIG. 2, there are illustrated the large-aperture plane mirror 21, the plane mirror support member 21 for holding the large-aperture plane mirror 21, and a ceiling 34.

Next, an operation of the antenna mirror surface measuring/adjusting apparatus according to the embodiment 1 discussed above, will be explained with reference to the drawings.

To start with, the principal reflection mirror 1 of the test antenna is directed toward the large-aperture plane mirror 21 disposed in front, and a bore site direction thereof is set orthogonal to the mirror surface of the large-aperture plane firro 21. During a measurement, a position of the test antenna is fixed in this state.

Then, at the first onset, the radio waves for measurement are radiated from the test antenna. The radio waves generated by the transmitter/receiver 29 and transmitted from the transmission/receipt shared primary radiator 28, travel through the auxiliary reflection mirror 23, the principal mirror 1 and the larger-aperture plane mirror 21 of the test antenna in this sequence. As a result, a large proportion of waves that are incident upon the larger-aperture plane mirror 21 are plane waves, and the radio waves reflected therefrom are reversely reflected toward the principal reflection mirror 1, the reflected waves arrive at the transmission/receipt shared primary radiator 28 and the transmitter/receiver 29 via the principal reflection mirror 1 and the auxiliary reflection mirror 23 of the test antenna in this sequence. As to receiving electric power, a large proportion of transmitting electric power is received excluding spillover electric power and a loss.

In step 1, a measurement in an initial state is made. In this embodiment 1, both of an amplitude and a phase of the receiving electric field in this state are measured.

Executed in step 2 is a measurement in a state where the phase of the electric field is changed. In accordance with the embodiment 1, the actuator controller 31 transmits a control signal to the actuator 1*b*, and one certain sheet of mirror surface panel 1*a* is driven in the bore site direction by the actuator 1*b*. A drive range is ½ or more of a wavelength in use, while the mirror surface panels other than this driven panel remain fixed. Then, in this state, both of the amplitude and the phase of the receiving electric field are measured. The amplitude and the phase measured herein are different from those of the electric field which have been measured in step 1.

Herein, let $\Delta z$ be a shift from the initial state of the mirror surface panel 1*a*. Then, step 2 is repeated while changing the driven quantity (shift quantity) $\Delta z$ of the mirror surface panel 1*a*, and the electric field is received.

For example, when step 2 is repeated N-times, the driven quantity $\Delta z$ is given by the following formula:

$$\Delta z=\Delta zi(i=1, 2, \ldots, N)$$

A receiving electric field E measured is expressed, as a function of the driven quantity$\Delta z$, as $E=E(\Delta z)$. Hence, let Ei be the receiving electric field when the driven quantity is $\Delta zi$, and this receiving electric field Ei is given by the following formula:

$$Ei=E(\Delta zi)$$

In step 3, a phase difference of the electric field is obtained by an arithmetic process. In the embodiment 1, the receiving electric field arithmetic processor 30 develops the measured electric field in complex Fourier series with respect to the driven quantity. A constant term (0-th order) of the complex Fourier series corresponds to the electric power given through what is exclusive of the single mirror surface panel driven, and a first-order term of the complex Fourier series corresponds to a change in the electric power given by driving the single mirror surface panel. Higher-order terms correspond to a wave effect of edge diffraction waves of the mirror surface panel as well as to an influence due to an error of the measurement. The electric field relative to the mirror surface panel to be driven and the electric field given by those other than this panel, are thereby obtained, and hence there is obtained a difference in terms of phase of excitation between the single mirror surface panel and the panels excluding this single panel.

It is the configuration of the mirror surface to be measured when the driven quantity of the mirror surface panel is 0, and it is therefore feasible to obtain a shift from a certain position in the initial state of the driven single mirror surface panel by getting a phase difference therebetween when the driven quantity is 0.

Similarly, another mirror surface panel is set as what is driven, and the processes steps 1 through 3 are executed.

These processes are effected for all the mirror surface panels, whereby it is possible to know how far each mirror surface panel is shifted from a given position.

In step 4, a map showing the mirror surface configuration is created. In the embodiment 1, an average value is obtained from all the values obtained by repeating the processes in steps 1 through 3, and a shift is gained from this average value. A thus procured distribution corresponds to an aperture surface phase distribution, and the map showing the mirror surface configuration having a resolution corresponding to a size of the mirror surface panel, is obtained therefrom.

With the test antenna position remaining unchanged, the electric power radiated from the antenna is directed toward the large-aperture plane mirror 21 from the beginning to the end, and there is almost no radiation in directions other than the above. Especially in the case of millimeter waves and sub-millimeter waves, if a scatterer defined as a reflective object exists in the surrounding in the first place, there are no incident waves on such a surrounding, and hence an influence upon the ambient reflection may be ignored.

Further, the test antenna and the large-aperture plane mirror 21 may be disposed at a sufficiently close distance. Hence, if a location for the measurement is indoor, the building does not require an extensive space.

As a matter of course, a scanner device often used for a vicinal field measurement is not necessary. Accordingly, a measurement frequency is freely selected, a position of a probe is not two-dimensionally scanned, the position of the test antenna is fixed during the measurement, and the measurement can be carried out in an ideal measurement environment of not being influenced by changes in wind, sunlight and temperature. As a result, the configuration of the mirror surface of the antenna can be measured with high accuracy, and the mirror surface can be highly precisely adjusted based on an error on the mirror surface which is obtained therefrom.

Namely, according to the antenna mirror surface measuring/adjusting apparatus in the embodiment 1, the apparatus for measuring the mirror surface of the test antenna constructed of a group of the plurality of mirror surface panels into which the principal reflection mirror 1 is segmented, and for adjusting the mirror surface panel, includes the plane mirror 21 larger than the aperture surface of the test antenna, and the actuator 1*b* for driving the mirror surface panel group of the test antenna. The apparatus is characterized in that: the position of the test antenna is fixed by setting the plane mirror 21 in parallel to the aperture surface of the test antenna; each time the actuator 1*b* shifts the position of the mirror surface panel from the initial state of the mirror surface panel 1*a* of the test antenna, the radio waves radiated from the test antenna are reflected by the plane mirror 21, and the radio waves returning to the test antenna are received; the receiving electric field thereof is arithmetically processed, thereby obtaining the aperture surface phase distribution in the initial state of the test antenna; and the configuration of the mirror surface is obtained from this aperture surface phase distribution. In the apparatus, the mirror surface is adjusted based on the obtained error on the mirror surface.

Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 2>

Figure 3:
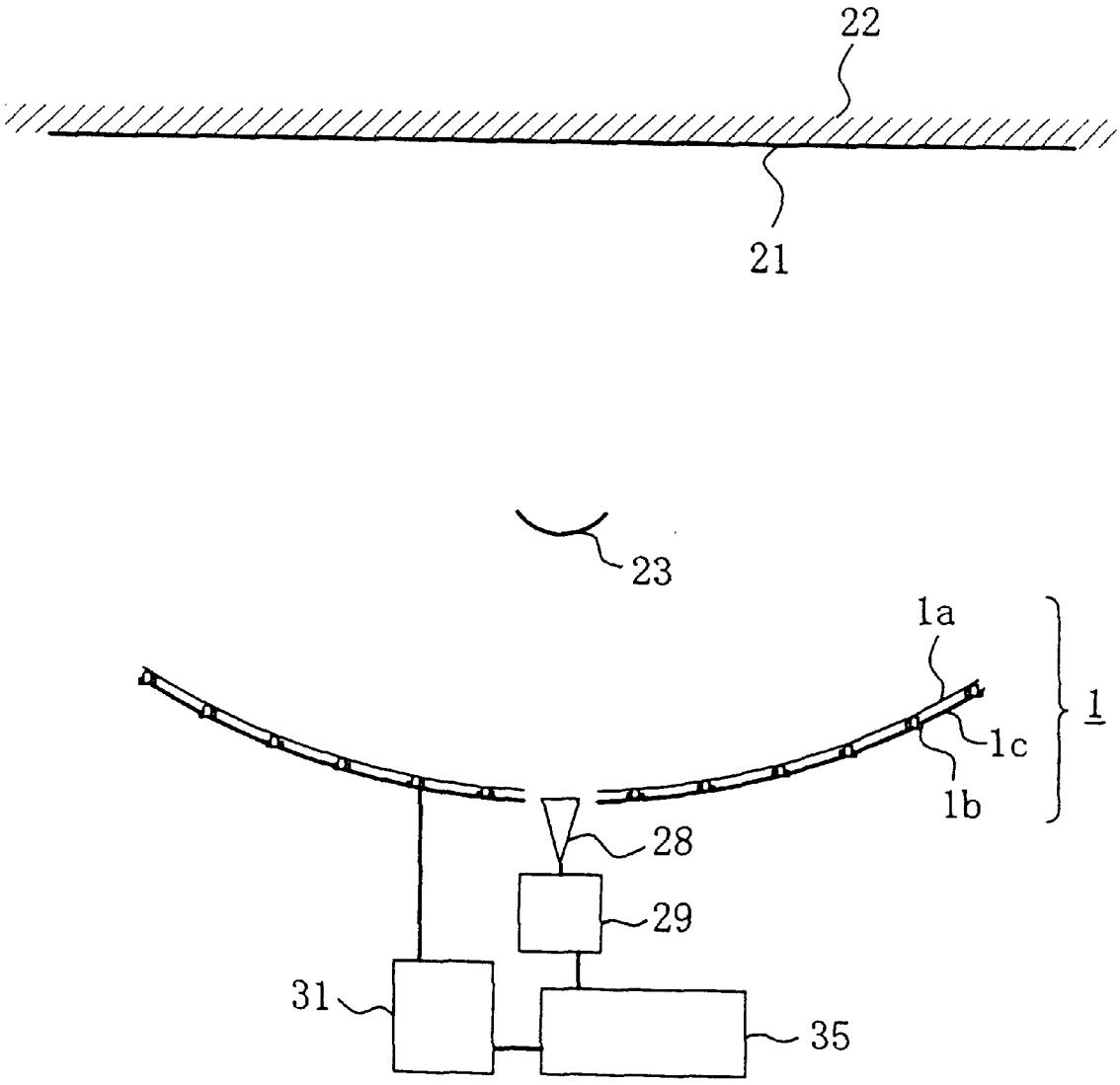
FIG. 3 is a diagram showing a construction of an antenna mirror surface measuring/adjusting apparatus according to an embodiment 2 of the present invention.

The antenna mirror surface measuring/adjusting apparatus in a second embodiment of the present invention will be described with reference to the drawings. FIG. 3 is a view showing a construction of the antenna mirror surface measuring/adjusting apparatus in the second embodiment of the present invention.

Referring to FIG. 3, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23, the transmission/receipt shared primary radiator 28, the transmitter/receiver 29, and the actuator controller 31. These components are the same as those in the embodiment 1 and perform the same operations as those therein. Further, the numeral 35 designates a receiving electric power arithmetic processor.

The radio waves radiated from the test antenna are reflected by the large-aperture plane mirror 21 from the principal reflection mirror 1. The radio waves are again reflected by the principal reflection mirror 1 and travel back.

When repeating the measuring procedures in steps 1 and 2, only the electric power of the receiving electric field is measured, whereas the phase of the receiving electric field is not measured.

In step 3, the measured electric power is developed the in complex Fourier series with respect to the driven quantity. The constant term (0-th order) of the complex Fourier series corresponds to the electric power given through what is exclusive of the single mirror surface panel driven, and the first-order term of the complex Fourier series corresponds to the change in the electric power given by driving the single mirror surface panel. Moreover, higher-order terms correspond to the wave effect of edge diffraction waves of the mirror surface panel as well as to the influence due to the error of the measurement.

The change in the electric power due to the drive of the single mirror surface panel occurs because of a variation in the excitation phase of the single mirror surface panel with respect to an excitation phase of a group of other mirror surface panels, and can be formularized on the assumption that the electric fields of both of them are superposed with phases different from each other. Accordingly, a phase term defined as an unknown quantity is readily gained from a trajectory of the change in the electric power. The thus obtained phase represents how far each mirror surface panel is shifted from a given position.

Step 4 is the same as step 4 in the embodiment 1. The thus procured distribution corresponds to the aperture surface phase distribution, and the map indicating the mirror surface configuration having a resolution corresponding to a size of the mirror surface panel, may be obtained therefrom. It is the same as the embodiment 1 that the position of the test antenna is not changed, and that the distance between the test antenna and the large-aperture plane mirror 21 can be taken sufficient. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 3>

Figure 4:
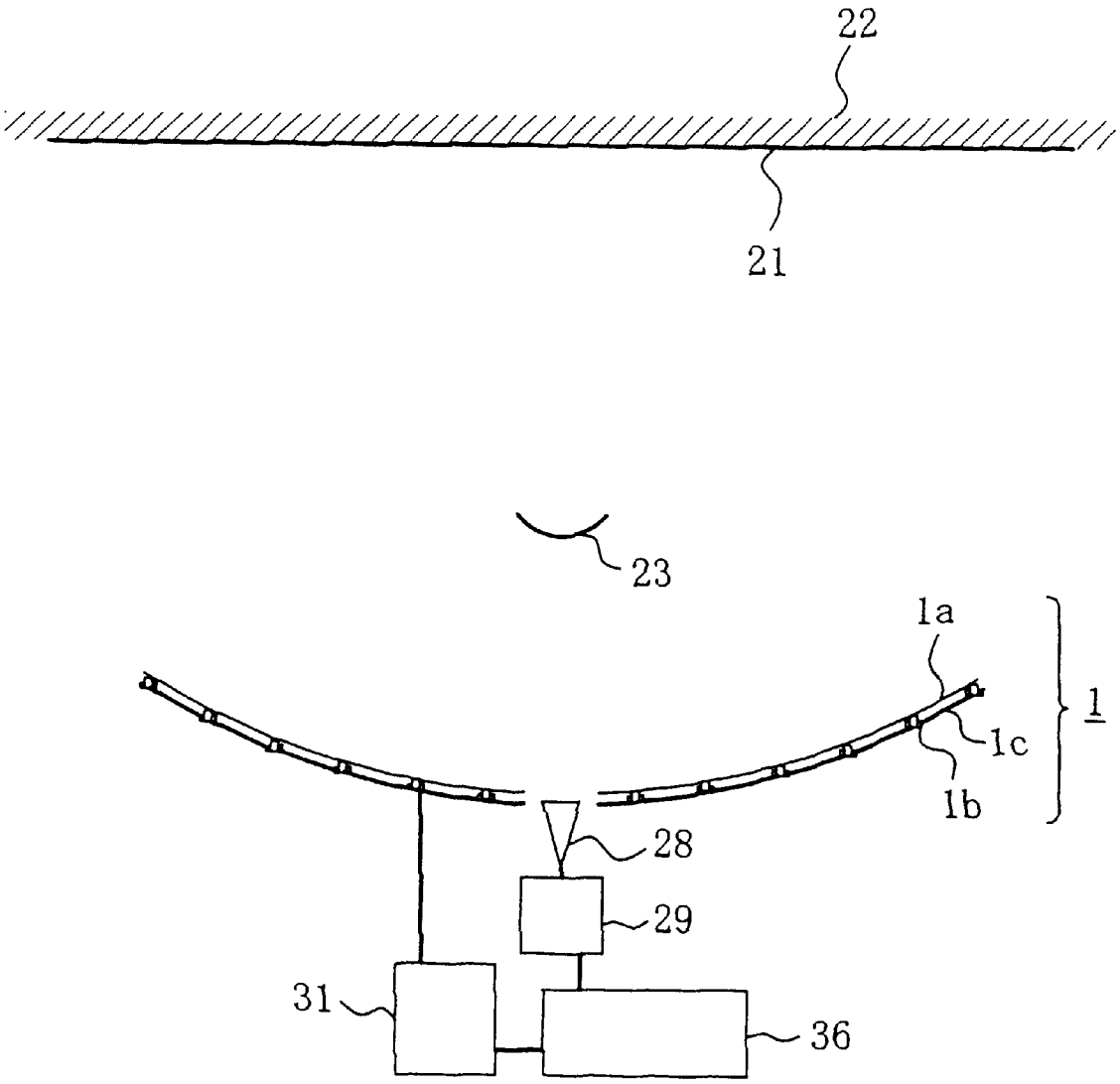
FIG. 4 is a diagram showing a construction of an antenna mirror surface measuring/adjusting apparatus according to an embodiment 3 of the present invention.

The antenna mirror surface measuring/adjusting apparatus in a third embodiment of the present invention will be discussed with reference to the drawings. FIG. 4 is a view showing a construction of the antenna mirror surface measuring/adjusting apparatus in the third embodiment of the present invention.

Referring to FIG. 4, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23, the transmission/receipt shared primary radiator 28, the transmitter/receiver 29, and the actuator controller 31. These components are the same as those in the embodiment 1 and perform the same operations as those therein. Further, the numeral 36 designates a receiving phase arithmetic processor.

The radio waves radiated from the test antenna are reflected by the large-aperture plane mirror 21 from the principal reflection mirror 1. The radio waves are again reflected by the principal reflection mirror 1 and travel back.

When repeating the measuring procedures in steps 1 and 2, only the phase of the receiving electric field is measured, whereas the electric power of the receiving electric field is not measured.

In step 3, a phase difference between an electric field component given by what is exclusive of the single mirror surface panel driven and an electric field component given by driving the single mirror surface panel, is obtained from a change in the measured phase when varying the driven quantity of the mirror surface panel 1*a*. the thus obtained phase difference represents how far each mirror surface panel is shifted from a given position.

Step 4 is the same as step 4 in the embodiment 1 discussed above. The thus procured distribution corresponds to the aperture surface phase distribution, and the maps indicating the mirror surface configurations having resolutions corresponding to sizes of the mirror surface panels, are obtained therefrom. It is the same as the embodiment 1 that the position of the test antenna is not changed, and that the distance between the test antenna and the large-aperture plane mirror 21 can be taken sufficient. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 4>

Figure 5:
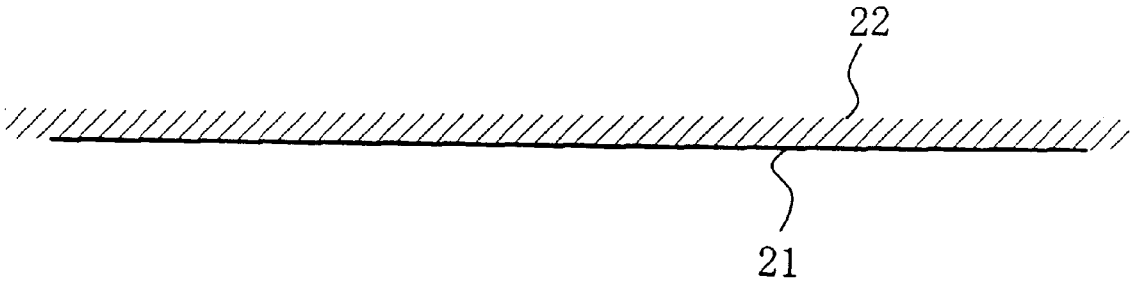
FIG. 5 is a diagram showing a construction of an antenna mirror surface measuring/adjusting apparatus according to an embodiment 4 of the present invention.
Figure 5:
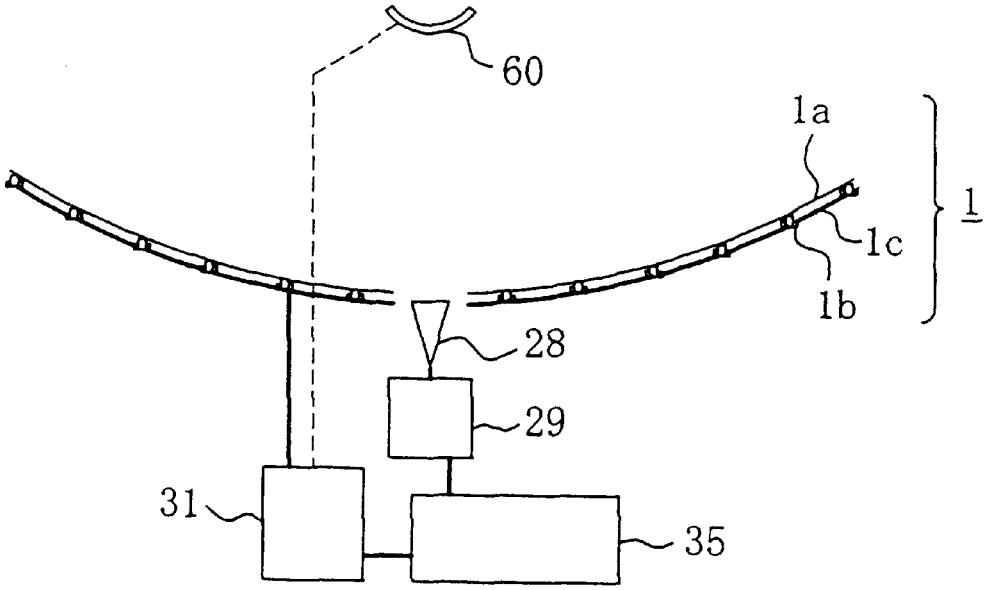

The antenna mirror surface measuring/adjusting apparatus in a fourth embodiment of the present invention will be discussed with reference to the drawings. FIG. 5 is a view showing a construction of the antenna mirror surface measuring/adjusting apparatus in the fourth embodiment of the present invention.

Referring to FIG. 5, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the transmission/receipt shared primary radiator 28, the transmitter/receiver 29, the actuator controller 31, and the receiving electric power arithmetic processor 35. These components are the same as those in the embodiment 2 and perform the same operations as those therein. Further, the numeral 60 designates an active auxiliary reflection mirror capable of partially changing the configuration of the mirror surface.

In the embodiment 4, the mirror surface panel 1*a* of the principal reflection mirror 1 is in a state of being fixed during the measurement but is not driven as in the embodiments 1 to 3.

Step 1 is the same as step 1 in the embodiment 1.

In step 2, a part of the active auxiliary reflection mirror 60 is moved within a range that is ½ or more of the wavelength in use, and the receiving electric power is measured by partially changing a difference between lengths of optical paths. Step 2 is repeated by changing a driven quantity of a part of the active auxiliary reflection mirror 60.

In step 3, this measured electric power is developed in the Fourier series with respect to the driven quantity of a part of the active auxiliary reflection mirror 60. It is equivalent in terms of geometrical optics to changing the aperture surface phase distribution of the principal reflection mirror 1 that a part of the active auxiliary reflection mirror 60 is driven. Accordingly, as in the embodiment 2, it is feasible to obtain how much the configuration of the mirror surface of the principal reflection mirror 1 deviates from a certain state. The resolution in the map representing the configuration of the mirror surface, which is thereby procured, corresponds to a size of the driven part of the active auxiliary reflection mirror 60.

Step 4 is the same as step 4 in the embodiment 1. The configuration of the mirror surface of the principal reflection mirror 1 may be obtained by the above operation. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 5>

Figure 6:
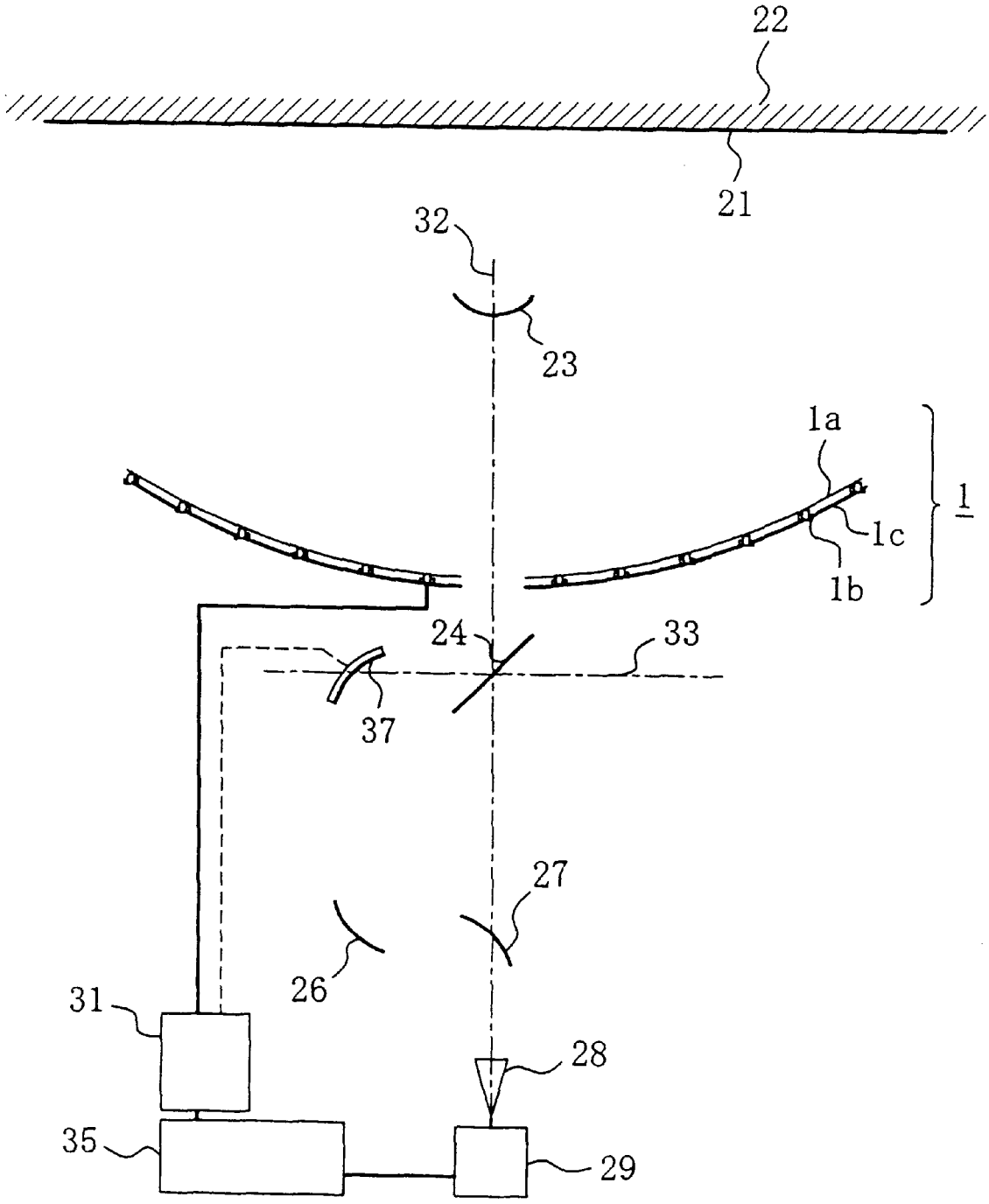
FIG. 6 is a diagram showing a construction of an antenna mirror surface measuring/adjusting apparatus according to an embodiment 5 of the present invention.

The antenna mirror surface measuring/adjusting apparatus in a fifth embodiment of the present invention will be discussed with reference to the drawings. FIG. 6 is a view showing a construction of the antenna mirror surface measuring/adjusting apparatus in the fifth embodiment of the present invention.

Referring to FIG. 6, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23, the transmission/receipt shared primary radiator 28, the transmitter/receiver 29, and the actuator controller 31. These components are the same as those in the embodiment 1, and the reference numeral 35 designates the receiving electric power arithmetic processor which operates the same as the embodiment 2.

Referring again to FIG. 6, there are further illustrated a beam supply first reflection mirror 24, a beam supply third reflection mirror 26, a beam supply fourth reflection mirror 27, an azimuth axis 32, an elevation axis 33, and a beam supply active mirror surface 37 capable of partially changing the configuration of the mirror surface.

During the measurement, the mirror surface panel 1*a* of the principal reflection mirror 1 is in the state of being fixed but is not driven as in the embodiments 1 to 3.

Step 1 is the same as step 1 in the embodiment 1.

In step 2, a part of the beam supply active mirror surface 37 is moved within a range that is ½ or more of the wavelength in use, and the receiving electric power is measured by partially changing a difference between lengths of optical paths. Step 2 is repeated by changing a driven quantity of a part of the beam supply active mirror surface 37.

In step 3, this measured electric power is developed in the Fourier series with respect to the driven quantity of a part of the beam supply active mirror surface 37. It is equivalent interms of geometrical optics to changing the aperture surface phase distribution of the principal reflection mirror 1 that a part of the beam supply active mirror surface 37. Hence, as in the embodiment 2, it is feasible to obtain how much the configuration of the mirror surface of the principal reflection mirror 1 deviates from a certain state. The resolution in the map representing the configuration of the mirror surface, which is thereby procured, corresponds to a size of the driven part of the beam supply active mirror surface 37. step 4 is the same as step 4 in the embodiment 1. The configuration of the mirror surface of the principal reflection mirror 1 may be obtained by the above operation. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 6>

Figure 7:
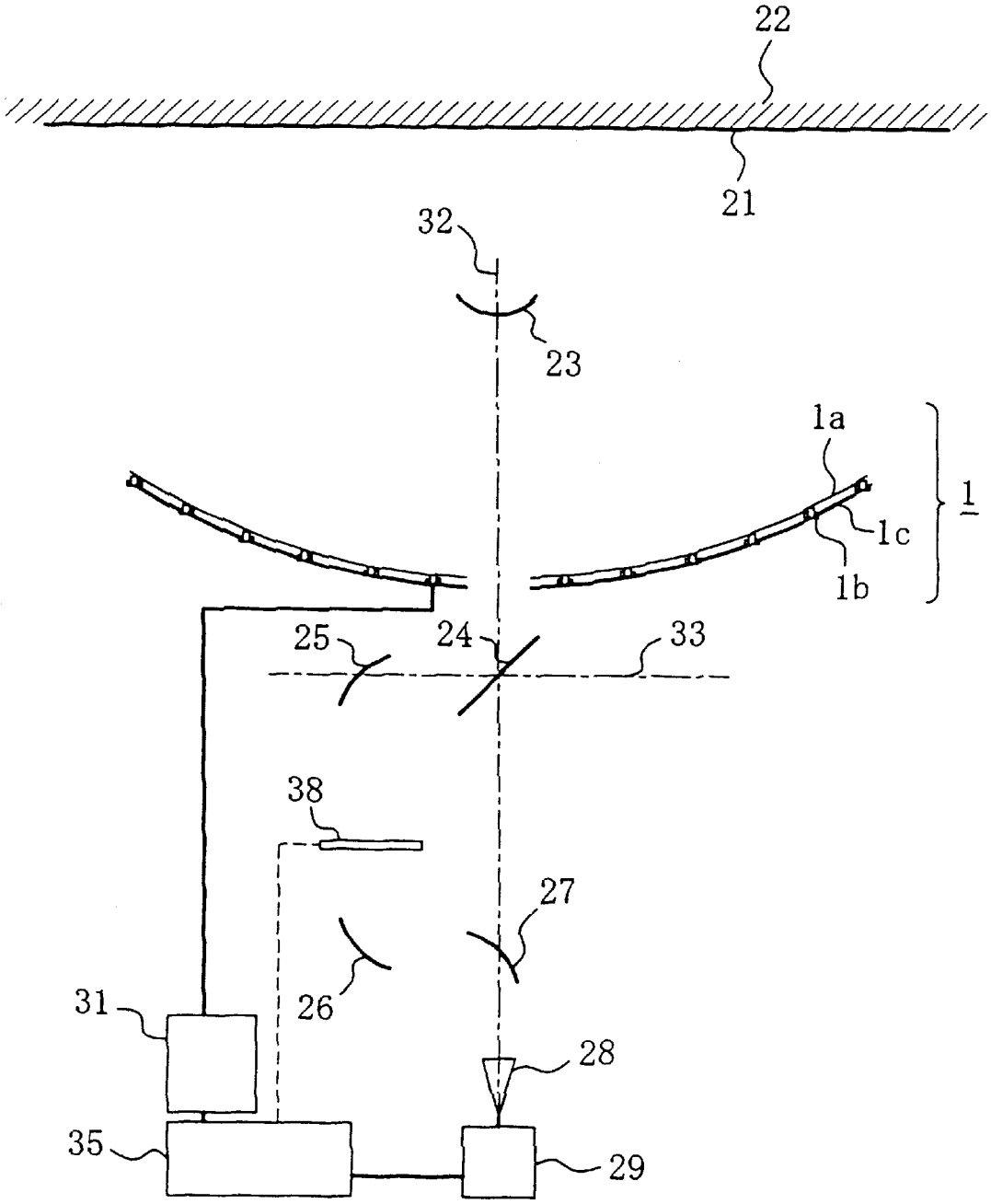
FIG. 7 is a diagram showing a construction of an antenna mirror surface measuring/adjusting apparatus in an embodiment 6 of the present invention.

The antenna mirror surface measuring/adjusting apparatus in a sixth embodiment of the present invention will be discussed with reference to the drawings. FIG. 7 is a view showing a construction of the antenna mirror surface measuring/adjusting apparatus in the sixth embodiment of the present invention.

Referring to FIG.7, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23, the transmission/receipt shared primary radiator 28, the transmitter/receiver 29, and the actuator controller 31. These components are the same as those in the embodiment 1, and the reference numeral 35 designates the receiving electric power arithmetic processor which operates the same as the embodiment 2.

Referring again to FIG. 6, there are further illustrated the beam supply first reflection mirror 24, the beam supply third reflection mirror 26, the beam supply fourth reflection mirror 27, the azimuth axis 32, the elevation axis 33, which are the same as those in the fifth embodiment discussed above and perform the same operations as those therein. Further, the numeral 25 represents a beam supply second reflection mirror, and 38 denotes a transmission type phase shifter for partially shifting a phase of the transmitting radio waves.

During the measurement, the mirror surface panel 1*a* of the principal reflection mirror 1 is in the state of being fixed but is not driven as in the embodiments 1 to 3.

Step 1 is the same as step 1 in the embodiment 1.

In step 2, a part of the transmission type phase shifter 38 is moved within a range that is ½ or more of the wavelength in use, and the receiving electric power is measured.

In step 3, this measured electric power is developed in the Fourier series with respect to the phase shift of a part of the transmission type phase shifter 38. It is equivalent in terms of geometrical optics to changing the aperture surface phase distribution of the principal reflection mirror 1 that the phase of a part of the transmission type phase shifter 38 is shifted. Hence, as in the embodiment 2, it is feasible to obtain how much the configuration of the mirror surface of the principal reflection mirror 1 deviates from a certain state. The resolution in the map representing the configuration of the mirror surface, which is thereby procured, corresponds to a size of the phase-shifted part of the transmission type phase shifter 38.

Step 4 is the same as step 4 in the embodiment 1. The configuration of the mirror surface of the principal reflection mirror 1 may be obtained by the above operation. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 7>

Figure 8:
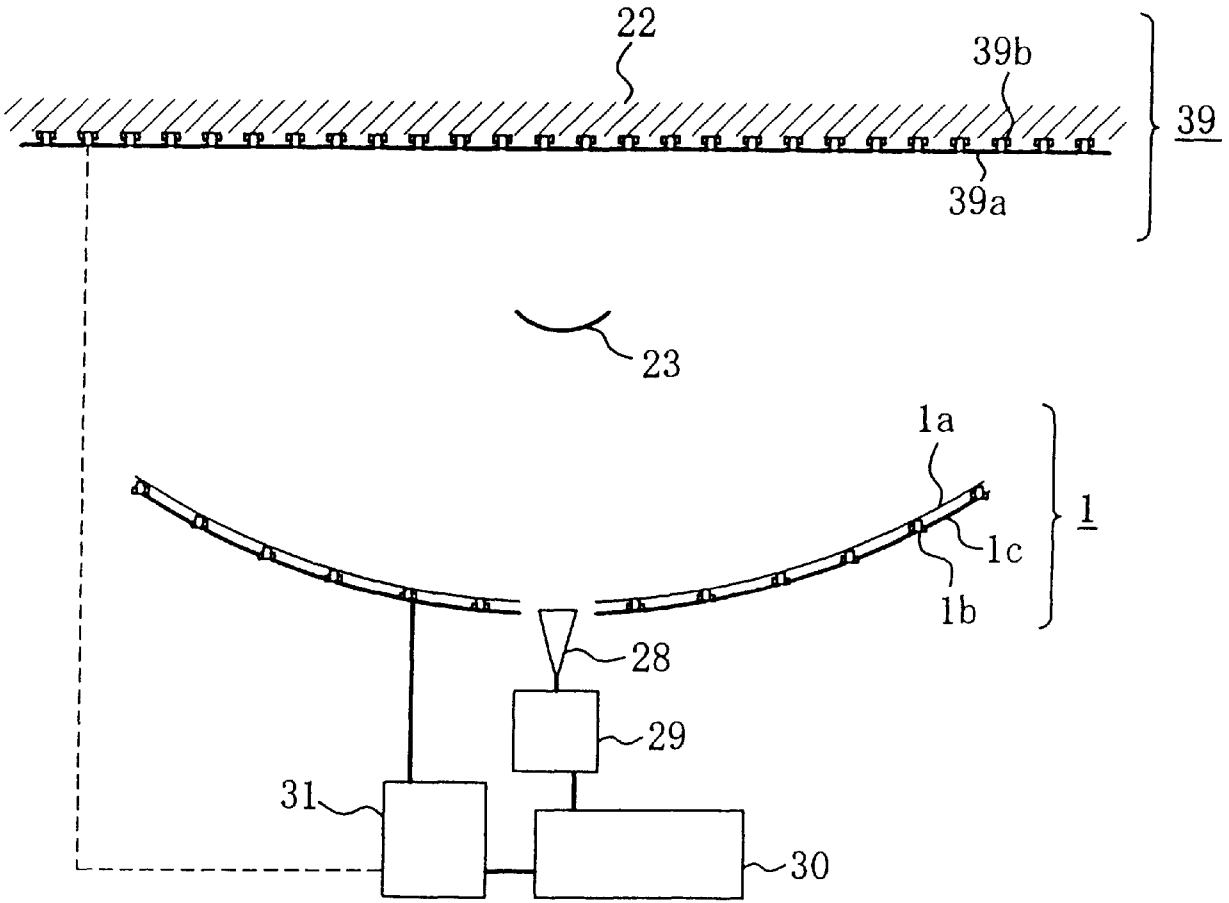
FIG. 8 is a diagram showing a construction of an antenna mirror surface measuring/adjusting apparatus according to an embodiment 7 of the present invention.

The antenna mirror surface measuring/adjusting apparatus in a seventh embodiment of the present invention will be discussed with reference to the drawings. FIG. 8 is a view showing a construction of the antenna mirror surface measuring/adjusting apparatus in the seventh embodiment of the present invention.

Referring to FIG. 8, the principal reflection mirror 1 of the test antenna is constructed of the mirror surface panel 1*a*, the actuator 1*b*, and the back structure ic. There are also shown the plane mirror support member 22, the auxiliary reflection mirror 23, the transmission/receipt shared primary radiator 28, the transmitter/receiver 29, the receiving electric field arithmetic processor 30, and the actuator controller 31. These components are the same as those in the embodiment 1 and perform the same operations as those therein. There are further illustrated a large-aperture active plane mirror 39, segmented plane panels 39*a* into which the plane mirror is segmented, and a segmented plane panel driving mechanism 39*b* for driving the segmented plane panels 39*a*.

Figure 9:
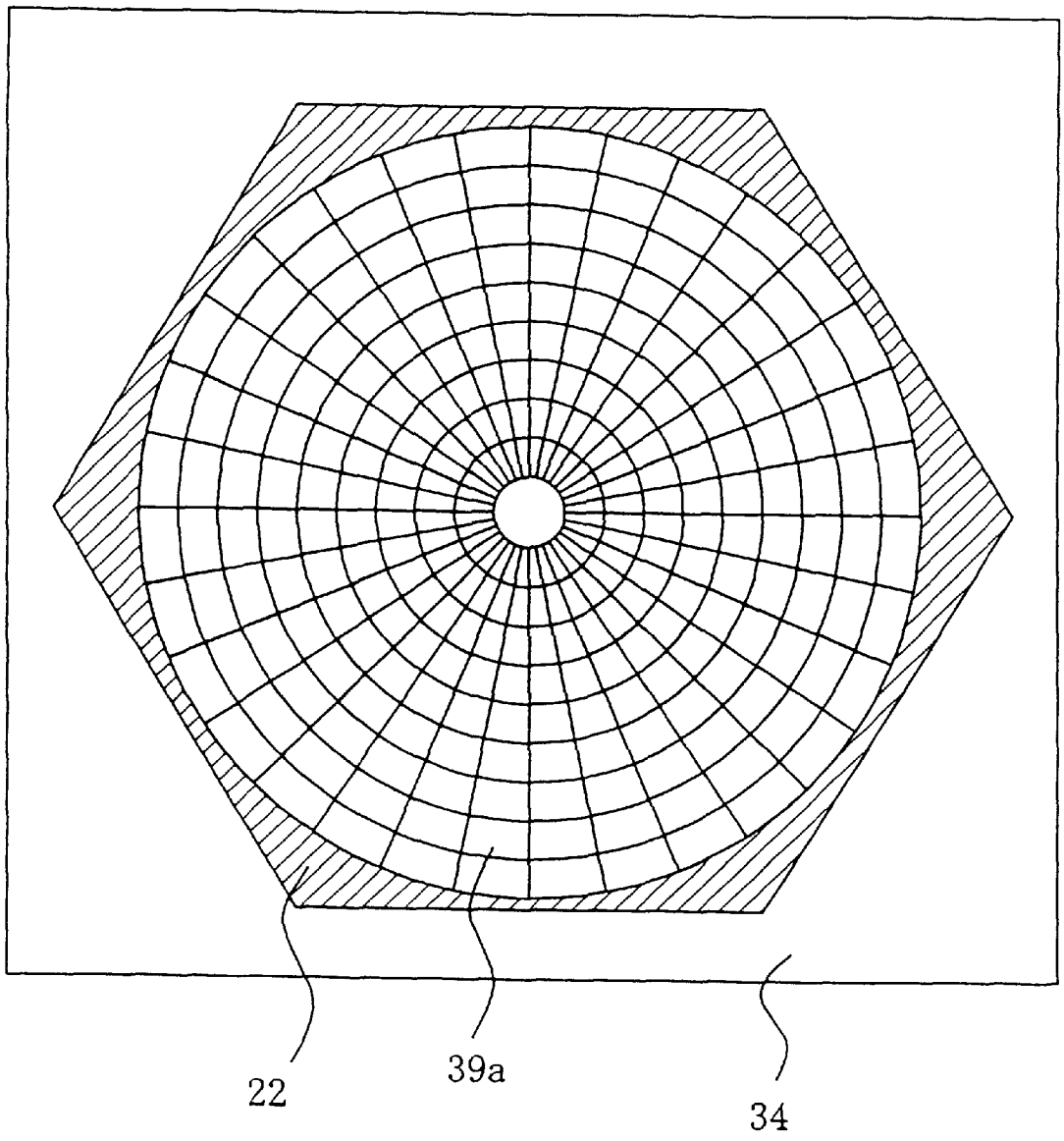
FIG. 9 is a front view showing a large-aperture active plane mirror of the antenna mirror surface measuring/adjusting apparatus according to the embodiment 7 of the present invention.

FIG. 9 is a front view showing the large-aperture active plane mirror of the antenna mirror surface measuring/adjusting apparatus in the embodiment 7. Referring to FIG. 9, there are shown the plane mirror support member 22, the ceiling 34 and the segmented plane panels 39*a*.

Next, an operational principle will be explained. Step 1 is the same as step 1 in the embodiment 1.

In step 2, the actuator controller 31 transmits a control signal to the segmented plane panel driving mechanism 39*b*, thereby driving a certain single piece of segmented plane panel 39*a*. A drive range is ½ or more of the wavelength in use, and other segmented plane panels remain fixed. Then, both of an amplitude and a phase of the receiving electric field in this state are measured. During the measurement, the mirror surface panel 1*a* of the principal reflection mirror 1 is in a state of being fixed but is not driven as in the embodiments 1 to 3.

In step 3, the phase difference between the electric fields is obtained by the arithmetic process. It is equivalent in terms of geometrical optics to changing the aperture surface phase distribution of the principal reflection mirror 1 that the segmented plane panel 39*a* is driven. Hence, as in the embodiment 1, the measured electric field is developed in the complex Fourier series with respect to the driven quantity. Further, another segmented plane panel 39*a* is set as an object to be driven, and the processes in steps 1 through 3 are executed. These processes are effected for all the segmented plane panels.

Step 4 is the same as step 4 in the embodiment 1. The thus obtained distribution corresponds to the aperture surface phase distribution, and there are gained therefrom the maps representing the configurations of the mirror surface having resolutions corresponding to sizes of the segmented plane panels 39*a*. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 8>

The antenna mirror surface measuring/adjusting apparatus in an eighth embodiment of the present invention will be discussed with reference to the drawings.

Figure 10:
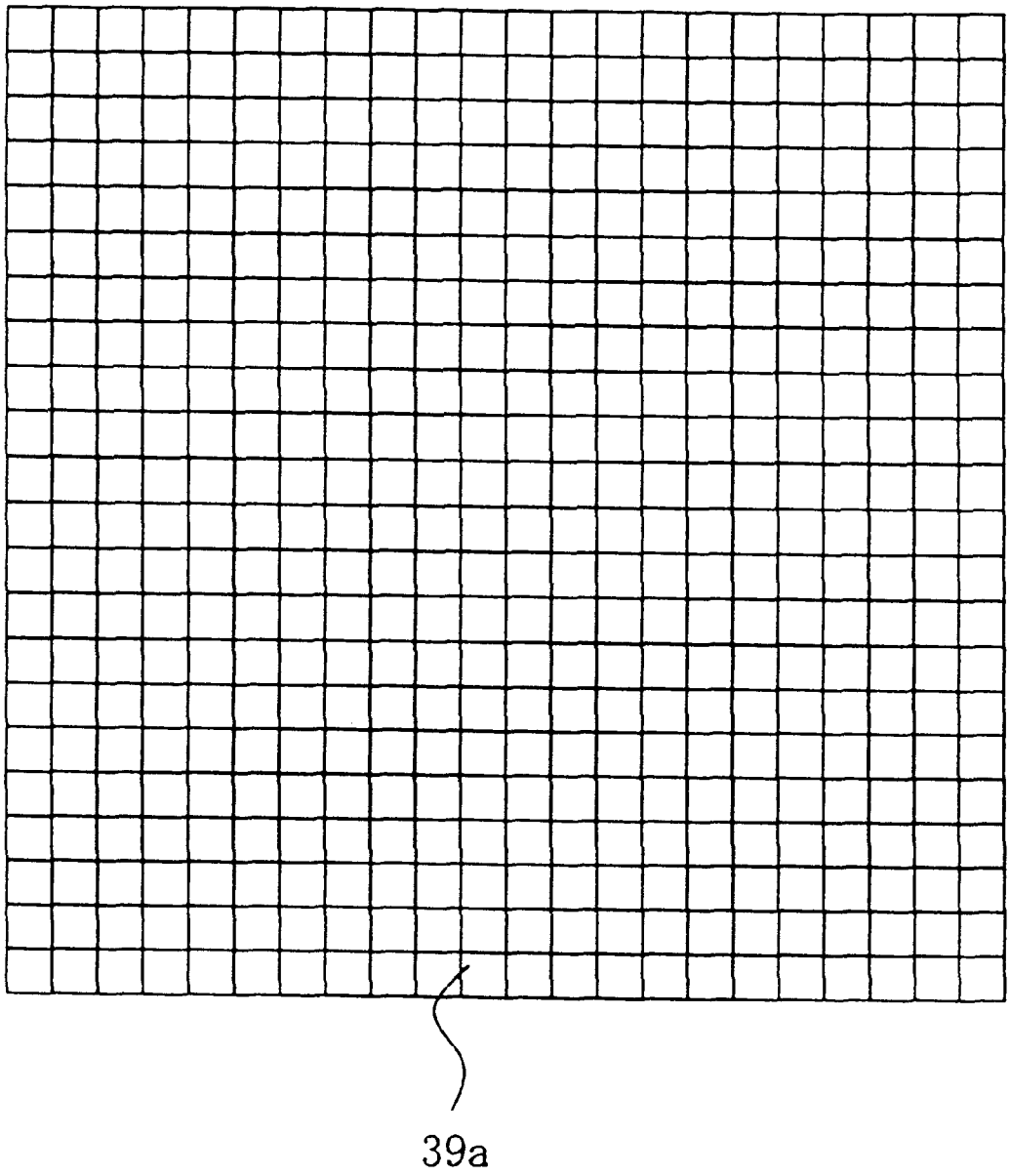
FIG. 10 is a front view showing a large-aperture active plane mirror of the antenna mirror surface measuring/adjusting apparatus according to an embodiment 8 of the present invention.

FIG. 10 is a front view showing the large-aperture active plane mirror of the antenna mirror surface measuring/adjusting apparatus in the eighth embodiment of the present invention. Referring to FIG. 10, the segmented plane panel 39*a* has a configuration into which the segmented configuration of the segmented plane panel in FIG. 9 is changed.

As illustrated in FIG. 10, the segmented plane panel is latticed, whereby the maps of the mirror surface can be gained in the form of lattice points. This makes it feasible to easily analyze a characteristic of radiation by a plane wave development method using the fast Fourier transform. The operational principle is the same as that in the embodiment 7.

<Embodiment 9>

Figure 11:
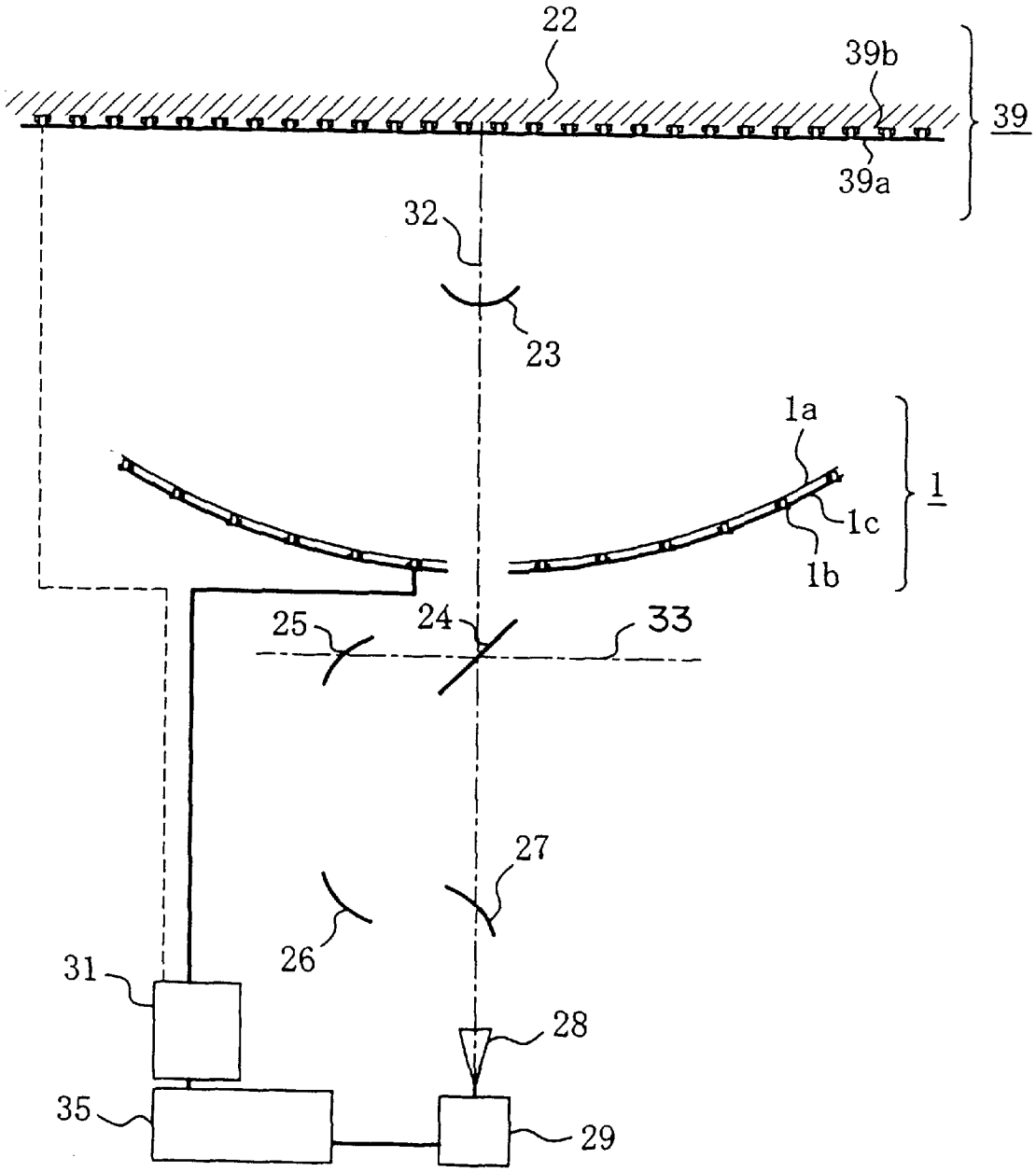
FIG. 11 is a diagram showing a construct ion of an antenna mirror surface measuring/adjusting apparatus according to an embodiment 9 of the present invention.

The antenna mirror surface measuring/adjusting apparatus in a ninth embodiment of the present invention will be discussed with reference to the drawings. FIG. 11 is a view showing a construction of the antenna mirror surface measuring/adjusting apparatus in the ninth embodiment of the present invention.

Referring to FIG. 11, the principal reflection mirror 1 of the test antenna is constructed of the mirror surface panel 1*a*, the actuator 1*b*, and the back structure ic. There are also shown the plane mirror support member 22, the auxiliary reflection mirror 23, the beam supply first reflection mirror 24, the beam supply second reflection mirror 25, the beam supply third reflection mirror 26, the beam supply fourth reflection mirror 27, the transmission/receipt shared primary radiator 28, the transmitter/receiver 29, the actuator controller 31, the azimuth axis 32, the elevation axis 33, and the receiving electric power arithmetic processor 35. These components are the same as those in the embodiment 6, and the reference numeral 39 designates the large-aperture active plane mirror, which is the same as that in the embodiment 7 and operates the same.

Step 1 is the same as step 1 in the embodiment 2.

In step 2, the actuator controller 31 transmits a control signal to the segmented plane panel driving mechanism 39*b*, thereby driving a certain single piece of segmented plane panel 39*a*. The drive range is ½ or more of the wavelength in use, and other segmented plane panels remain fixed. Then, the receiving electric power in this state is measured. During the measurement, the mirror surface panel 1*a* of the principal reflection mirror 1 is in a state of being fixed but is not driven as in the embodiments 1 to 3. Driving the segmented plane panel 39*a* is equivalent in terms of geometrical optics to changing the aperture surface phase distribution of the principal reflection mirror 1.

Hence, step 3 of obtaining the phase difference between the electric fields by the arithmetic process is the same as step 3 in the embodiment 2. Further, another segmented plane panel 39*a* is set as an object to be driven, and the processes in steps 1 through 3 are executed. These processes are effected for all the segmented plane panels.

Step 4 is the same as step 4 in the embodiment 1. The thus obtained distribution corresponds to the aperture surface phase distribution, and there are gained therefrom the maps representing the configurations of the mirror surface having resolutions corresponding to sizes of the segmented plane panels 39*a*. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 10>

Figure 12:
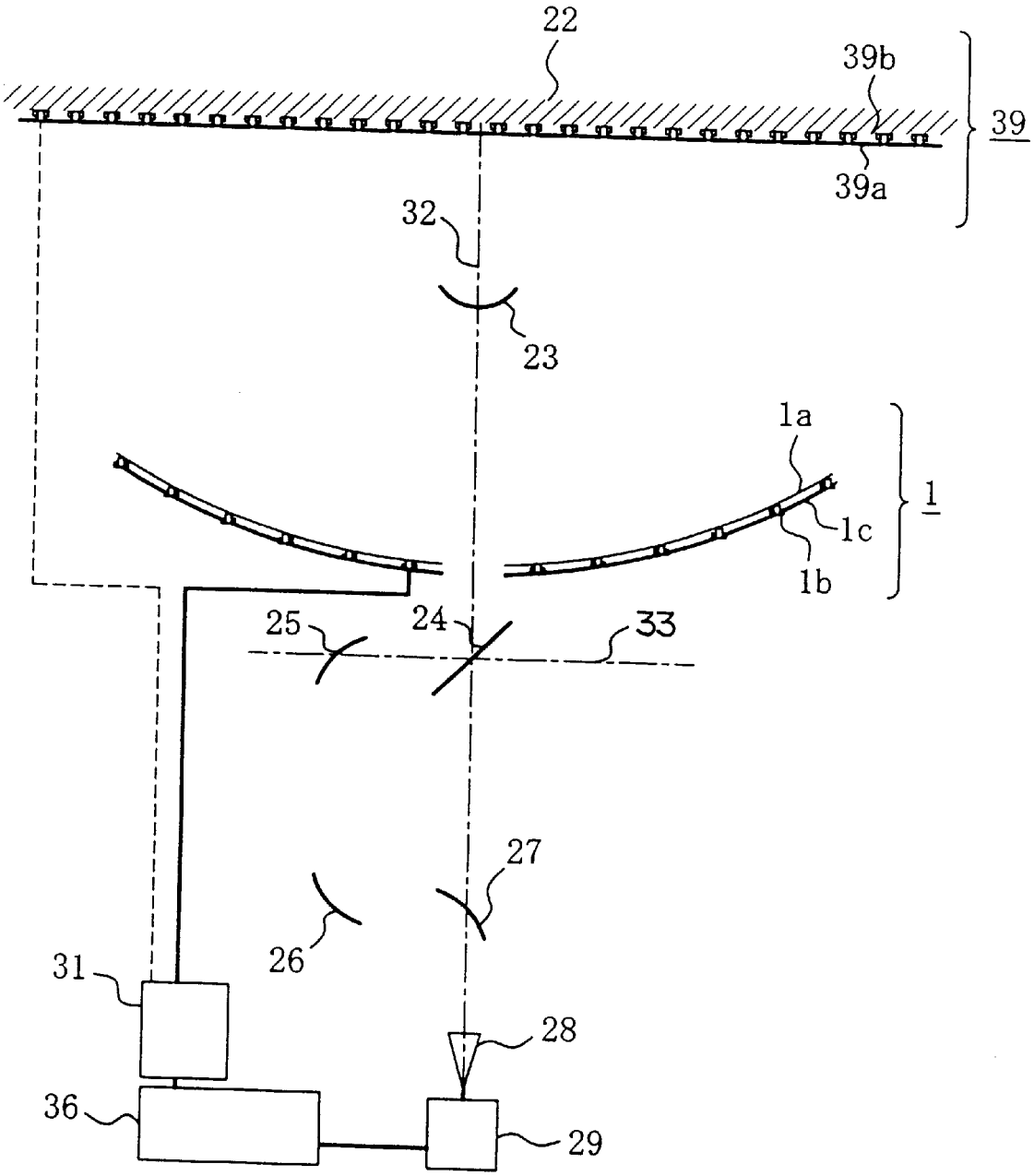
FIG. 12 is a diagram showing a construction of an antenna mirror surface measuring/adjusting apparatus according to an embodiment 10 of the present invention.

The antenna mirror surface measuring/adjusting apparatus in a tenth embodiment of the present invention will be discussed with reference to the drawings. FIG. 12 is a view showing a construction of the antenna mirror surface measuring/adjusting apparatus in the tenth embodiment of the present invention.

Referring to FIG. 12, the principal reflection mirror 1 of the test antenna is constructed of the mirror surface panel 1*a*, the actuator 1*b*, and the back structure 1*c*. There are also shown the plane mirror support member 22, the auxiliary reflection mirror 23, the beam supply first reflection mirror 24, the beam supply second reflection mirror 25, the beam supply third reflection mirror 26, the beam supply fourth reflection mirror 27, the transmission/receipt shared primary radiator 28, the transmitter/receiver 29, the actuator controller 31, the azimuth axis 32, and the elevation axis 33. These components are the same as those in the embodiment 6, and the receiving phase arithmetic processor 36 is the same as that in the embodiment 3, and the large-aperture active plane mirror 39 is also the same as that in the embodiment 7, and these components perform the same operations as those therein.

Step 1 is the same as step 1 in the embodiment 3.

In step 2, the actuator controller 31 transmits a control signal to the segmented plane panel driving mechanism 39*b*, thereby driving a certain single piece of segmented plane panel 39*a*. The drive range is ½ or more of the wavelength in use, and other segmented plane panels remain fixed. Then, a phase of the receiving electric field in this state is measured. During the measurement, the mirror surface panel 1*a* of the principal reflection mirror 1 is in a state of being fixed but is not driven as in the embodiments 1 to 3. Driving the segmented plane panel 39*a* is equivalent in terms of geometrical optics to changing the aperture surface phase distribution of the principal reflection mirror 1.

Hence, step 3 of obtaining the phase difference between the electric fields by the arithmetic process is the same as step 3 in the embodiment 3. Further, another segmented plane panel 39*a* is set as an object to be driven, and the processes in steps 1 through 3 are executed. These processes are effected for all the segmented plane panels.

Step 4 is the same as step 4 in the embodiment 1. The thus obtained distribution corresponds to the aperture surface phase distribution, and there are gained therefrom the maps representing the configurations of the mirror surface having resolutions corresponding to sizes of the segmented plane panels 39*a*. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 11>

Figure 13:
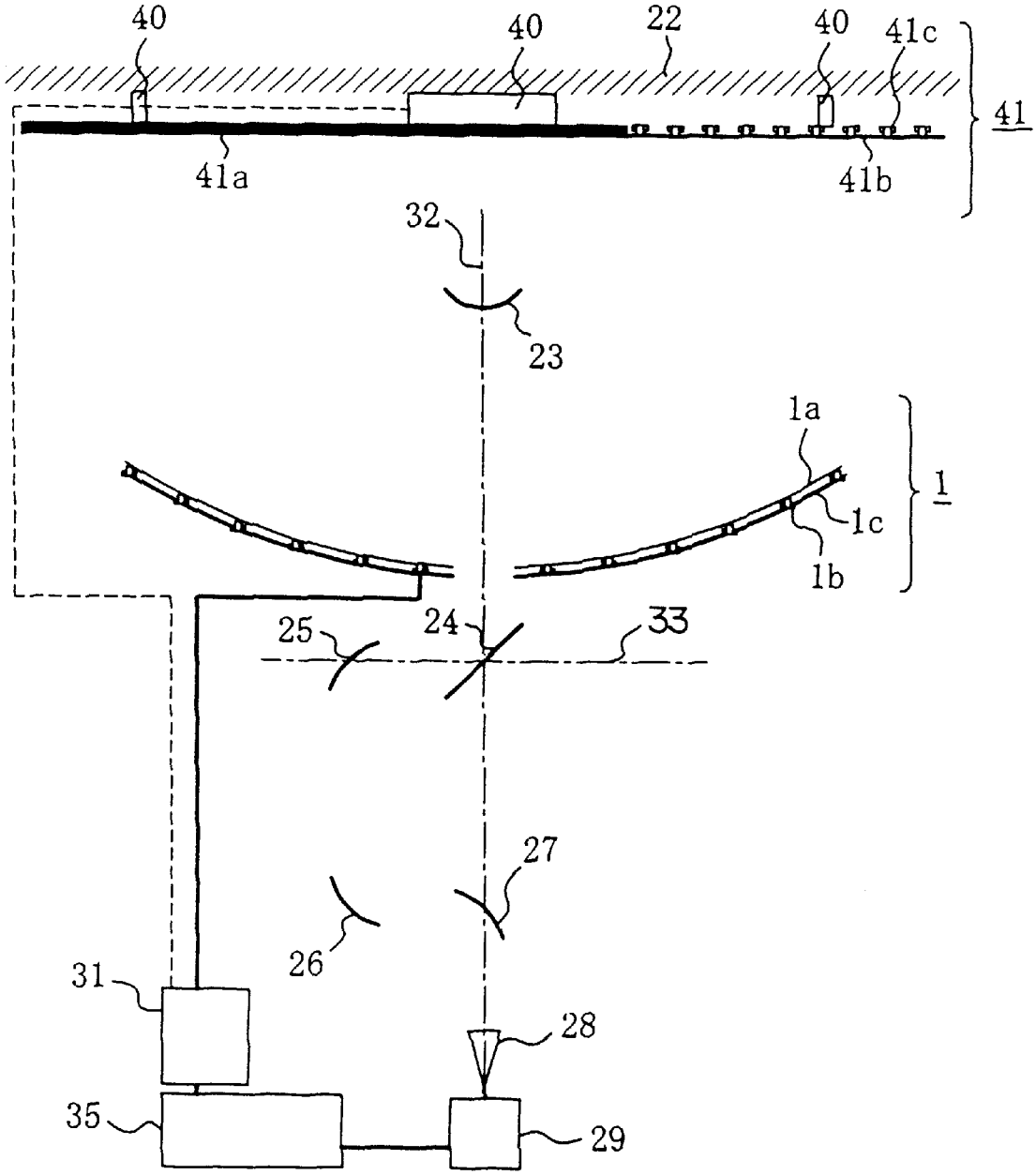
FIG. 13 is a diagram showing a construction of an antenna mirror surface measuring/adjusting apparatus according to an embodiment 11 of the present invention.

The antenna mirror surface measuring/adjusting apparatus in an eleventh embodiment of the present invention will be discussed with reference to the drawings. FIG. 13 is a view showing a construction of the antenna mirror surface measuring/adjusting apparatus in the eleventh embodiment of the present invention.

Referring to FIG. 13, the principal reflection mirror 1 of the test antenna is constructed of the mirror surface panel 1*a*, the actuator 1*b*, and the back structure 1*c*. There are also shown the plane mirror support member 22, the auxiliary reflection mirror 23, the beam supply first reflection mirror 24, the beam supply second reflection mirror 25, the beam supply third reflection mirror 26, the beam supply fourth reflection mirror 27, the transmission/receipt shared primary radiator 28, the transmitter/receiver 29, the actuator controller 31, the azimuth axis 32, the elevation axis 33, and the receiving electric power arithmetic processor 35. These components are the same as those in the embodiment 6 and perform the same as those therein.

Referring again to FIG. 13, there are shown a large-aperture partially movable plane mirror rotation mechanism, designated by 40, for rotating the large-aperture partially movable plane mirror about the axis coincident with the bore site direction of the test antenna, a large-aperture partially movable plane mirror 41, a plane mirror fixed member 41*a* which is not driven in the direction orthogonal to the plane mirror, a plane mirror movable member 41*b* driven in the direction orthogonal to the plane mirror, and a plane panel driving mechanism 41*c* for the plane mirror movable member. Note that the large-aperture partially movable plane mirror rotation mechanism 40 has a drive member 40 provided in the vicinity of the rotational axis of the large-aperture partially movable plane mirror, and a guide member 40 provided in the vicinity of the periphery thereof.

Figure 14:
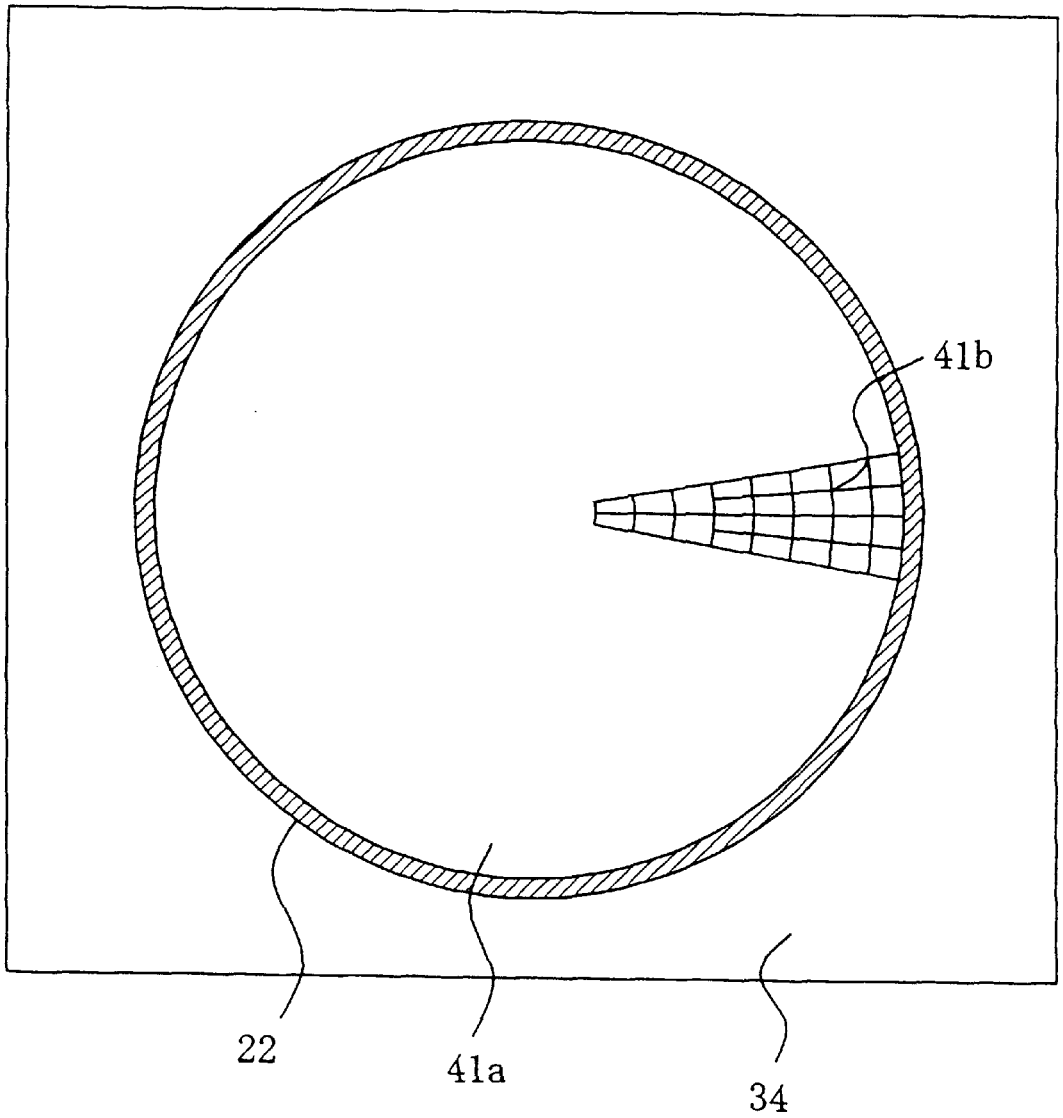
FIG. 14 is a front view showing a large-aperture partially movable plane mirror of the antenna mirror surface measuring/adjusting apparatus in the embodiment 11 of the present invention.

FIG. 14 is a front view showing the large-aperture partially movable plane mirror of the antenna mirror measuring/adjusting apparatus in the embodiment 11. FIG. 14 shows the plane mirror support member 22, the ceiling 34, the large-aperture partially movable plane mirror rotation mechanism 40, the plane mirror fixed member 41*a*, and the plane mirror movable member 41*b*. Note that the plane mirror fixed member 41*a* and the plane mirror movable member 41*b* are integrally constructed as a single piece of disk-like member.

Next, the operational principle will be explained. Step 1 is the same as step 1 in the embodiment 2.

In step 2 of making the measurement in a state where the phase of the electric field is changed, to begin with, as in the embodiment 9, the receiving electric power is measured. What is driven is the plane mirror movable member 41*b*. Then, the step is repeated for other plane mirror movable members each as an object for the measurement. After completing the measurements for all the plane mirror movable members, the large-aperture partially movable plane mirror rotation mechanism 40 rotates the large-aperture partially movable plane mirror 41 and fixes it. The rotation is made so that a region of the plane mirror movable member 41*c* is not overlapped with a region of the plane mirror movable member 41*c* before the rotation.

In this state, the step 2 is again repeated. Then, when completing the measurements for all the plane mirror movable members, the large-aperture partially movable plane mirror rotation mechanism 40 rotates the large-aperture partially movable plane mirror 41 and fixes it. Thus, the measurement is repeated till the whole aperture surface is covered with the regions of the plane mirror movable member 41*c*.

Step 4 is the same as step 4 in the embodiment 1. The thus obtained distribution corresponds to the aperture surface phase distribution, and there are gained therefrom the maps representing the configurations of the mirror surface having resolutions corresponding to sizes of the segmented plane panels 39*a*. Accordingly., the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 12>

Figure 15:
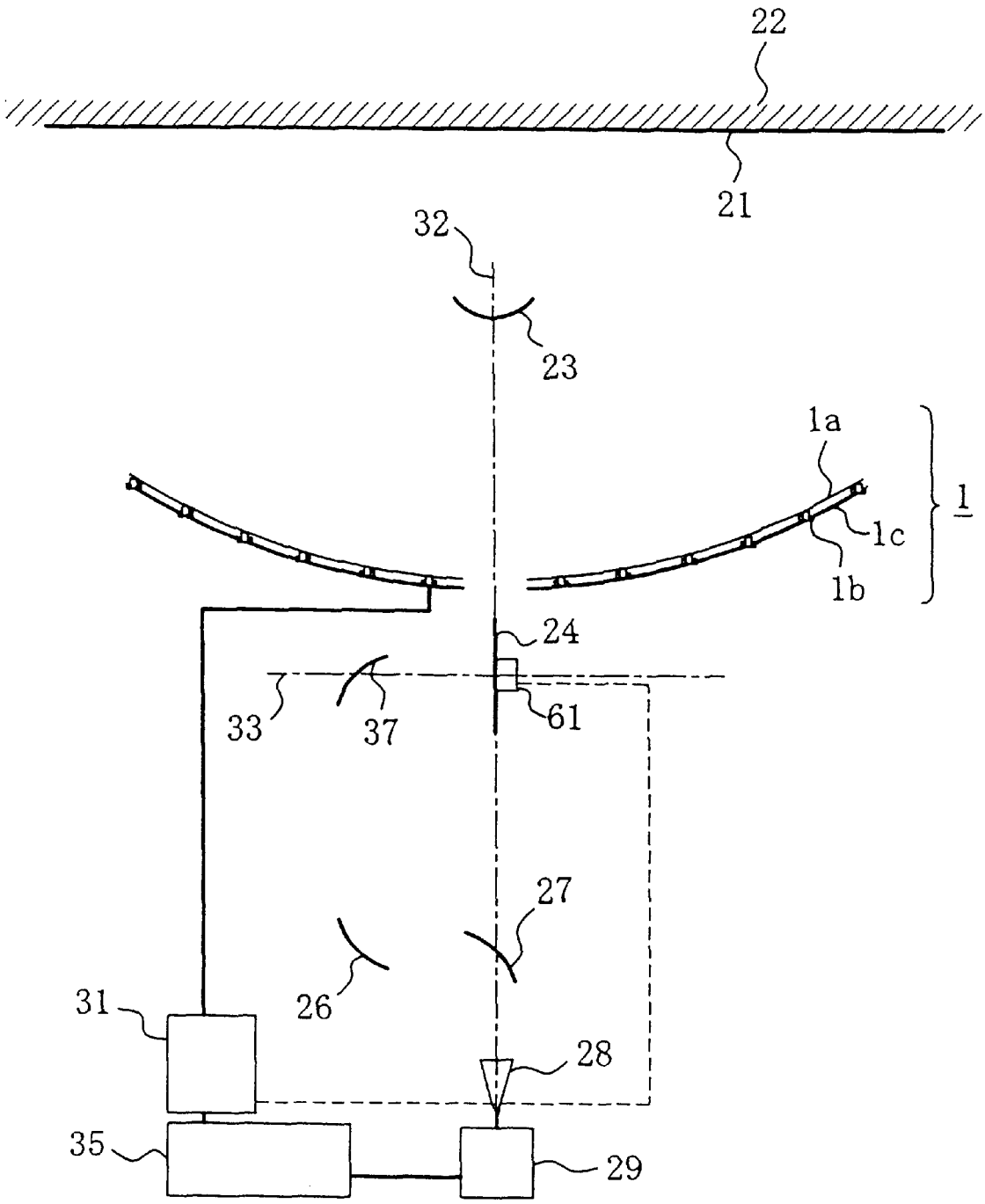
FIG. 15 is a diagram showing a construction of an antenna mirror surface measuring/adjusting apparatus according to an embodiment 12 of the present invention.

The antenna mirror surface measuring/adjusting apparatus in a twelfth embodiment of the present invention will be discussed with reference to the drawings. FIG. 15 is a view showing a construction of the antenna mirror surface measuring/adjusting apparatus in the twelfth embodiment of the present invention.

Referring to FIG. 15, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23, the beam supply first reflection mirror 24, the beam supply third reflection mirror 26, the beam supply fourth reflection mirror 27, the transmission/receipt shared primary radiator 28, the transmitter/receiver 29, the actuator controller 31, the azimuth axis 32, the elevation axis 33, the receiving electric power arithmetic processor 35, and a beam supply active plane surface 37. These components are the same as those in the embodiment 5 and perform the same as those therein. Moreover, the reference numeral 61 designates a beam supply first reflection rotation mechanism.

Next, the operational principle will be explained. At first, the beam supply first reflection rotation mechanism 61 rotates the beam supply first reflection mirror 24 to set it the same as the beam supply first reflection mirror 24 in the embodiment 5 illustrated in FIG. 6. Then, the same measurement as that in the embodiment 5 is carried out. A mirror surface error map obtained by the above operation contains a wave front aberration in the beam supply system in addition to ruggedness on the principal reflection mirror 1.

Then, the beam supply first reflection mirror rotation mechanism 61 further rotates the beam supply first reflection mirror 24 and executes the setting as shown in FIG. 15, and in this state the measurement is carried out in the same procedures as those in the embodiment 5. The radio waves radiated from the transmission/receipt shared primary radiator 28 travel via the beam supply fourth reflection mirror 27, the beam supply third reflection mirror 26 and the beam supply active mirror surface 37. The radio waves are then reflected by the beam supply first reflection mirror 24, and reversely converge at the transmission/receipt shared primary radiator 28 via the beam supply active mirror surface 37, the beam supply third reflection mirror 26 and the beam supply fourth reflection mirror 27.

A direction of the beam supply first reflection mirror 24 is changed as shown in FIG. 15, thereby gaining a characteristic which does not depend upon the principal reflection mirror 1, the auxiliary reflection mirror 23 and the large-aperture plane mirror 21. Then, the wave front aberration in the beam supply system, which could not be separated in the embodiment 5 discussed above, can be evaluated in separation. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 13>

Figure 16:
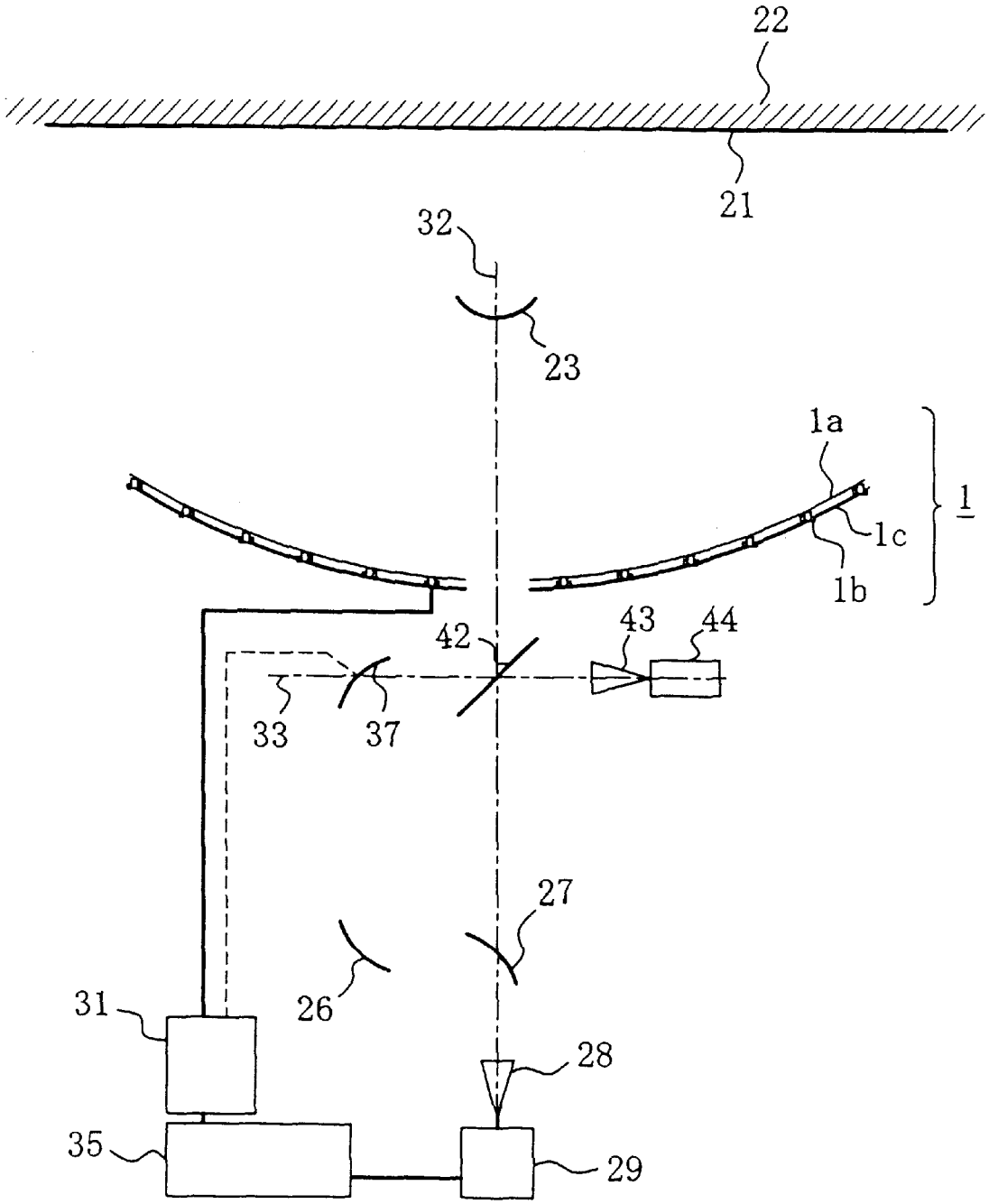
FIG. 16 is a diagram showing a construction of an antenna mirror surface measuring/adjusting apparatus according to an embodiment 13 of the present invention.

The antenna mirror surface measuring/adjusting apparatus in a thirteenth embodiment of the present invention will be discussed with reference to the drawings. FIG. 16 is a view showing a construction of the antenna mirror surface measuring/adjusting apparatus in the thirteenth embodiment of the present invention.

Referring to FIG. 16, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23, the beam supply third reflection mirror 26, the beam supply fourth reflection mirror 27, the transmission/receipt shared primary radiator 28, the transmitter/receiver 29, the actuator controller 31, the azimuth axis 32, the elevation axis 33, the receiving electric power arithmetic processor 35, and the beam supply active plane surface 37. These components are the same as those in the embodiment 5 and perform the same as those therein. Moreover, the reference numeral 42 designates a grid mirror surface, 43 denotes a beam supply system measurement-oriented primary radiator, and 44 represents a beam supply system measurement-oriented receiver.

Next, the operational principle will be explained. At first, the radio waves transmitted from the transmitter/receiver 29 of the test antenna and the transmission/receipt shared primary radiator 28 travel through the beam supply fourth reflection mirror 27, the beam supply third reflection mirror 26, the beam supply active mirror surface 37 and the grid mirror surface 42 in this sequence. The radio waves are separated in direction of the components of the electric field by the grid mirror surface 42. Some proportion of the radio waves are reflected toward the auxiliary reflection mirror 23 of the test antenna, and remaining radio waves penetrate toward the beam supply system measurement-oriented primary radiator 43.

The former radio waves travel toward the auxiliary reflection mirror 23, the principal reflection mirror 1 and the large-aperture plane mirror 21, reflect on the large-aperture plane mirror 21, and arrive at the principal reflection mirror 1, the auxiliary reflection mirror 23, the grid mirror surface 42, the beam supply active mirror surface 37, the beam supply third reflection mirror 26, the beam supply fourth reflection mirror 27, the transmission/receipt shared primary radiator 28 and the transmitter/receiver 29.

The latter radio waves are received by the beam supply system measurement-oriented primary radiator 43 and the beam supply system measurement-oriented receiver 44. Step 1 is the same as step 1 in the embodiment 1.

In step 2, a part of the beam supply active mirror surface 37 is moved within a range that is ½ or more of the wavelength in use, and the receiving electric power is measured by both of the transmitter/receiver 29 and the beam supply system measurement-oriented receiver 44 by changing only some of a difference in length between the optical paths. Step 2 is repeated by varying a driven quantity of a part of the beam supply active mirror surface 37.

In step 3, the electric power measured by the transmitter/receiver 29 and the electric power measured by the beam supply system measurement-oriented receiver 44 are each developed in the Fourier series with respect to a driven quantity of a part of the beam supply active mirror surface 37. Hereinafter, there is implemented an arithmetic process in relation to the two quantities of electric power which have been measured by the transmitter/receiver 29 and the receiver 44.

Step 4 is the same as step 4 in the embodiment 1. It leads to an acquisition of the aperture surface phase distribution of the principal reflection mirror 1 with respect to the measurement of the transmitter/receiver 29 that a part of the beam supply active mirror surface 37 is driven, as well as to an acquisition of the wave front aberration in the beam supply system with respect to the measurement of the beam supply system measurement-oriented receiver 44.

The aperture surface phase distribution obtained by the measurement of the transmitter/receiver 29 contains the wave front aberration in the beam supply system in addition to the ruggedness on the principal reflection mirror 1.

Accordingly, the ruggedness on the principal reflection mirror 1 and the wave front aberration in the beam supply system are separated from each other by the measurement of the transmitter/receiver 29 and the measurement of the beam supply system measurement-oriented receiver 44, and it is possible to obtain how much the configuration of the mirror surface of the principal reflection mirror deviates from a certain state.

The resolution of the map representing the configuration of the mirror surface, which is procured by the above operation, corresponds to a size of the driven portion of the beam supply active mirror surface 37. The configuration of the mirror surface of the principal reflection mirror is thereby acquired. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 14>

Figure 17:
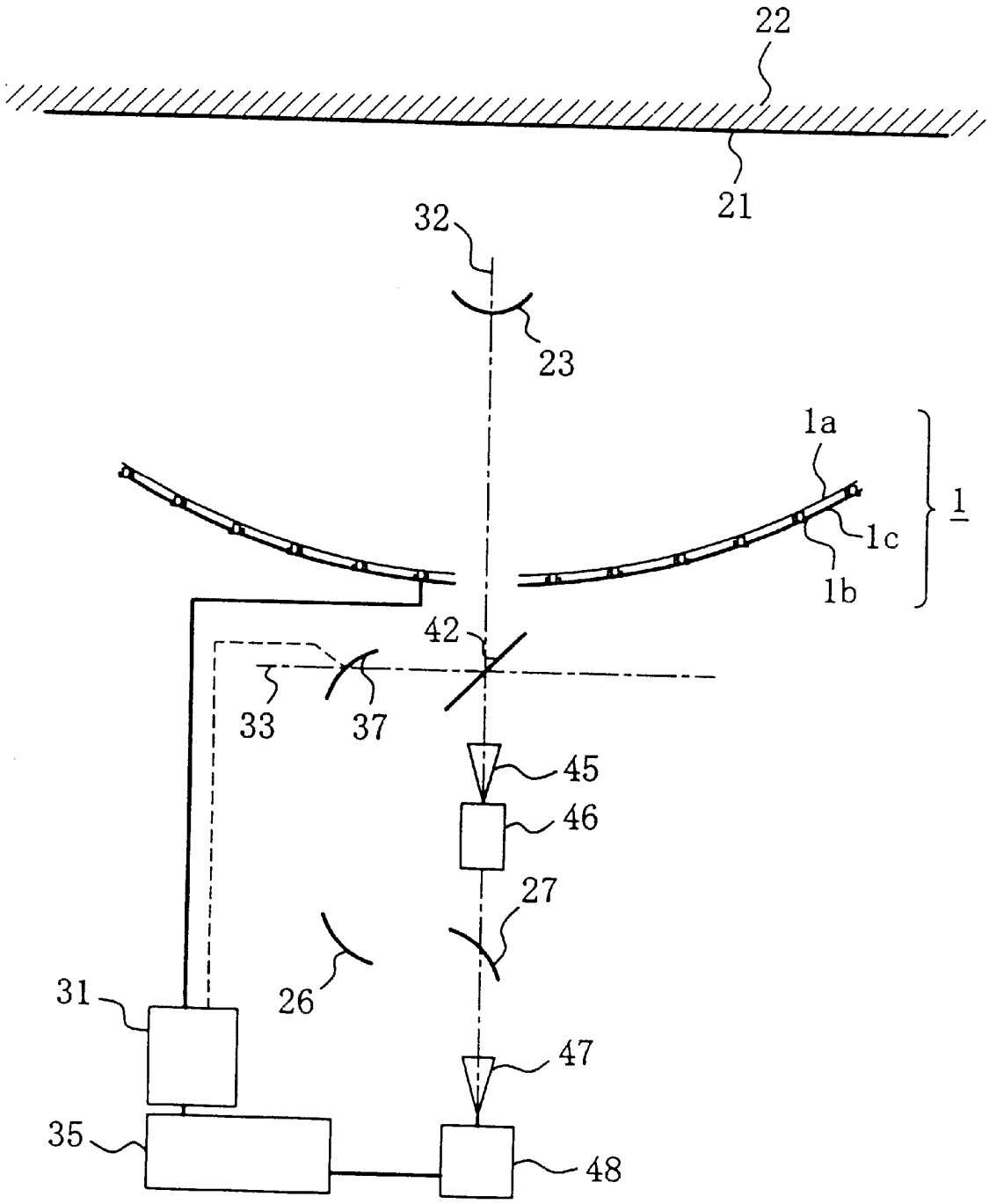
FIG. 17 is a diagram showing a construction of an antenna mirror surface measuring/adjusting apparatus according to an embodiment 14 of the present invention.

The antenna mirror surface measuring/adjusting apparatus in a fourteenth embodiment of the present invention will be discussed with reference to the drawings. FIG. 17 is a view showing a construction of the antenna mirror surface measuring/adjusting apparatus in the fourteenth embodiment of the present invention.

Referring to FIG. 17, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23, the beam supply third reflection mirror 26, the beam supply fourth reflection mirror 27, the actuator controller 31, the azimuth axis 32, the elevation axis 33, the receiving electric power arithmetic processor 35, and the beam supply active mirror surface 37. These components are the same as those in the embodiment 5. Further, the reference numeral 42 designates a grid mirror surface which is the same as that in the embodiment 5 and performs the same operation as that therein. Illustrated further are a principal reflection mirror measurement-oriented primary radiator 45, a principal reflection mirror measurement-oriented transmitter 46, a receiving-oriented primary radiator 47, and a receiver 48.

A larger-sized antenna dedicated to the receiving is not constructed in the transmission/receipt shared mode, and hence the measurement can be carried out in the same way as the embodiment 2 by providing the principal reflection mirror measurement-oriented primary radiator 45 and the principal reflection mirror measurement-oriented transmitter 46. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 15>

Figure 18:
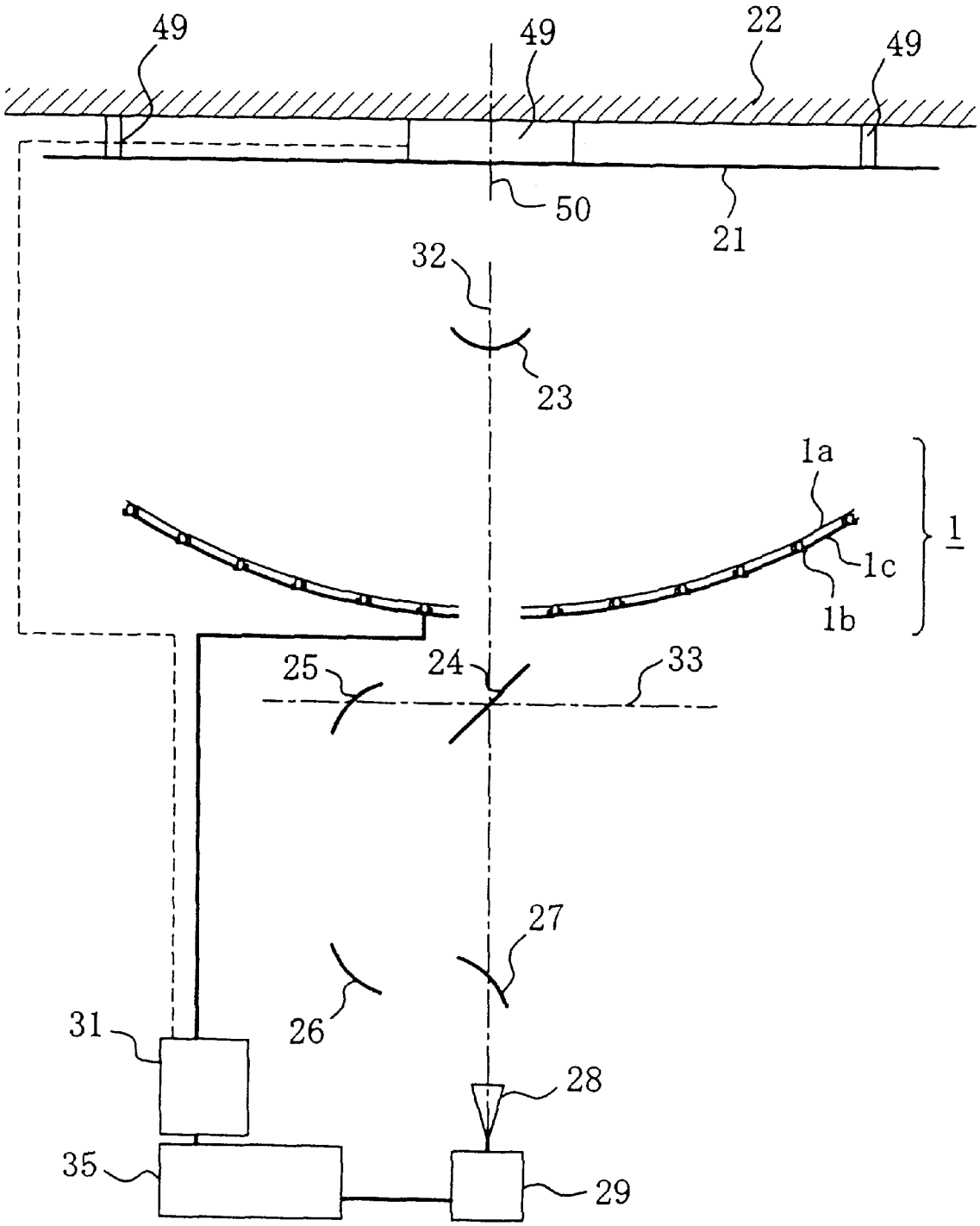
FIG. 18 is a diagram showing a construction of an antenna mirror surface measuring/adjusting apparatus according to an embodiment 15 of the present invention.

The antenna mirror surface measuring/adjusting apparatus in a fifteenth embodiment of the present invention will be discussed with reference to the drawings. FIG. 18 is a view showing a construction of the antenna mirror surface measuring/adjusting apparatus in the fifteenth embodiment of the present invention.

Referring to FIG. 18, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23, the beam supply first reflection mirror 24, the beam supply second reflection mirror 25, the beam supply third reflection mirror 26, the beam supply fourth reflection mirror 27, the transmission/receipt shared primary radiator 28, the transmitter/receiver 29, the actuator controller 31, the azimuth axis 32, the elevation axis 33, and the receiving electric power arithmetic processor 35. These components are the same as those in the embodiment 6 and effect the same operations as those therein. Further, reference numeral 49 denotes a large-aperture plane mirror rotation mechanism and 50 denotes a large-aperture plane mirror rotation shaft. Shown further is the large-aperture plane mirror rotation mechanism 49 including the drive member 49 provided in the vicinity of a large-aperture plane mirror rotary shaft 50, and a guide member 49 provided in the vicinity of the periphery thereof.

Figure 19:
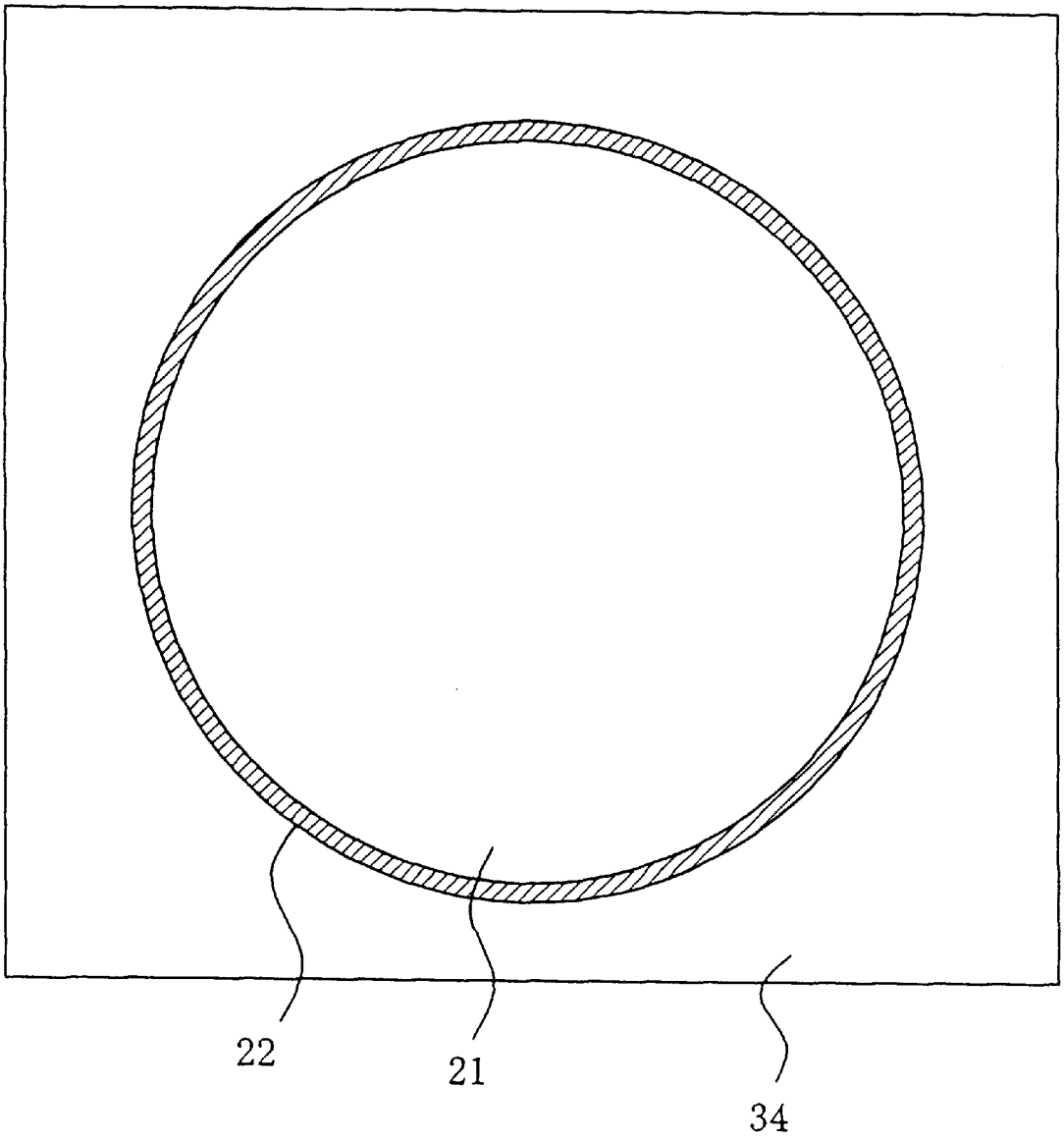
FIG. 19 is a front view showing a large-aperture partially movable plane mirror of the antenna mirror surface measuring/adjusting apparatus according to the embodiment 15 of the present invention.

FIG. 19 is a front view showing the large aperture plane mirror of the antenna mirror measuring/adjusting apparatus in the embodiment 15. FIG. 19 shows the large-aperture plane mirror 21, the plane mirror support member 22, and the ceiling 34.

Next, the operational principle will be explained. To begin with, as in the embodiment 2, all the measurements in steps 1 through 4 are carried out. Then, after the large-aperture plane mirror rotation mechanism 49 has rotated the large-aperture plane mirror 21 about the large-aperture plane mirror rotation shaft 50, the plane mirror 21 is fixed. In this state, as in the embodiment 2, all the measurements in steps 1 to 4 are again executed.

With this operation being repeated, a plurality of maps of the mirror configurations are measured. The thus obtained map representing the configuration of the mirror surface contains ruggedness as an error on the large-aperture plane mirror, in addition to the ruggedness on the principal reflection mirror. Therefore, the error due to the ruggedness on the large-aperture plane mirror is eliminated by obtaining an average value of the maps of the plurality of mirror surface configurations, or alternatively by solving simultaneous equations consisting of a combination of the plurality of maps of the mirror surface configurations. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 16>

Figure 20:
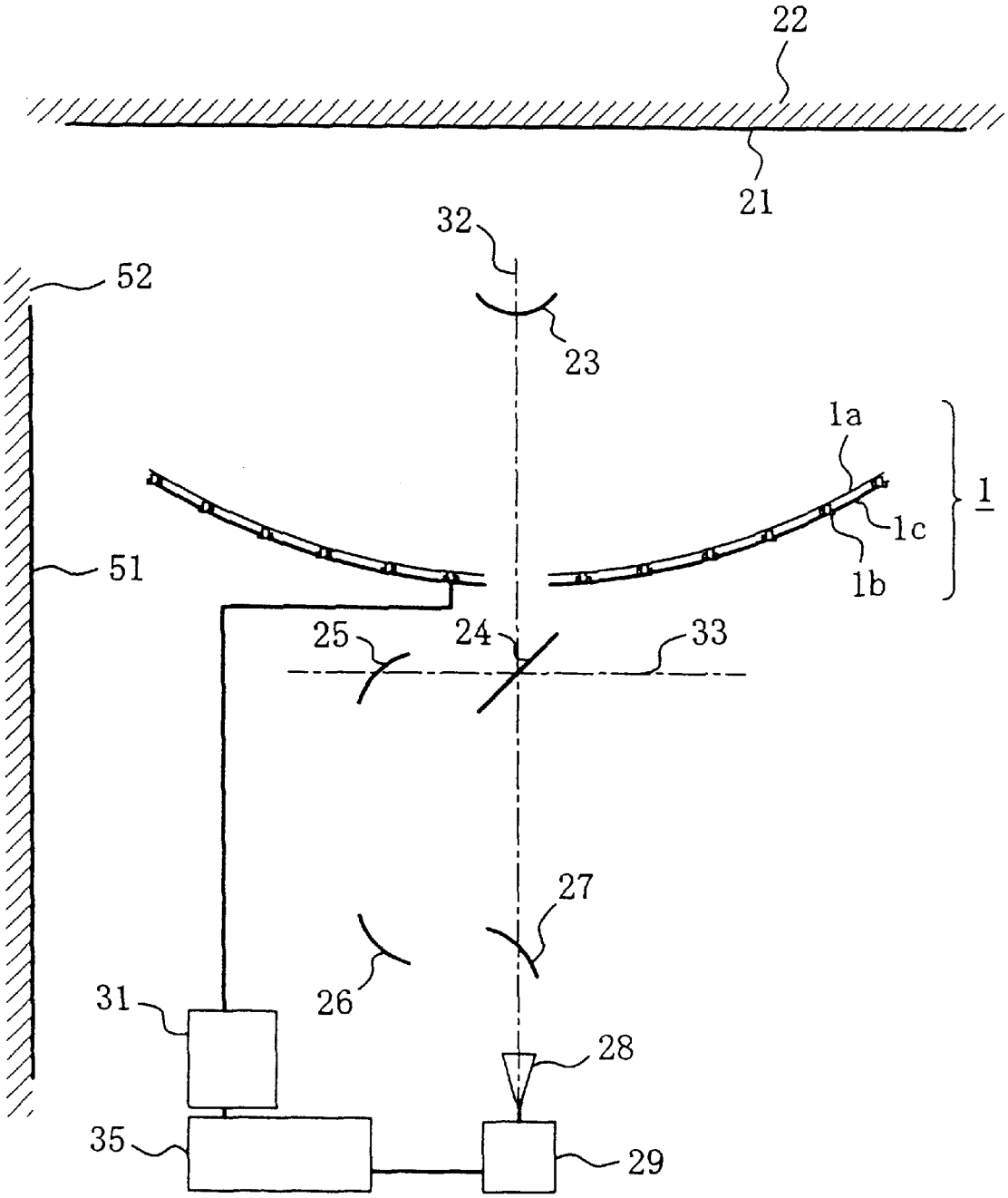
FIG. 20 is a diagram showing a construction of an antenna mirror surface measuring/adjusting apparatus according to an embodiment 16 of the present invention.

The antenna mirror surface measuring/adjusting apparatus in an embodiment 16 of the present invention will be discussed with reference to the drawings. FIG. 20 is a view showing a construction of the antenna mirror surface measuring/adjusting apparatus in the embodiment 16 of the present invention.

Referring to FIG. 20, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23, the beam supply first reflection mirror 24, the beam supply second reflection mirror 25, the beam supply third reflection mirror 26, the beam supply fourth reflection mirror 27, the transmission/receipt shared primary radiator 28, the transmitter/receiver 29, the actuator controller 31, the azimuth axis 32, the elevation axis 33, and the receiving electric power arithmetic processor 35. These components are the same as those in the embodiment 6 and effect the same operations as those therein. Shown further are a large-aperture second plane mirror 51, and a large-aperture second plane mirror support member 52.

To begin with, as in the embodiment 2, all the measurements in steps 1 through 4 are implemented.

Next, the aperture surface of the principal reflection mirror 1 of the test antenna is set perpendicular. Then, the radio waves are radiated toward the large-aperture second plane mirror 51. Thereafter, as in the embodiment 2, all the measurements in steps 1 through 4 are performed.

Two maps of the mirror surface configurations are thereby obtained. A difference between the two maps of the mirror surface configurations might occur due to influences exerted by the gravity upon a step difference between the mirror surface panels of the principal reflection mirror 1 and upon a distortion in the mirror surface. This is derived from a difference in terms of position of the principal reflection mirror 1. Therefore, the mirror surface can be set at an arbitrary elevation angle by evaluating a component relative to a self-weight deformation of the principal reflection mirror 1 from this difference. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 17>

Figure 21:
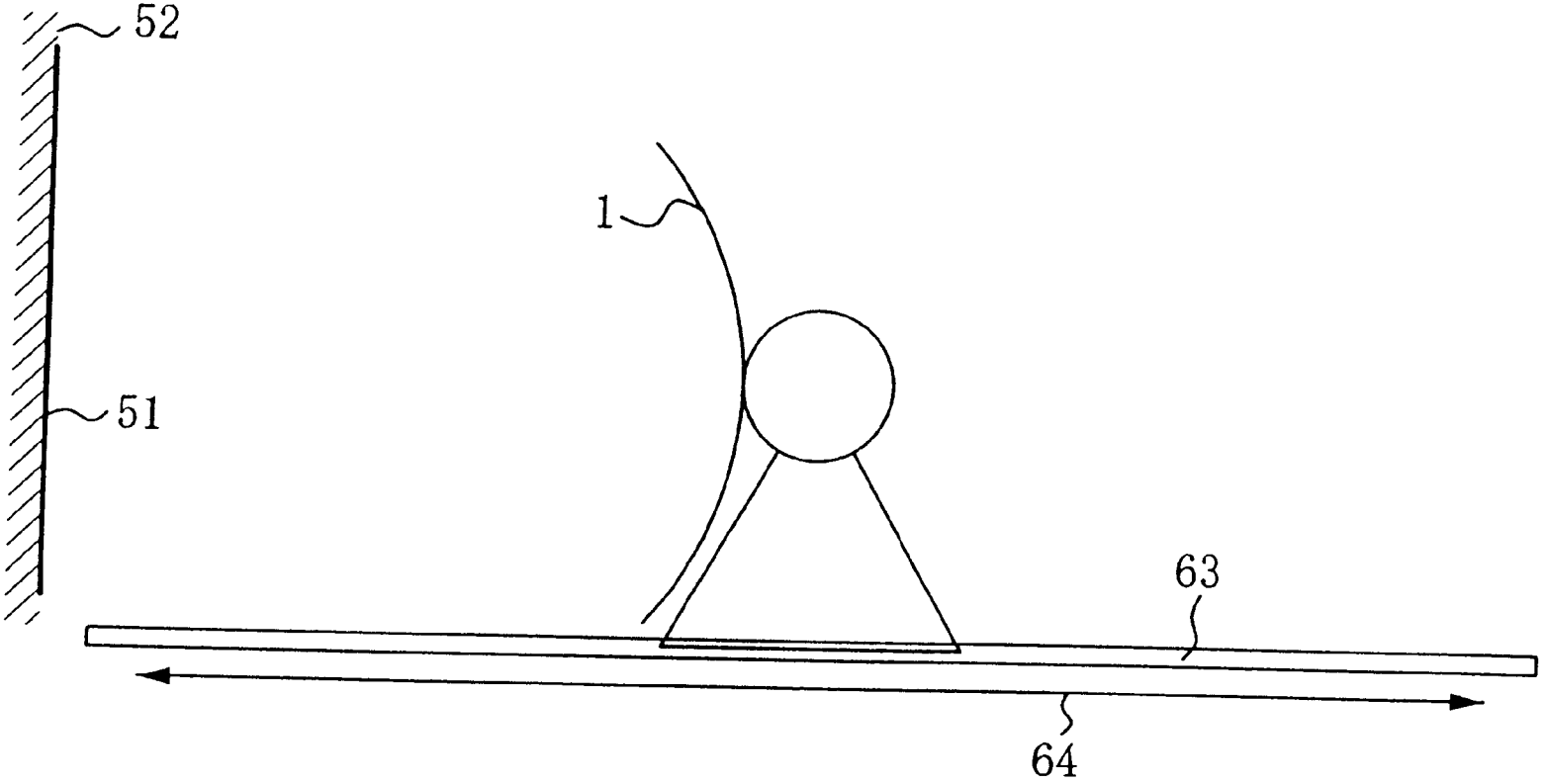
FIG. 21 is a diagram schematically showing a construction of an antenna mirror surface measuring/adjusting apparatus according to an embodiment 17 of the present invention.

The antenna mirror surface measuring/adjusting apparatus in an embodiment 17 of the present invention will be discussed with reference to the drawings. FIG. 21 is a view showing a construction of the antenna mirror surface measuring/adjusting apparatus in the embodiment 17 of the present invention.

Referring to FIG. 21, there are illustrated the principal reflection mirror 1, the large-aperture second plane mirror 51, the large-aperture second plane mirror support member 52, a z-axis scanner 63 for changing a distance between the test antenna and the large-aperture second plane mirror 51, and antenna movable range 64 in which the distance can be changed by the z-axis scanner 63.

The test antenna is moved by the z-axis scanner 63 and halted in a predetermined position, in which state the same measurement as that in the embodiment 16 is carried out. Thereafter, the test antenna is moved by the z-axis scanner 63 and halted in a different position, and the measurement is similarly executed. These operations are repeated. A result of the measurements at different distances between the test antenna and the large-aperture second plane mirror 51, is thereby obtained.

The wave effect when radio waves travel to the large-aperture second plane mirror 51 from the test antenna, can be evaluated from the difference between the results of the measurements at the different distances, and can be eliminated by use of the results of the measurements at the different distances. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 18>

Figure 22:
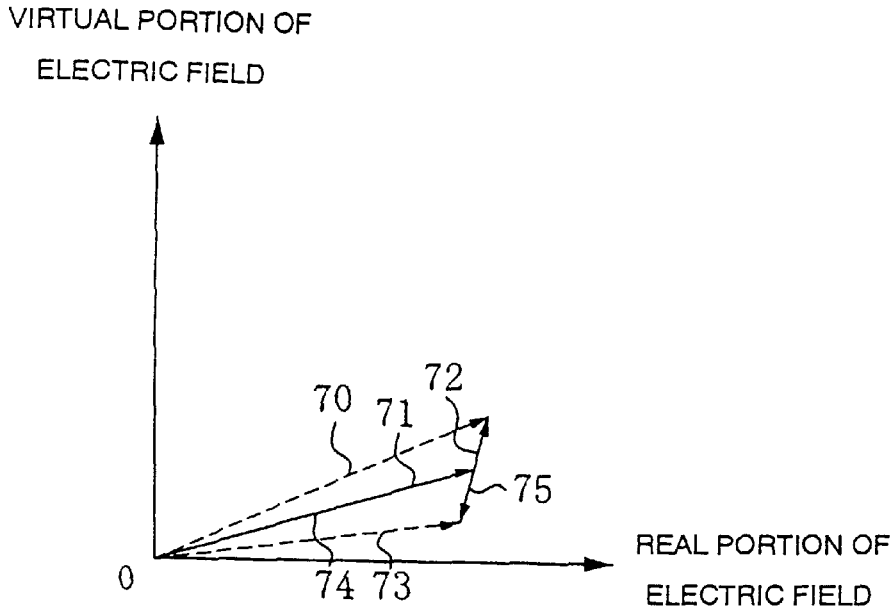
FIG. 22 (*a*) and (*b*) are explanatory diagrams showing a principle of an antenna mirror surface measuring/adjusting apparatus according to an embodiment 18 of the present invention.
Figure 22:
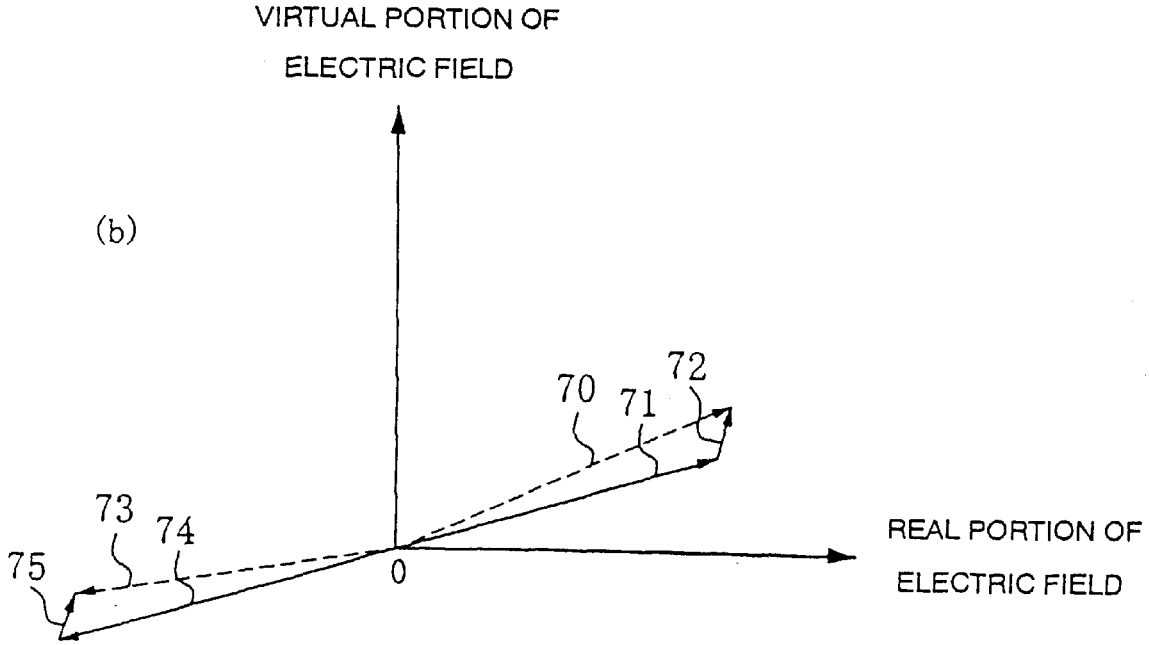

The antenna mirror surface measuring/adjusting apparatus in an embodiment 18 of the present invention will be discussed with reference to the drawings. FIG. 22 is an explanatory diagram illustrating the principle of the antenna mirror surface measuring/adjusting apparatus in the embodiment 18 of the present invention.

Referring to FIG. 22, reference numeral 70 represents an electric field measured value when in a state of in-phase in the case of switching over a phase to in-phase and anti-phase at high-speed in a region set as an object for evaluation, 71 designates an electric field fixed component when in the state of in-phase corresponding to a region which is not set as an object for evaluation, 72 denotes an electric field variable component when in the state of in-phase corresponding to the region set as the object for evaluation, 73 stands for an electric field measured value when in a state of anti-phase in the case of switching over the phase to in-phase and anti-phase at high-speed in the region set as the object for evaluation, 74 designates an electric field fixed component when in the state of anti-phase corresponding to the region which is not set as an object for evaluation, and 75 denotes an electric field variable component when in the state of anti-phase corresponding to the region set as the object for evaluation.

Referring to FIG. 22(*a*), the electric field fixed component 71 when in the state of in-phase and the electric field fixed component 73 when in the state of anti-phase, are measured with a period short enough to make an influence of time-fluctuations ignorable. Taking a difference between the electric field measured value when in the state of in-phase and the electric field measured value when in the state of anti-phase, the electric field fixed component is cancelled, and only the electric field variable component (2-fold) is obtained.

FIG. 22(*b*) shows a state where the phase of the anti-phase electric field is inverted. This makes it feasible to eliminate an error due to the time-fluctuations in the receiving electric power, and hence, even if it takes a long measurement time for enhancing the resolution on the aperture surface and there might occur the time-fluctuations in the meantime, the measurement can be made while eliminating such an influence. Accordingly, the measurement frequency is freely selected, the position of the probe is not two-dimensionally scanned, the position of the test antenna is fixed during the measurement, and the measurement can be carried out in the ideal measurement environment of not being influenced by changes in wind, sunlight and temperature. As a result, the configuration of the mirror surface of the antenna can be measured with high accuracy, and the mirror surface can be highly precisely adjusted based on the error on the mirror surface which is obtained therefrom.

<Embodiment 19>

Incidentally, in the antenna mirror surface measuring/adjusting apparatus in the embodiment 1, the radio waves transmitted from the transmission/receipt shared primary radiator 28 are assumed to be what is excited in a base mode. Therefore, it follows that the radio waves with which the principal reflection mirror 1 is irradiated have such a distribution as to exhibit a high intensity of the electric field at a central portion of the principal reflection mirror 1 and a low intensity of the electric field at an outer peripheral portion thereof. Hence, the mirror surface panel 1*a* at the outer peripheral portion of the principal reflection mirror 1 is low of an irradiation level, and consequently a variation of the receiving electric field is small. Accordingly, there arises a problem in which an error when measuring the configuration of the mirror surface is larger than a measurement error at the central portion.

Further, the radio waves travelling through between the principal reflection mirror 1 and the large-aperture plane mirror 21 spread by owing to the wave effect, and therefore it does not follow that all the radio waves reflected by a certain mirror surface panel 1*a* are again incident on the same mirror surface panel la via the large-aperture plane mirror 21, and some proportion of radio waves are incident on the peripheral area of that mirror surface panel 1*a*. Similarly, some of the radio waves reflected from the peripheral area of the above mirror surface panel 1*a* travel through the large-aperture plane mirror 21 and are thereafter incident upon the same panel 1*a*. Consequently, the mirror surface panel 1*a* at the outer peripheral portion of the principal reflection mirror 1 which exhibits a low intensity of the electric field, with the influence from the peripheral area becoming comparatively large, presents such a problem that the error on the occasion of measuring the configuration of the mirror surface is larger than the measurement error at the central portion.

Moreover, in the antenna mirror surface measuring/adjusting apparatus in the embodiment 1 discussed above, if the mirror surface panel 1*a* of the principal reflection mirror 1 is segmented more minutely, the electric field component of the single piece of mirror surface panel 1*a* to be driven becomes relatively small with respect to the electric field component given by what is exclusive of the single mirror surface panel 1*a* driven. Hence, there might decrease a change in the electric power by driving the single piece of mirror surface panel 1*a*. Accordingly, if the segmentation of the mirror surface panel 1*a* of the principal reflection mirror 1 becomes minute, a problem is that the error caused when measuring the configuration of the mirror surface becomes large.

The embodiment 19 is contrived for obviating the problem given above, and aims at procuring the antenna mirror surface measuring/adjusting apparatus capable of enhancing the accuracy of measuring the configuration of the mirror surface with respect to the mirror surface panel 1*a* even at the outer peripheral portion on the principal reflection mirror 1. Another purpose is to obtain the antenna mirror surface measuring/adjusting apparatus capable of enhancing the accuracy of measuring the configuration of the mirror surface even if the segmentation of the mirror surface panel 1*a* of the principal reflection mirror 1 is minute.

Figure 23:
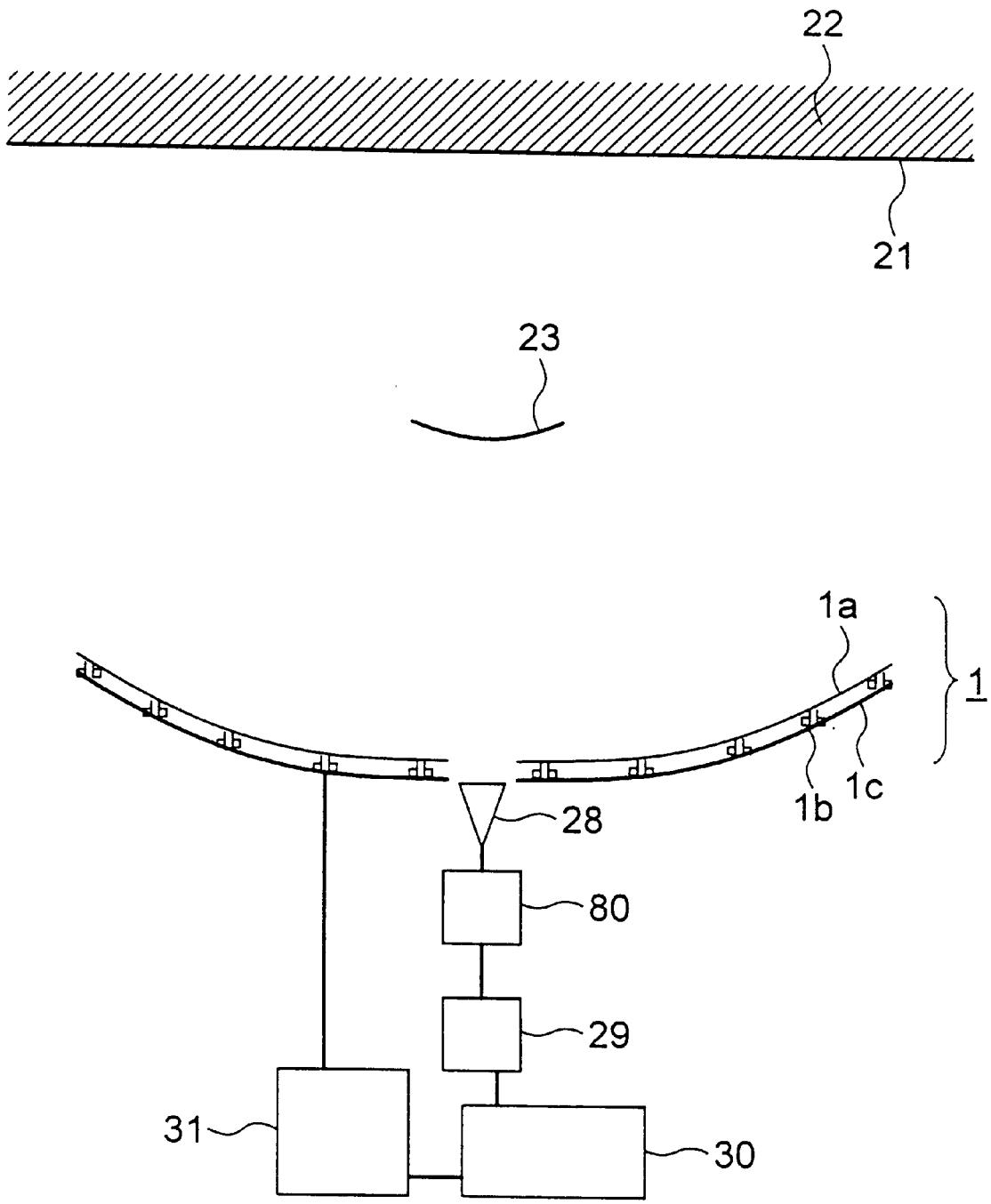
FIG. 23 is a diagram showing a construction of an antenna mirror surface measuring/adjusting apparatus according to an embodiment 19 of the present invention.

The antenna mirror surface measuring/adjusting apparatus in the embodiment 19 of the present invention will be described with reference to the drawings. FIG. 23 is a view showing a construction of the antenna mirror surface measuring/adjusting apparatus in the embodiment 19 of the present invention. Note that the same numerals indicate the same or corresponding components throughout the drawings.

Referring to FIG. 23, the principal reflection mirror 1 of the test antenna includes as its components the mirror surface panel 1*a* configured such that the surface of the principal reflection mirror 1 for reflecting radio waves is segmented, the actuator 1*b* for shifting the mirror surface panel 1*a* to a predetermined position, and the back structure 1*c* for holding the mirror surface panel 1*a* and the actuator 1*b*. There are also shown the large-aperture plane mirror 21, the plane mirror support member 22 for holding the large-aperture plane mirror 21, the auxiliary reflection mirror 23 of the test antenna, the transmission/receipt shared primary radiator 28, the transmitter/receiver 29, the receiving electric field arithmetic processor 30, and the actuator controller 31. Reference numeral 80 designates a high-order mode generator for generating only a specified high-order mode.

Next, an operation of the antenna mirror surface measuring/adjusting apparatus in the embodiment 19 will be described with reference to the drawings.

Figure 24:
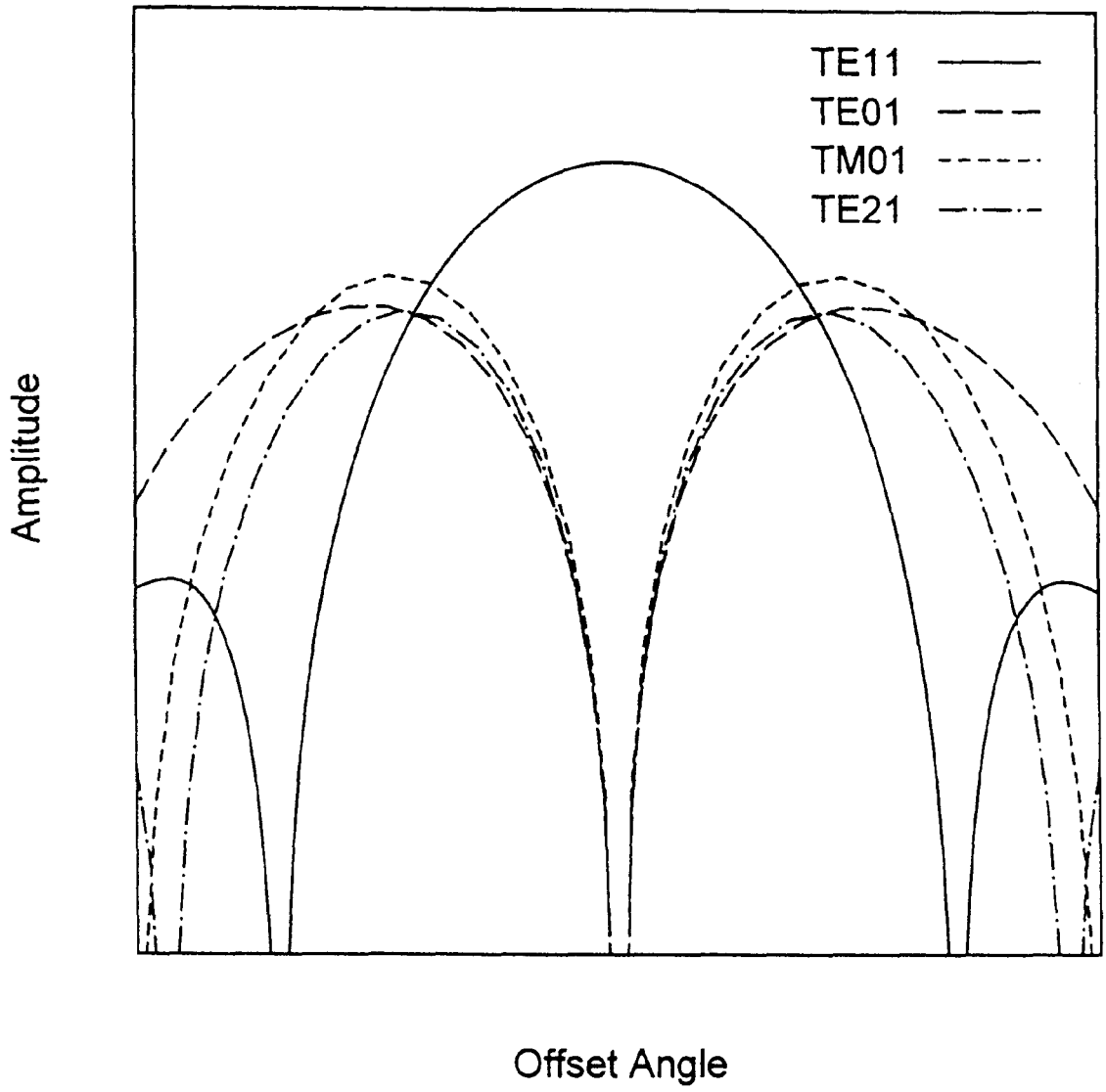
FIG. 24 is a diagram showing a radiation pattern of a transmission/receipt shared primary radiator in a variety of excitation modes in the antenna mirror surface measuring/adjusting apparatus according to the embodiment 19 of the present invention.

FIG. 24 is a diagram showing a radiation pattern of the transmission/receipt shared primary radiator 28 in the respective excitation modes.

The antenna mirror surface measuring/adjusting apparatus in the embodiment 19 includes the high-order mode generator 80. ATE01 mode, a TM01 mode, a TE21 mode, of which the radiation patters each have, as shown in FIG. 24, a null point in the bore site direction, may be selected as a high-order mode for exciting the transmission/receipt shared primary radiator 28.

Then, the principal reflection mirror 1 of the test antenna is directed toward the large-aperture plane mirror 21 disposed in front thereof, and the bore site direction is set orthogonal to the mirror surface of the large-aperture plane mirror 21. During the measurement, the position of the test antenna is fixed in this state.

Next, the radio waves are radiated from the test antenna. The radio waves transmitted by the transmitter/receiver 29 from the transmission/receipt shared primary radiator 28 via the high-order mode generator 80, travel through the auxiliary reflection mirror 23, the principal reflection mirror 1 and the large-aperture plane mirror 21 of the test antenna in this sequence.

On this occasion, the radio waves radiated from the transmission/receipt shared primary radiator 28 are, as described above, excited in the high-order mode, and hence, when falling upon the principal reflection mirror 1 via the auxiliary reflection mirror 23, an irradiation level at the outer peripheral portion thereof is high.

The radio waves reflected from the large-aperture plane mirror 21 are reversely reflected toward the principal reflection mirror 1. These reflected waves arrive at the transmission/receipt shared primary radiator 28, the high-order mode generator 80 and the transmitter/receiver 29 via the principal reflection mirror 1 and the auxiliary reflection mirror 23 of the test antenna in this sequence. A large proportion of transmitting electric power, from which spill-over electric power and a loss are removed, are received as the receiving electric power.

Herein, as in the embodiment 1 discussed above, the procedures in steps 1 through 4 are carried out, thereby obtaining the maps of the configurations of the mirror surface of the principal reflection mirror 1. Then, the mirror surface can be adjusted based on a mirror surface error gained therefrom.

Moreover, the antenna mirror surface measuring/adjusting apparatus in the embodiment 19 involves, as explained above, the use of the high-order mode generator 80 for generating such a high-order mode that the radiation pattern of the transmission/receipt shared primary radiator 28 has the null point in the bore site direction, and hence the irradiation level at the outer peripheral portion of the principal reflection mirror 1 is high. It is therefore feasible to obtain with high accuracy the configuration of the mirror surface at the outer peripheral portion of the principal reflection mirror 1, and to adjust the mirror surface with high accuracy on the basis of the mirror surface error gained therefrom.

<Embodiment 20>

Figure 25:
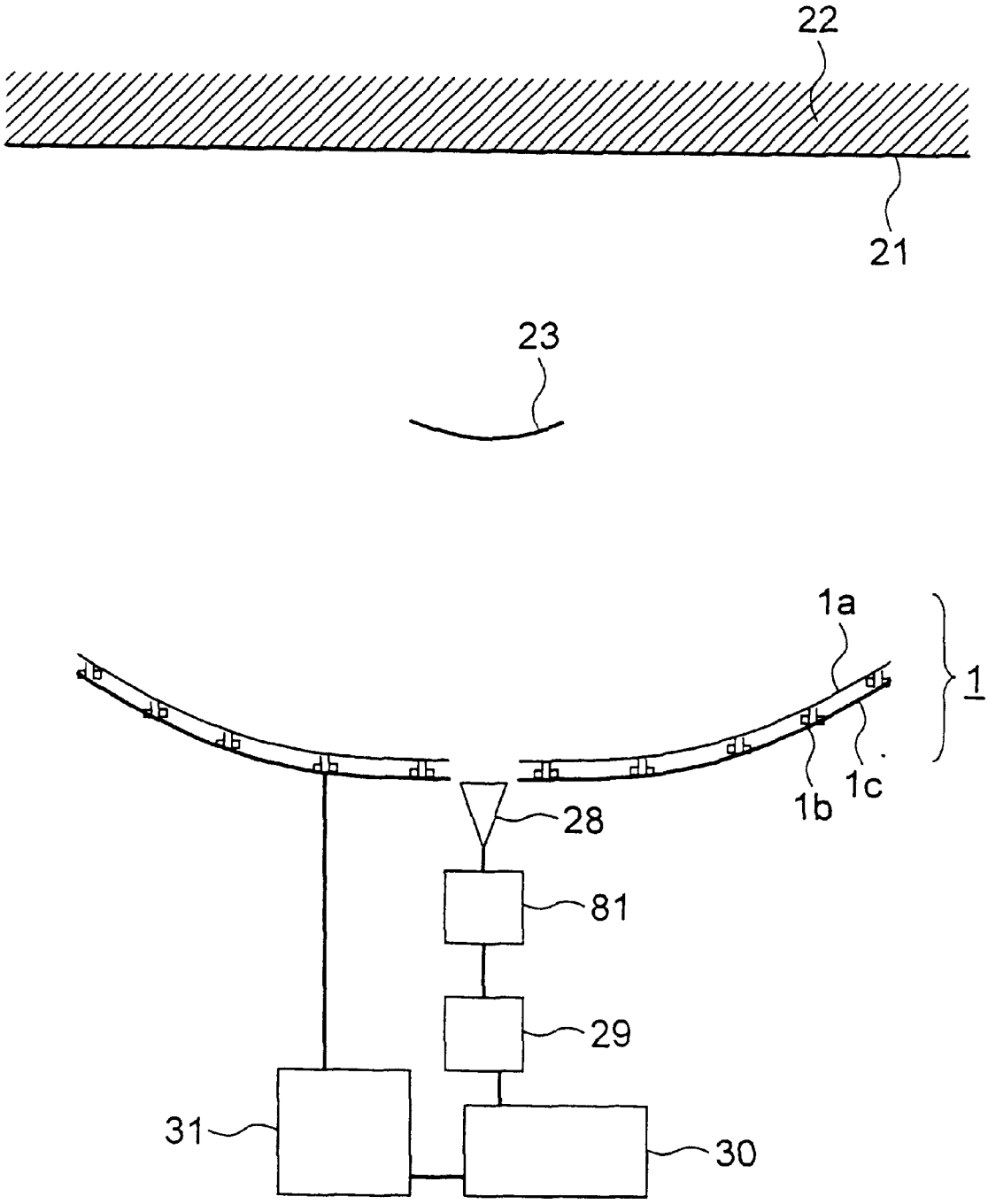
FIG. 25 is a diagram showing a construction of an antenna mirror surface measuring/adjusting apparatus according to an embodiment 20 of the present invention.

The antenna mirror surface measuring/adjusting apparatus according to an embodiment 20 of the present invention will be discussed with reference to the drawings. FIG. 25 is a view showing a construction of the antenna mirror surface measuring/adjusting apparatus in the embodiment 20 of the present invention.

Referring to FIG. 25, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23 of the test antenna, the transmission/receipt shared primary radiator 28, the transmitter/receiver 29, the receiving electric field arithmetic processor 30, and the actuator controller 31. These components are the same as those in the embodiment 19 and perform the same operations as those therein. Further, the numeral 81 designates a high-order mode synthesizer capable of exciting by synthesizing a plurality of modes.

The antenna mirror surface measuring/adjusting apparatus according to the embodiment 20 includes the high-order mode synthesizer 81, and there is previously selected a synthesizing ratio of the high-order mode to a base mode thereof, which is synthesized by the high-order mode synthesizer 81 and serves to excite the transmission/receipt shared primary radiator 28 so that the principal reflection mirror 1 is uniformly irradiated with the radiation pattern from the radiator 28 via the auxiliary reflection mirror 23.

Then, the principal reflection mirror 1 of the test antenna is directed toward the large-aperture plane mirror 21 disposed in front thereof, and the bore site direction is set orthogonal to the mirror surface of the large-aperture plane mirror 21. During the measurement, the position of the test antenna is fixed in this state.

Next, the radio waves are radiated from the test antenna. The radio waves transmitted by the transmitter/receiver 29 from the transmission/receipt shared primary radiator 28 via the high-order mode synthesizer 81, travel through the auxiliary reflection mirror 23, the principal reflection mirror 1 and the large-aperture plane mirror 21 of the test antenna in this sequence.

On this occasion, the radio waves radiated from the transmission/receipt shared primary radiator 28 are, as described above, excited by the high-order mode synthesizer 81, and hence, when irradiating the principal reflection mirror 1 via the auxiliary reflection mirror 23, the irradiation levels at the respective portions of the principal reflection mirror 1 become uniform.

The radio waves reflected from the large-aperture plane mirror 21 are reversely reflected toward the principal reflection mirror 1. The reflected waves arrive at the transmission/receipt shared primary radiator 28, the high-order mode synthesizer 81 and the transmitter/receiver 29 via the principal reflection mirror 1 and the auxiliary reflection mirror 23 of the test antenna in this sequence. A large proportion of transmitting electric power, from which spillover electric power and a loss are removed, is received as the receiving electric power.

Herein, as in the embodiment 1 discussed above, the procedures in steps 1 through 4 are carried out, thereby obtaining the maps of the configurations of the mirror surface of the principal reflection mirror 1. Then, the mirror surface can be adjusted based on a mirror surface error gained therefrom.

Moreover, the antenna mirror surface measuring/adjusting apparatus according to the embodiment 20 employs, as explained above, the use of the high-order mode synthesizer 81 for uniformly irradiating the principal reflection mirror 1 with the radiation pattern of the transmission/receipt shared primary radiator 28 through the auxiliary reflection mirror 23. It is therefore feasible to obtain with high accuracy the configuration of the mirror surface over the entire area of the principal reflection mirror 1, and to adjust the mirror surface with high accuracy on the basis of the mirror surface error gained therefrom.

<Embodiment 21>

Figure 26:
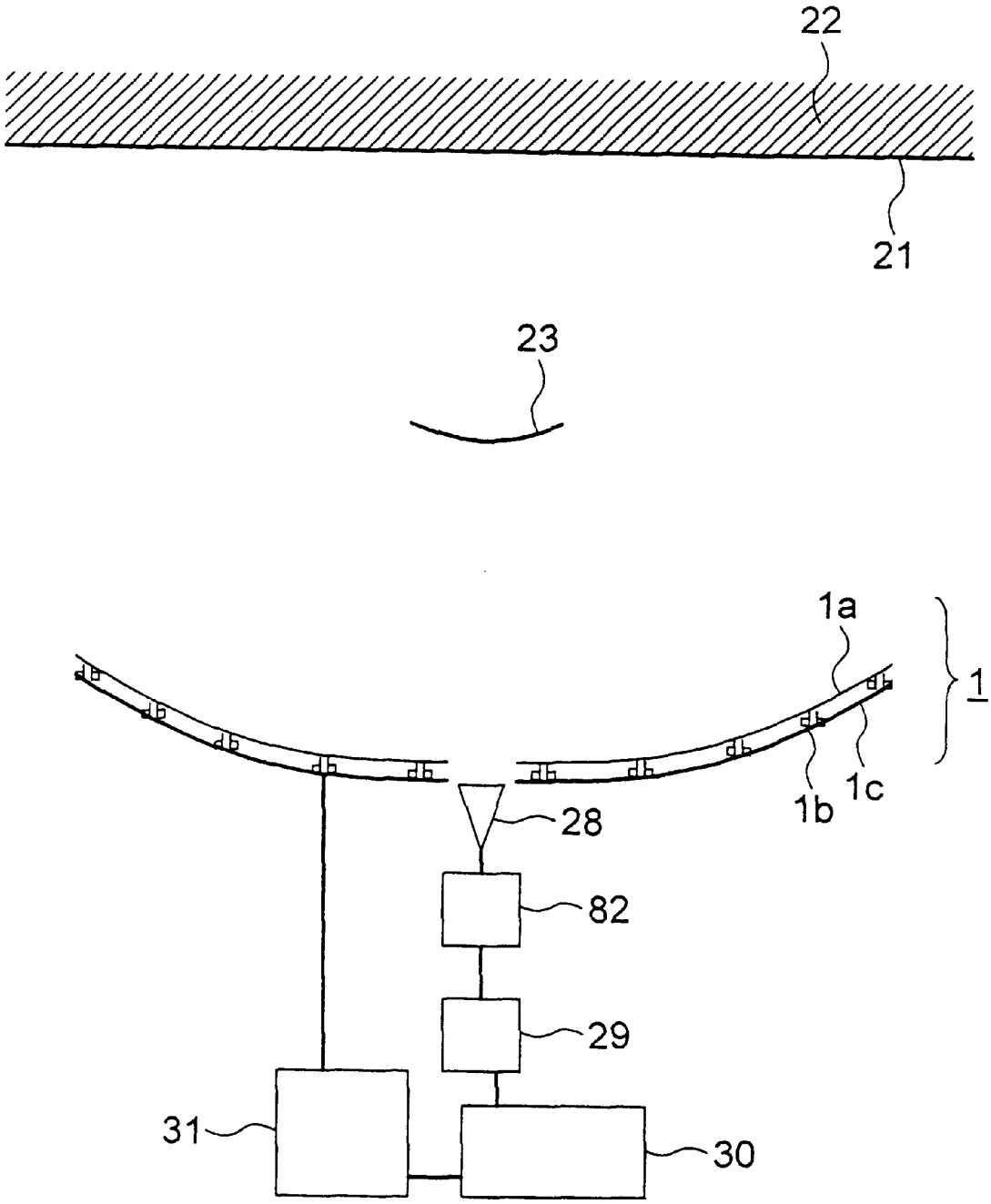
FIG. 26 is a diagram showing a construction of an antenna mirror surface measuring/adjusting apparatus according to an embodiment 21 of the present invention.

The antenna mirror surface measuring/adjusting apparatus according to an embodiment 21 of the present invention will be discussed with reference to the drawings. FIG. 26 is a view showing a construction of the antenna mirror surface measuring/adjusting apparatus in the embodiment 21 of the present invention.

Referring to FIG. 26, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23 of the test antenna, the transmission/receipt shared primary radiator 28, the transmitter/receiver 29, the receiving electric field arithmetic processor 30, and the actuator controller 31. These components are the same as those in the embodiment 19 and perform the same operations as those therein. Further, the numeral 82 designates an electric supply device capable of independently exciting each of the base mode and the specified high-order mode.

The antenna mirror surface measuring/adjusting apparatus in the embodiment 21 includes the electric supply device 82 capable of independently exciting each of the base mode and the specified high-order mode, and the TE01 mode, the TM01 mode, the TE21 mode, of which the radiation patterns each have a null point in the bore site direction, may be selected as a high-order mode for exciting the transmission/receipt shared primary radiator 28.

Then, the principal reflection mirror 1 of the test antenna is directed toward the large-aperture plane mirror 21 disposed in front thereof, and the bore site direction is set orthogonal to the mirror surface of the large-aperture plane mirror 21. During the measurement, the position of the test antenna is fixed in this state.

Next, the radio waves are radiated from the test antenna. The radio waves transmitted by the transmitter/receiver 29 from the transmission/receipt shared primary radiator 28 via the electric supply device 82, travel through the auxiliary reflection mirror 23, the principal reflection mirror 1 and the large-aperture plane mirror 21 of the test antenna in this sequence.

The radio waves reflected from the large-aperture plane mirror 21 are reversely reflected toward the principal reflection mirror 1. The reflected waves arrive at the transmission/receipt shared primary radiator 28, the electric supply device 82 and the transmitter/receiver 29 via the principal reflection mirror 1 and the auxiliary reflection mirror 23 of the test antenna in this sequence. A large proportion of transmitting electric power, from which spillover electric power and a loss are removed, is received as the receiving electric power.

Herein, as in the embodiment 1 discussed above, the procedures in steps 1 through 4 are carried out in each of the case of the excitation in the base mode and the case of the excitation in the high-order mode, thereby obtaining the maps of the configurations of the mirror surface of the principal reflection mirror 1 in each case.

In the thus obtained maps of the configurations of the mirror surface in the case of the excitation in the base mode, the irradiation level at the central portion of the principal reflection mirror 1 is high, and hence there is exhibited a high accuracy of the mirror surface configuration at the central portion of the principal reflection mirror 1. By contrast, in the maps of the configurations of the mirror surface in the case of the excitation in the high-order mode, the irradiation level at the outer peripheral portion of the principal reflection mirror 1 is high, and hence there is exhibited a high accuracy of the mirror surface configuration at the outer peripheral portion of the principal reflection mirror 1.

An average is taken in each case, and it follows that the restructured maps of the configurations of the mirror surface show a uniform accuracy over the entire area of the principal reflection mirror 1. Accordingly, the mirror surface can be adjusted at the uniform accuracy over the entire area of the principal reflection mirror 1 by making the adjustment of the mirror surface on the basis of the mirror surface error obtained from the mirror surface configuration.

Further, when measuring both of the amplitude and the phase of the receiving electric field and when measuring only the amplitude of the receiving electric field, the maps of the mirror surface errors are weighted with the amplitude of the receiving electric field and thus averaged in each case, thus restructuring the maps of the mirror surface configurations. With these restructured maps, the mirror surface can be adjusted at a much higher accuracy over the entire area of the principal reflection mirror 1.

<Embodiment 22>

Figure 27:
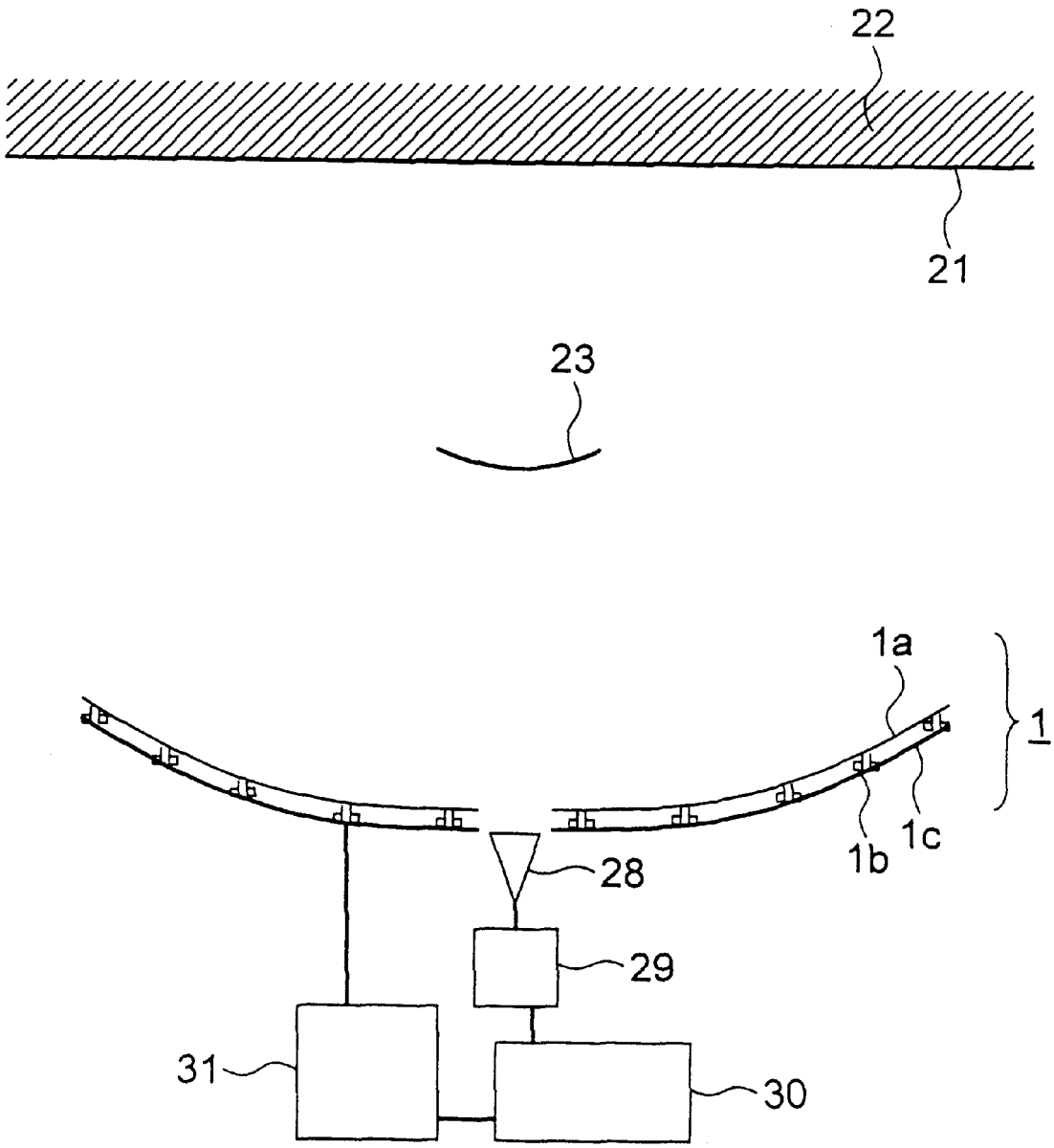
FIG. 27 is a diagram showing a construction of an antenna mirror surface measuring/adjusting apparatus according to an embodiment 22 of the present invention.

The antenna mirror surface measuring/adjusting apparatus according to an embodiment 22 of the present invention will be discussed with reference to the drawings. FIG. 27 is a view showing a construction of the antenna mirror surface measuring/adjusting apparatus in the embodiment 22 of the present invention.

Referring to FIG. 27, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23 of the test antenna, the transmission/receipt shared primary radiator 28, the transmitter/receiver 29, the receiving electric field arithmetic processor 30, and the actuator controller 31. These components are the same as those in the embodiment 19 and perform the same operations as those therein.

Figure 28:
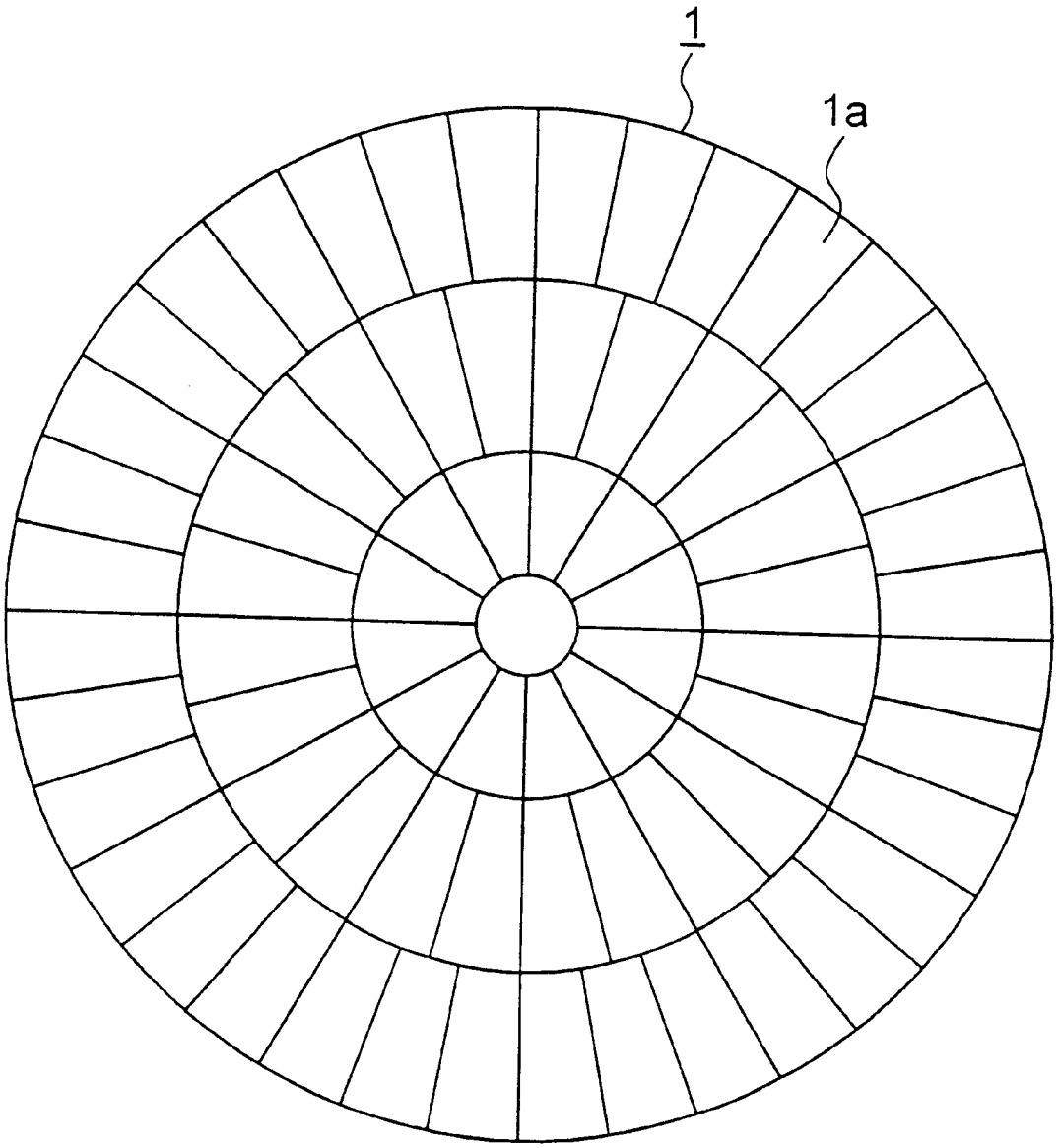
FIG. 28 is a diagram showing an example of a mirror surface panel segmentation in the antenna mirror surface measuring/adjusting apparatus according to the embodiment 22 of the present invention.

FIG. 28 is a diagram showing an example of the mirror surface panel segmentation in the antenna mirror surface measuring/adjusting apparatus in the embodiment 22 of the present invention.

Referring to FIG. 28, the numeral 1 designates the principal reflection mirror of the test antenna including as its component the mirror surface panel 1*a*.

At first, the principal reflection mirror 1 of the test antenna is directed toward the large-aperture plane mirror 21 disposed in front thereof, and the bore site direction is set orthogonal to the mirror surface of the large-aperture plane mirror 21. During the measurement, the position of the test antenna is fixed in this state.

Next, the radio waves are radiated from the test antenna. The radio waves transmitted by the transmitter/receiver 29 from the transmission/receipt shared primary radiator 28, travel through the auxiliary reflection mirror 23, the principal reflection mirror 1 and the large-aperture plane mirror 21 of the test antenna in this sequence.

The radio waves reflected from the large-aperture plane mirror 21 are reversely reflected toward the principal reflection mirror 1. The reflected waves arrive at the transmission/receipt shared primary radiator 28, the electric supply device 82 and the transmitter/receiver 29 via the principal reflection mirror 1 and the auxiliary reflection mirror 23 of the test antenna in this sequence. A large proportion of transmitting electric power, from which spillover electric power and a loss are removed, are received as the receiving electric power.

Herein, as in the embodiment 1 discussed above, the procedures in steps 1 through 4 are carried, thereby obtaining the maps of the configurations of the mirror surface of the principal reflection mirror 1. Then, the mirror surface can be adjusted based on these maps.

In the measurement in the state where the phase of the electric field is changed in step 2, the actuator of the antenna mirror surface measuring/adjusting apparatus in the embodiment 22 shifts the position of the single piece of mirror surface panel, or simultaneously shifts those of the plurality of mirror surface panels so that the electric power with which the mirror surface of the test antenna is irradiated becomes uniform.

Therefore, it follows that the thus obtained maps of the configurations of the mirror surface exhibit the uniform accuracy over the entire area of the principal reflection mirror 1. By Accordingly, the mirror surface is adjusted based on the mirror surface error gained from the mirror surface configurations, whereby the mirror surface can be adjusted at the uniform accuracy over the entire area of the principal reflection mirror 1.

<Embodiment 23>

Figure 29:
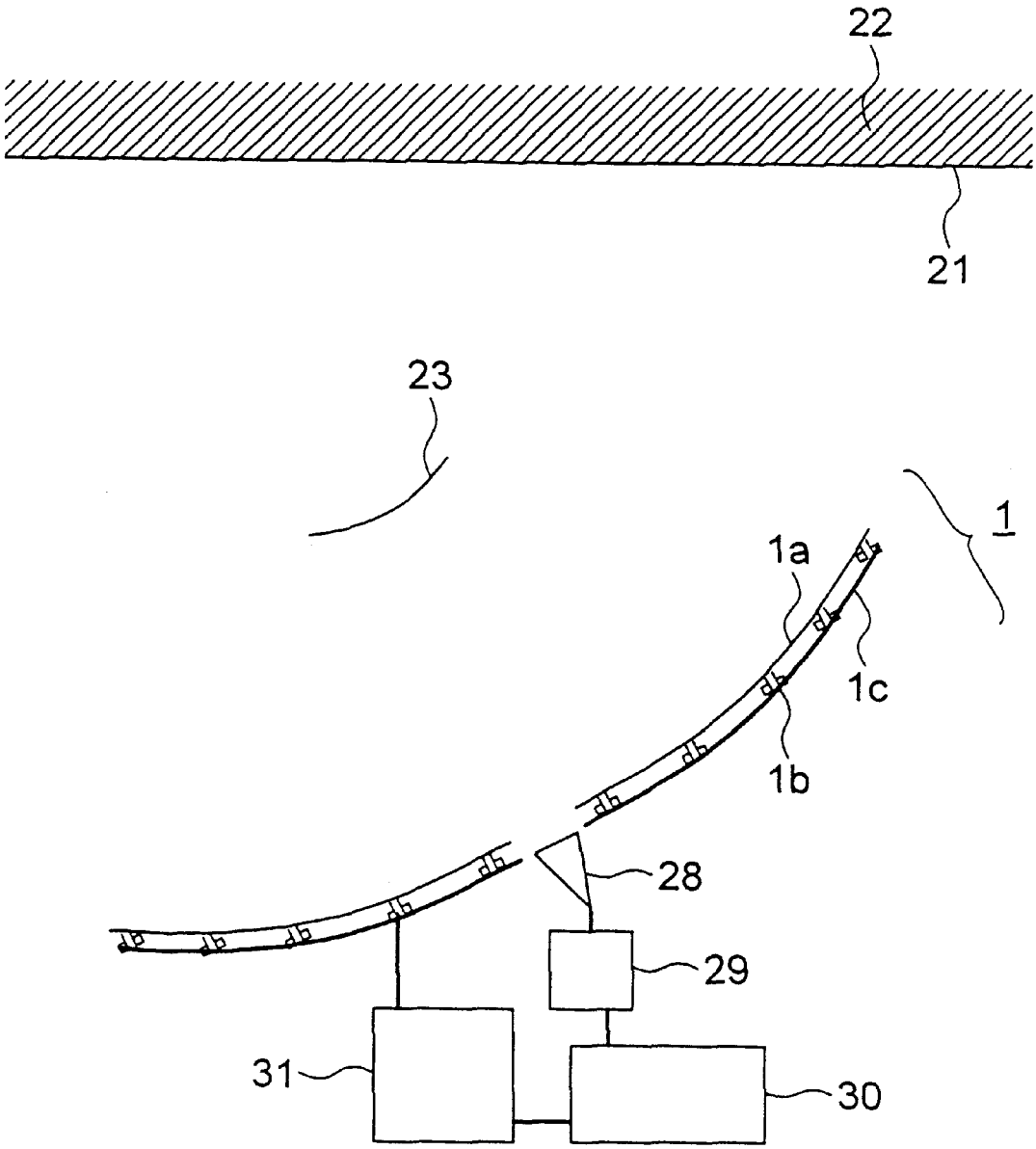
FIG. 29 is a diagram showing a construction of an antenna mirror surface measuring/adjusting apparatus according to an embodiment 23 of the present invention.
Figure 30:
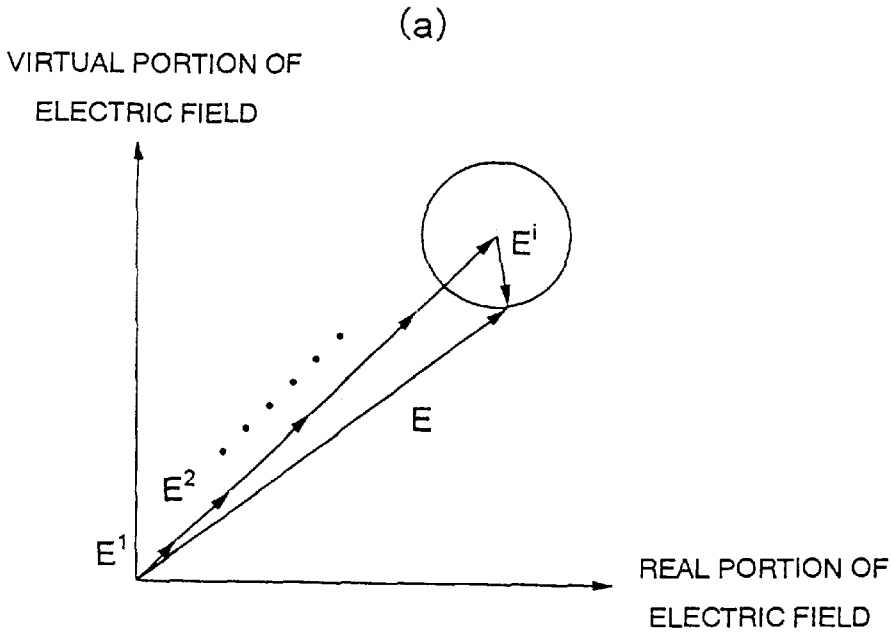
FIG. 30 (*a*) and (*b*) are diagrams showing an operational principle of the antenna mirror surface measuring/adjusting apparatus in the embodiment 23 of the present invention.
Figure 30:
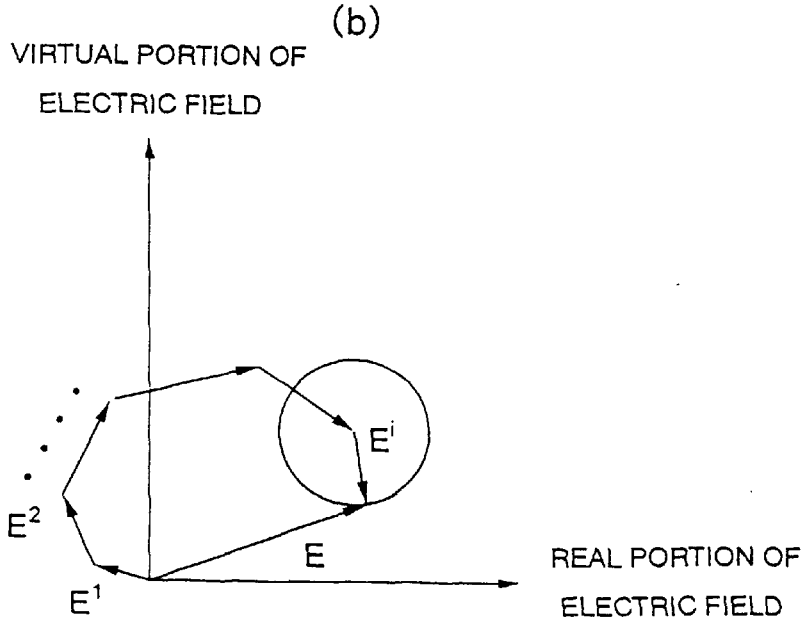
Figure 31A:
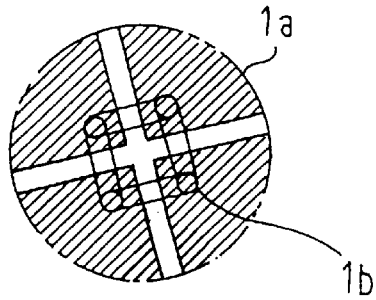
FIGS. 31, 31A are diagrams schematically showing a construction of an antenna mirror surface measuring/adjusting apparatus in the prior art.
Figure 31:
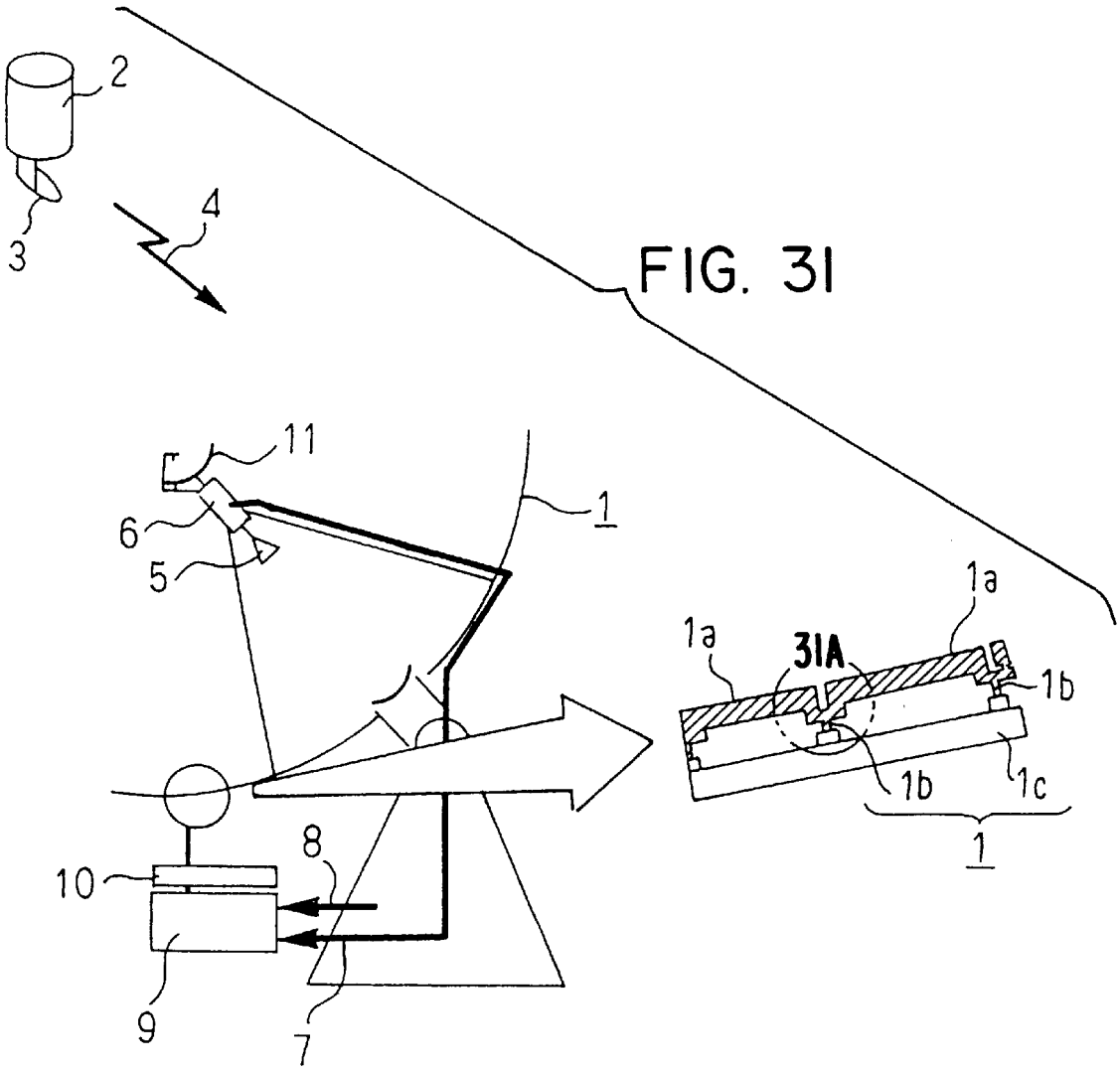

The antenna mirror surface measuring/adjusting apparatus according to an embodiment 23 of the present invention will be discussed with reference to the drawings. FIG. 29 is a view showing a construction of the antenna mirror surface measuring/adjusting apparatus in the embodiment 23 of the present invention. FIG. 30 is an explanatory diagram showing the principle of the antenna mirror surface measuring/adjusting apparatus in the embodiment 23 of the present invention.

Referring to FIG. 29, the principal reflection mirror 1 of the test antenna is constructed of the mirror surface panel 1*a*, the actuator 1*b*, and the back structure 1*c*. There are also shown the large-aperture plane mirror 21, the plane mirror support member 22, the auxiliary reflection mirror 23 of the test antenna, the transmission/receipt shared primary radiator 281, the transmitter/receiver 29, the receiving electric field arithmetic processor 30, and the actuator controller 31. These components are the same as those in the embodiment 19 and perform the same operations as those therein.

In the antenna mirror surface measuring/adjusting apparatus in the embodiment 23, the aperture surface of the test antenna is set at an angle orthogonal to an arbitrary side lobe direction with respect to the large-aperture plane mirror 21. During the measurement, the position of the test antenna is fixed in this state.

Next, the radio waves are radiated from the test antenna. The radio waves transmitted by the transmitter/receiver 29 from the transmission/receipt shared primary radiator 28, travel through the auxiliary reflection mirror 23, the principal reflection mirror 1 and the large-aperture plane mirror 21 of the test antenna in this sequence.

The radio waves reflected from the large-aperture plane mirror 21 are reversely reflected toward the principal reflection mirror 1. The reflected waves arrive at the transmission/receipt shared primary radiator 28 and the transmitter/receiver 29 via the principal reflection mirror 1 and the auxiliary reflection mirror 23 of the test antenna in this sequence. As for the receiving electric power, the large-aperture plane mirror 21 is not orthogonal to the bore site direction, and hence there is received only the radiation electric power, acting in the side lobe direction, of all the radiation electric power from the test antenna, from which the spillover electric power and the loss are removed.

Herein, as in the embodiment 1 discussed above, the procedures in steps 1 through 4 are carried out, thereby obtaining the maps of the mirror surface errors of the principal reflection mirror 1. Then, the mirror surface can be adjusted based on these maps.

Herein, on the occasion of obtaining a phase difference between the electric fields in step 3, the plane waves are incident in the case where the aperture surface of the test antenna is set at the angle orthogonal to the bore site direction with respect to the large-aperture plane mirror 21, and therefore, as shown in FIG. 30(*a*), the receiving electric fields from the individual mirror surface panels 1*a* are each in phase. Accordingly, if the i-th mirror surface panel 1*a* to be driven is small, an electric field component Ei based thereon is smaller than a synthesized electric field based on other mirror surface panels 1*a*, and hence it follows that a change in the receiving electric field E might decrease.

In contrast with this, in the antenna mirror surface measuring/adjusting apparatus according to the embodiment 23, the aperture surface of the test antenna is set at the angle orthogonal to the arbitrary side lobe direction with respect to the large-aperture plane mirror 21, and consequently, as shown in FIG. 30(*b*), the receiving electric fields from the respective mirror surface panels 1*a* take phases different from each other. With a proper side lobe direction being selected, even if the i-th mirror surface panel 1*a* to be driven is small, the electric field Ei therefrom is not unnecessarily smaller than the synthetic electric field, with the result that it is possible to acquire the same effect as that when increasing a relative irradiation level to the i-th mirror surface panel 1*a* to be driven.

It therefore follows that the thus obtained maps of the mirror surface configurations have the high accuracy even when the segmentation of the mirror surface panels 1*a* of the principal reflection mirror 1 is minute. Accordingly, the mirror surface is adjusted based on the mirror surface error gained from the mirror surface configurations, whereby the mirror surface can be adjusted with high accuracy.

As described above, according to the first aspect of the present invention, the antenna mirror surface measuring/adjusting apparatus for measuring a mirror surface of a principal reflection mirror constructed of a group of a plurality of mirror surface panels, and adjusting the mirror panel is comprised of:

- a plane mirror larger than an aperture surface of the principal reflection mirror and set in parallel with the aperture surface;
- transmitting/receiving means for transmitting and receiving radio waves between the principal reflection mirror and the plane mirror;
- actuator means for driving the group of mirror surface panels of the principal reflection mirror; and
- an arithmetic processor for measuring, each time the actuator means shifts a position of the mirror surface panel from an initial state of the mirror surface panel of the principal reflection mirror, radio wave signals of radio waves which are radiated by the transmitting/receiving means and reflected back from the plane mirror, obtaining an aperture surface phase distribution in an initial state of the principal reflection mirror by executing an arithmetic process on these measured signals, then gaining configurations of the mirror surface on the basis of the aperture surface phase distribution, and adjusting the mirror surface by use of the actuator means in accordance with the thus obtained mirror surface configurations. Accordingly, the apparatus has an effect that the measurement frequency is freely selected, the position of the probe is not two-dimensionally scanned, the position of the test antenna is fixed during the measurement, the measurement can be carried out in the ideal measurement environment of not being influenced by changes in wind, sunlight and temperature, and, as a result, the configuration of the mirror surface of the antenna can be measured with high accuracy, making it possible to highly and precisely adjust the mirror surface based on the error on the mirror surface which is obtained therefrom.

As described above, according to the second aspect of the present invention, in the antenna mirror surface measuring/adjusting apparatus of the first aspect, the arithmetic processor obtains a phase difference between an electric field component relative to the mirror surface panel to be driven and an electric field component given by those other than this panel by developing an amplitude and a phase of the measured electric field in complex Fourier series with respect to a driven quantity of the mirror surface panel, and thus obtains the aperture surface phase distribution. Accordingly, the apparatus has an effect that the measurement frequency is freely selected, the position of the probe is not two-dimensionally scanned, the position of the test antenna is fixed during the measurement, the measurement can be carried out in the ideal measurement environment of not being influenced by changes in wind, sunlight and temperature, and, as a result, the configuration of the mirror surface of the antenna can be measured with high accuracy, making it possible to highly and precisely adjust the mirror surface based on the error on the mirror surface which is obtained therefrom.

As described above, according to the third aspect of the present invention, in the antenna mirror surface measuring/adjusting apparatus of the first aspect, the arithmetic processor obtains the phase difference between an electric field component relative to the mirror surface panel to be driven and an electric field component given by those other than this panel by developing only electric power of the measured electric field in the complex Fourier series with respect to the driven quantity of the mirror surface panel, and thus obtains the aperture surface phase distribution. Accordingly, the apparatus has an effect that the measurement frequency is freely selected, the position of the probe is not two-dimensionally scanned, the position of the test antenna is fixed during the measurement, the measurement can be carried out in the ideal measurement environment of not being influenced by changes in wind, sunlight and temperature, and, as a result, the configuration of the mirror surface of the antenna can be measured with high accuracy, making it possible to highly and precisely adjust the mirror surface based on the error on the mirror surface which is obtained therefrom.

As described above, according to the fourth aspect of the present invention, in the antenna mirror surface measuring/adjusting apparatus of the first aspect, the arithmetic processor obtains the phase difference between an electric field component relative to the mirror surface panel to be driven and an electric field component given by those other than this panel by developing only a phase of the measured electric field in the complex Fourier series with respect to the driven quantity of the mirror surface panel, and thus obtains the aperture surface phase distribution. Accordingly, the apparatus has an effect that the measurement frequency is freely selected, the position of the probe is not two-dimensionally scanned, the position of the test antenna is fixed during the measurement, the measurement can be carried out in the ideal measurement environment of not being influenced by changes in wind, sunlight and temperature, and, as a result, the configuration of the mirror surface of the antenna can be measured with high accuracy, making it possible to highly and precisely adjust the mirror surface based on the error on the mirror surface which is obtained therefrom.

As described above, according to the fifth aspect of the present invention, the antenna mirror surface measuring/adjusting apparatus for measuring a mirror surface of a principal reflection mirror constructed of a group of a plurality of mirror surface panels, and adjusting the mirror panel is comprised of:

a plane mirror larger than an aperture surface of the principal reflection mirror and set in parallel with the aperture surface;

transmitting/receiving means for transmitting and receiving radio waves between the principal reflection mirror and the plane mirror;

phase shifting means for changing a phase of the radio wave, provided between the plane mirror and the transmitting/receiving means;

actuator means for driving the group of mirror surface panels of the principal reflection mirror; and an arithmetic processor for measuring, each time the phase shifting means changes the phase from an initial state of the mirror surface panel of said principal reflection mirror, radio wave signals of radio waves which are radiated by the transmitting/receiving means and reflected back from the plane mirror, obtaining a phase difference between the measured electric fields by developing the electric power of these measured electric fields in complex Fourier series with respect to a quantity of the phase change by the phase shifting means, obtaining an aperture surface phase distribution in an initial state of the principal reflection mirror therefrom, then gaining configurations of the mirror surface on the basis of the aperture surface phase distribution, and adjusting the mirror surface by use of the actuator means in accordance with the thus obtained mirror surface configurations. Accordingly, the apparatus has an effect that the measurement frequency is freely selected, the position of the probe is not two-dimensionally scanned, the position of the test antenna is fixed during the measurement, the measurement can be carried out in the ideal measurement environment of not being influenced by changes in wind, sunlight and temperature, and, as a result, the configuration of the mirror surface of the antenna can be measured with high accuracy, making it possible to highly and precisely adjust the mirror surface based on the error on the mirror surface which is obtained therefrom.

As described above, according to the sixth aspect of the present invention, the antenna mirror surface measuring/adjusting apparatus for measuring a mirror surface of a principal reflection mirror constructed of a group of a plurality of mirror surface panels, and adjusting the mirror panel, is comprised of:

a plane mirror larger than an aperture surface of the principal reflection mirror, set in parallel with the aperture surface, and constructed of a group of a plurality of segmented plane panels;

transmitting/receiving means for transmitting and receiving radio waves between the principal reflection mirror and the plane mirror;

actuator means for driving the group of mirror surface panels of the principal reflection mirror, and the group of segmented plane panels of the plane mirror; and an arithmetic processor for measuring, each time said actuator means shifts a position of the segmented plane panel from an initial state of the mirror surface panel of the principal reflection mirror, radio wave signals of radio waves which are radiated by the transmitting/receiving means and reflected back from the plane mirror, obtaining an aperture surface phase distribution in an initial state of the principal reflection mirror by executing an arithmetic process on these measured signals, then gaining configurations of the mirror surface on the basis of the aperture surface phase distribution, and adjusting the mirror surface by use of the actuator means in accordance with the thus obtained mirror surface configurations. Accordingly, the apparatus has an effect that the measurement frequency is freely selected, the position of the probe is not two-dimensionally scanned, the position of the test antenna is fixed during the measurement, the measurement can be carried out in the ideal measurement environment of not being influenced by changes in wind, sunlight and temperature, and, as a result, the configuration of the mirror surface of the antenna can be measured with high accuracy, making it possible to highly and precisely adjust the mirror surface based on the error on the mirror surface which is obtained therefrom.

As described above, according to the seventh aspect of the present invention, in the antenna mirror surface measuring/adjusting apparatus of the first aspect, the plane mirror is constructed of a first plane mirror orthogonal to a direction of the gravity, and a second plane mirror parallel to a plane including the direction of the gravity, and the arithmetic processor performs the measurement arithmetic process in such a way that the aperture surface of the principal reflection mirror is disposed in parallel to the first plane mirror, and next performs the measurement arithmetic process in such a way that the aperture surface of the principal reflection mirror is disposed in parallel to the second plane mirror. Accordingly, the apparatus has an effect that the measurement frequency is freely selected, the position of the probe is not two-dimensionally scanned, the position of the test antenna is fixed during the measurement, the measurement can be carried out in the ideal measurement environment of not being influenced by changes in wind, sunlight and temperature, and, as a result, the configuration of the mirror surface of the antenna can be measured with high accuracy, making it possible to highly and precisely adjust the mirror surface based on the error on the mirror surface which is obtained therefrom.

As described above, according to the eighth aspect of the present invention, the antenna mirror surface measuring/adjusting apparatus of the first aspect further comprises a high-order mode generator capable of exciting the radio waves radiated from the transmitting/receiving means in a specified high-order mode. Accordingly, the apparatus has an effect that the measurement accuracy of mirror configurations may be enhanced also on the mirror surface panels at the peripheral portion of the principal reflection mirror, even when the mirror surface panel of the principal reflection mirror is segmented into many small pieces.

As described above, according to the ninth aspect of the present invention, the antenna mirror surface measuring/adjusting apparatus of the first aspect further comprises a high-order mode synthesizer capable of exciting the radio waves radiated from the transmitting/receiving means by synthesizing a plurality of modes. Accordingly, the apparatus has an effect that the measurement accuracy of mirror configurations may be enhanced also on the mirror surface panels at the peripheral portion of the principal reflection mirror, even when the mirror surface panel of the principal reflection mirror is segmented into many small pieces.

As described above, according to the tenth aspect of the present invention, the antenna mirror surface measuring/adjusting apparatus of the first aspect further comprises an electric supply device capable of independently exciting the radio waves radiated from the transmitting/receiving means respectively in a base mode and in a specified high-order mode. Accordingly, the apparatus has an effect that the measurement accuracy of mirror configurations may be enhanced also on the mirror surface panels at the peripheral portion of the principal reflection mirror, even when the mirror surface panel of the principal reflection mirror is segmented into many small pieces.

According to the eleventh aspect of the present invention, in the antenna mirror surface measuring/adjusting apparatus of the first aspect, the arithmetic processor receives, each time the actuator means shifts a position of the single of mirror surface panel or shifts simultaneously positions of the plurality of mirror surface panels so that the electric power with which the mirror surface of the principal reflection mirror is irradiated becomes uniform, the radio waves radiated from the transmitting/receiving means and reflected back to the transmitting/receiving means from the plane mirror, then obtains the aperture surface phase distribution in the initial state of the principal reflection mirror by executing the arithmetic process on the radio waves, and gaining the mirror surface configurations therefrom. Accordingly, the apparatus has an effect that the measurement accuracy of mirror configurations may be enhanced also on the mirror surface panels at the peripheral portion of the principal reflection mirror, even when the mirror surface panel of the principal reflection mirror is segmented into many small pieces.

According to the twelfth aspect of the present invention, the antenna mirror surface measuring/adjusting apparatus for measuring a mirror surface of a principal reflection mirror constructed of a group of a plurality of mirror surface panels, and adjusting the mirror panel, is comprised of:

a plane mirror larger than an aperture surface of the principal reflection mirror;

transmitting/receiving means for transmitting and receiving radio waves between the principal reflection mirror and the plane mirror;

actuator means for driving the group of mirror surface panels of the principal reflection mirror; and an arithmetic processor for measuring, each time the actuator means shifts a position of the mirror surface panel from an initial state of the mirror surface panel of the principal reflection mirror, radio wave signals of radio waves which are radiated by the transmitting/receiving means and reflected back from the plane mirror, obtaining an aperture surface phase distribution in an initial state of the principal reflection mirror by executing an arithmetic process on these measured signals, then gaining configurations of the mirror surface on the basis of the aperture surface phase distribution, and adjusting the mirror surface by use of the actuator means in accordance with the thus obtained mirror surface configurations, in which an aperture surface of the principal reflection mirror is set at an angle orthogonal to an-arbitrary side lobe direction with respect to the plane mirror. Accordingly, the apparatus has an effect that the measurement accuracy of mirror configurations may be enhanced also on the mirror surface panels at the peripheral portion of the principal reflection mirror, even when the mirror surface panel of the principal reflection mirror is segmented into many small pieces.

What is claimed is:

1. An antenna mirror surface measuring/adjusting apparatus for measuring a mirror surface of a principal reflection mirror constructed of a group of a plurality of mirror surface panels, and adjusting the mirror panel, said apparatus comprising:

a plane mirror larger than an aperture surface of said principal reflection mirror and set in parallel with the aperture surface;

transmitting/receiving means for transmitting and receiving radio waves between said principal reflection mirror and said plane mirror;

actuator means for driving said group of mirror surface panels of said principal reflection mirror; and an arithmetic processor for measuring, each time said actuator means shifts a position of said mirror surface panel from an initial state of said mirror surface panel of said principal reflection mirror, radio wave signals of radio waves which are radiated by said transmitting/receiving means and reflected back from said plane mirror, obtaining an aperture surface phase distribution in an initial state of said principal reflection mirror by executing an arithmetic process on these measured signals, then gaining configurations of the mirror surface on the basis of the aperture surface phase distribution, and adjusting the mirror surface by use of said actuator means in accordance with the thus obtained mirror surface configurations.

2. An antenna mirror surface measuring/adjusting apparatus according to claim 1, wherein said arithmetic processor obtains a phase difference between the measured electric fields by developing an amplitude and a phase of the measured electric field in complex Fourier series with respect to a driven quantity of said mirror surface panel, and thus obtains the aperture surface phase distribution.

3. An antenna mirror surface measuring/adjusting apparatus according to claim 1, wherein said arithmetic processor obtains the phase difference between the measured electric fields by developing only electric power of the measured electric field in the complex Fourier series with respect to the driven quantity of said mirror surface panel, and thus obtains the aperture surface phase distribution.

4. An antenna mirror surface measuring/adjusting apparatus according to claim 1, wherein said arithmetic processor obtains the phase difference between the measured electric fields by developing only a phase of the measured electric field in the complex Fourier series with respect to the driven quantity of said mirror surface panel, and thus obtains the aperture surface phase distribution.

5. An antenna mirror surface measuring/adjusting apparatus according to claim 1, wherein said plane mirror is constructed of a first plane mirror orthogonal to a direction of the gravity, and a second plane mirror parallel to a plane including the direction of the gravity, and wherein said arithmetic processor performs the measurement arithmetic process while the aperture surface of said principal reflection mirror is disposed in parallel to said first plane mirror, and next performs the measurement arithmetic process while the aperture surface of said principal reflection mirror is disposed in parallel to said second plane mirror.

6. An antenna mirror surface measuring/adjusting apparatus according to claim 1, further comprising a high-order mode generator capable of exciting the radio waves radiated from said transmitting/receiving means in a specified high-order mode.

7. An antenna mirror surface measuring/adjusting apparatus according to claim 1, further comprising a high-order mode synthesizer capable of exciting the radio waves radiated from said transmitting/receiving means by synthesizing a plurality of modes.

8. An antenna mirror surface measuring/adjusting apparatus according to claim 1, further comprising an electric supply device capable of independently exciting the radio waves radiated from said transmitting/receiving means respectively in a base mode and in a specified high-order mode.

9. An antenna mirror surface measuring/adjusting apparatus according to claim 1, wherein said arithmetic processor receives, each time said actuator means shifts a position of said single mirror surface panel or shifts simultaneously positions of said plurality of mirror surface panels so that the electric power with which the mirror surface of said principal reflection mirror is irradiated becomes uniform, the radio waves radiated from said transmitting/receiving means and reflected back to said transmitting/receiving means from said plane mirror, then obtains the aperture surface phase distribution in the initial state of said principal reflection mirror by executing the arithmetic process on the received radio waves, and gains the mirror surface configurations therefrom.

10. An antenna mirror surface measuring/adjusting apparatus for measuring a mirror surface of a principal reflection mirror constructed of a group of a plurality of mirror surface panels, and adjusting the mirror panel, said apparatus comprising:

a plane mirror larger than an aperture surface of said principal reflection mirror and set in parallel with the aperture surface;

transmitting/receiving means for transmitting and receiving radio waves between said principal reflection mirror and said plane mirror;

phase shifting means for changing a phase of the radio wave, provided between said plane mirror and said transmitting/receiving means;

actuator means for driving said group of mirror surface panels of said principal reflection mirror; and an arithmetic processor for measuring, each time said phase shifting means changes the phase from an initial state of said mirror surface panel of said principal reflection mirror, radio wave signals of radio waves which are radiated by said transmitting/receiving means and reflected back from said plane mirror, obtaining a phase difference between the measured electric fields by developing the electric power of these measured electric fields in complex Fourier series with respect to a quantity of the phase change by said phase shifting means, obtaining an aperture surface phase distribution in an initial state of said principal reflection mirror therefrom, then gaining configurations of the mirror surface on the basis of the aperture surface phase distribution, and adjusting the mirror surface by use of said actuator means in accordance with the thus obtained mirror surface configurations.

11. An antenna mirror surface measuring/adjusting apparatus for measuring a mirror surface of a principal reflection mirror constructed of a group of a plurality of mirror surface panels, and adjusting the mirror panel, said apparatus comprising:

a plane mirror larger than an aperture surface of said principal reflection mirror, set in parallel with the aperture surface, and constructed of a group of a plurality of segmented plane panels;

transmitting/receiving means for transmitting and receiving radio waves between said principal reflection mirror and said plane mirror;

actuator means for driving said group of mirror surface panels of said principal reflection mirror, and said group of segmented plane panels of said plane mirror; and an arithmetic processor for measuring, each time said actuator means shifts a position of said segmented plane panel from an initial state of said mirror surface panel of said principal reflection mirror, radio wave signals of radio waves which are radiated by said transmitting/receiving means and reflected back from said plane mirror, obtaining an aperture surface phase distribution in an initial state of said principal reflection mirror by executing an arithmetic process on these measured signals, then gaining configurations of the mirror surface on the basis of the aperture surface phase distribution, and adjusting the mirror surface by use of said actuator means in accordance with the thus obtained mirror surface configurations.

12. An antenna mirror surface measuring/adjusting apparatus for measuring a mirror surface of a principal reflection mirror constructed of a group of a plurality of mirror surface panels, and adjusting the mirror panel, said apparatus comprising:

a plane mirror larger than an aperture surface of said principal reflection mirror;

transmitting/receiving means for transmitting and receiving radio waves between said principal reflection mirror and said plane mirror;

actuator means for driving said group of mirror surface panels of said principal reflection mirror; and an arithmetic processor for measuring, each time said actuator means shifts a position of said mirror surface panel from an initial state of said mirror surface panel of said principal reflection mirror, radio wave signals of radio waves which are radiated by said transmitting/receiving means and reflected back from said plane mirror, obtaining an aperture surface phase distribution in an initial state of said principal reflection mirror by executing an arithmetic process on these measured signals, then gaining configurations of the mirror surface on the basis of the aperture surface phase distribution, and adjusting the mirror surface by use of said actuator means in accordance with the thus obtained mirror surface configurations, wherein an aperture surface of said principal reflection mirror is set at an angle orthogonal to an arbitrary side lobe direction with respect to said plane mirror.

* * * * *